US009409707B2

(12) United States Patent
Perkins et al.

(10) Patent No.: US 9,409,707 B2
(45) Date of Patent: Aug. 9, 2016

(54) SECONDARY CONTAINMENT UNIT AND METHODS

(71) Applicant: Falcon Technologies and Services, Inc., Houston, TX (US)

(72) Inventors: Larry L. Perkins, Southlake, TX (US); Mark Conner, Coraopolis, PA (US); Chad Cannan, Cypress, TX (US); Todd Roper, Katy, TX (US); Jack Sheng, Keller, TX (US)

(73) Assignee: FALCON TECHNOLOGIES AND SERVICES, INC., Houston, TX (US)

( * ) Notice: Subject to any disclaimer, the term of this patent is extended or adjusted under 35 U.S.C. 154(b) by 0 days.

(21) Appl. No.: 14/289,708

(22) Filed: May 29, 2014

(65) Prior Publication Data

US 2014/0353310 A1 Dec. 4, 2014

Related U.S. Application Data

(60) Provisional application No. 61/829,835, filed on May 31, 2013, provisional application No. 61/857,419, filed on Jul. 23, 2013.

(51) Int. Cl.
*B65D 90/08* (2006.01)
*B65D 88/08* (2006.01)
(Continued)

(52) U.S. Cl.
CPC ..... *B65D 90/08* (2013.01); *B65D 88/08* (2013.01); *B65D 90/024* (2013.01); *B65D 90/24* (2013.01)

(58) Field of Classification Search
CPC ..... B65D 90/08; B65D 90/24; B65D 90/023; B65D 90/046; E02B 3/106; E04H 12/20; E04H 4/0018; E04H 4/0043; E04H 17/16
USPC ..... 220/4.16, 476, 9.1, 9.3, 9.4; 405/107, 405/110, 114, 52, 129.45, 129.55, 129.6, 405/129.75, 129.8; 52/169.7, 146, 152, 52/102; 256/1, 13, 24, 27, 31; 4/506
See application file for complete search history.

(56) References Cited

U.S. PATENT DOCUMENTS 492,001 A 2/1893 Forgie
1,265,966 A 5/1918 Schlafly
(Continued)

FOREIGN PATENT DOCUMENTS

WO WO2006046038 5/2006
WO WO2009033449 3/2009

OTHER PUBLICATIONS

WO 2004/025033 with English translation.*

*Primary Examiner* — Fenn Mathew
*Assistant Examiner* — Robert Stodola
(74) *Attorney, Agent, or Firm* — Patterson & Sheridan, LLP

(57) ABSTRACT

A modular secondary containment unit that can be adapted to surround an above-ground fluid storage tank and can include a plurality of corner assemblies is described herein. Two or more components of each of the corner assemblies can be composed of one or more reinforced resin composite materials. The modular secondary containment units and the above-ground fluid storage tanks can be used in oil and gas exploration and production operations. An assembly for a modular secondary containment unit can include a track segment including first and second channels, a wall segment mounted on the track segment and extending within the first channel of the track segment, and a brace engaged with the wall segment and extending within the second channel of the track segment. A method of constructing a modular secondary containment unit is also provided.

20 Claims, 46 Drawing Sheets

(51) Int. Cl.
*B65D 90/02* (2006.01)
*B65D 90/24* (2006.01)

(56) References Cited

U.S. PATENT DOCUMENTS 2,378,126 A 6/1945 Blair
4,050,605 A 9/1977 Wakana et al.
4,112,644 A 9/1978 Allen
4,760,932 A 8/1988 Rhodes, Jr.
4,765,775 A 8/1988 Kroger
4,989,751 A 2/1991 Gillett
5,582,311 A 12/1996 Bartenstein et al.
5,592,702 A 1/1997 Gillebaard, Jr.
5,791,098 A * 8/1998 Thomas ..... H02G 9/10 220/4.28
5,800,091 A 9/1998 Van Romer
5,810,511 A 9/1998 Schmidt
6,079,904 A * 6/2000 Trisl ..... E02B 3/106 405/107
6,092,686 A * 7/2000 Shaw ..... E04H 4/0056 220/573
6,230,451 B1 * 5/2001 Stoller ..... A63C 19/10 220/9.4
6,390,325 B1 5/2002 Gonzales
6,431,387 B2 8/2002 Pielher
6,474,496 B1 11/2002 Garton
6,715,243 B1 4/2004 Fons
6,840,711 B1 * 1/2005 Martinez ..... E02B 3/106 405/107
6,874,651 B2 4/2005 Matiere
7,614,825 B2 11/2009 Kroger
7,997,828 B2 * 8/2011 Rijlaarsdam ..... E02B 3/102 256/13
8,540,456 B2 9/2013 Marshall
2004/0118844 A1 6/2004 Bennett et al.
2009/0020527 A1 1/2009 Chen
2010/0329785 A1 * 12/2010 Nero ..... E06B 3/9642 405/16
2013/0240538 A1 * 9/2013 Beak ..... B65D 90/24 220/646
2013/0264348 A1 * 10/2013 Ingalls ..... B65D 90/205 220/565
2013/0277363 A1 * 10/2013 French ..... B65D 90/205 220/4.16

* cited by examiner

SECONDARY CONTAINMENT UNIT AND METHODS

CROSS-REFERENCE TO RELATED APPLICATIONS

This application claims the benefit of the filing date of, and priority to, U.S. patent application No. 61/829,835, filed May 31, 2013, the entire disclosure of which is hereby incorporated herein by reference.

This application claims the benefit of the filing date of, and priority to, U.S. patent application No. 61/857,419, filed Jul. 23, 2013, the entire disclosure of which is hereby incorporated herein by reference.

TECHNICAL FIELD

The present disclosure relates in general to secondary containment units and above-ground fluid storage tanks used in, for example, oilfield processes. In several exemplary embodiments, the secondary containment units and/or above-ground storage tanks are constructed from one or more reinforced resin composites, such as fiber-reinforced resin composites.

BACKGROUND

Above-ground fluid storage tanks are commonly required at oilfield production sites to store fluids such as, for example, water used in hydraulic fracturing operations, or oil, gas, or produced water that flows out of a completed well. Since such tanks may be susceptible to leakage or corrosion-induced catastrophic failure, a surrounding secondary containment unit is often necessary to contain leakage from one or more tanks. A containment unit is typically built at an oilfield production site, and may be constructed using a dirt berm, steel containment structures, concrete traffic-type barriers, or any combination thereof. However, the dirt berm may be permeable to the fluids that it is meant to contain and may not protect the surrounding environment. Steel containment structures may suffer from several flaws such as, for example, heavy weight, susceptibility to corrosion and leakage, and the need for the application of a protective coating of epoxy or polyurea. Concrete traffic-type barriers are also very heavy and may be permeable to the contained fluid and therefore suffer from some of the same drawbacks as steel containment structures.

Above-ground fluid storage tanks are typically made of steel or fiberglass. Such tanks are very heavy, and require heavy equipment on-site for construction and installation, as well as an exceptionally sturdy ground anchoring system. Additionally, steel tank walls are susceptible to corrosion from the contained fluids, often causing structural failure, and include multiple attachment points that are susceptible to leakage. Steel tanks also need to be coated with epoxy or polyurea after construction to deter this leakage and corrosion. This coating process is complicated and expensive. Fiberglass tanks are typically constructed in a monolithic fashion and, while not as susceptible to leakage as steel tanks, they are not widely used due to increased flammability as well as susceptibility to wind damage or destruction, particularly when the tank is empty or partially empty. Due to their lack of rigidity, fiberglass tanks tend to bulge when fluids are placed into them. This makes obtaining a standard measure of their contents difficult by current industry standards. Fiberglass tanks also experience a static charge buildup on the interior of the tank body as a result of fluid movement inside the tank. The buildup of static electricity can create a fire or explosion threat.

Therefore, what is needed is an apparatus or method that addresses one or more of the above-described issues, and/or one or more other issues.

BRIEF DESCRIPTION OF THE DRAWINGS

The accompanying drawings facilitate an understanding of the various exemplary embodiments.

DETAILED DESCRIPTION

Figure 1:
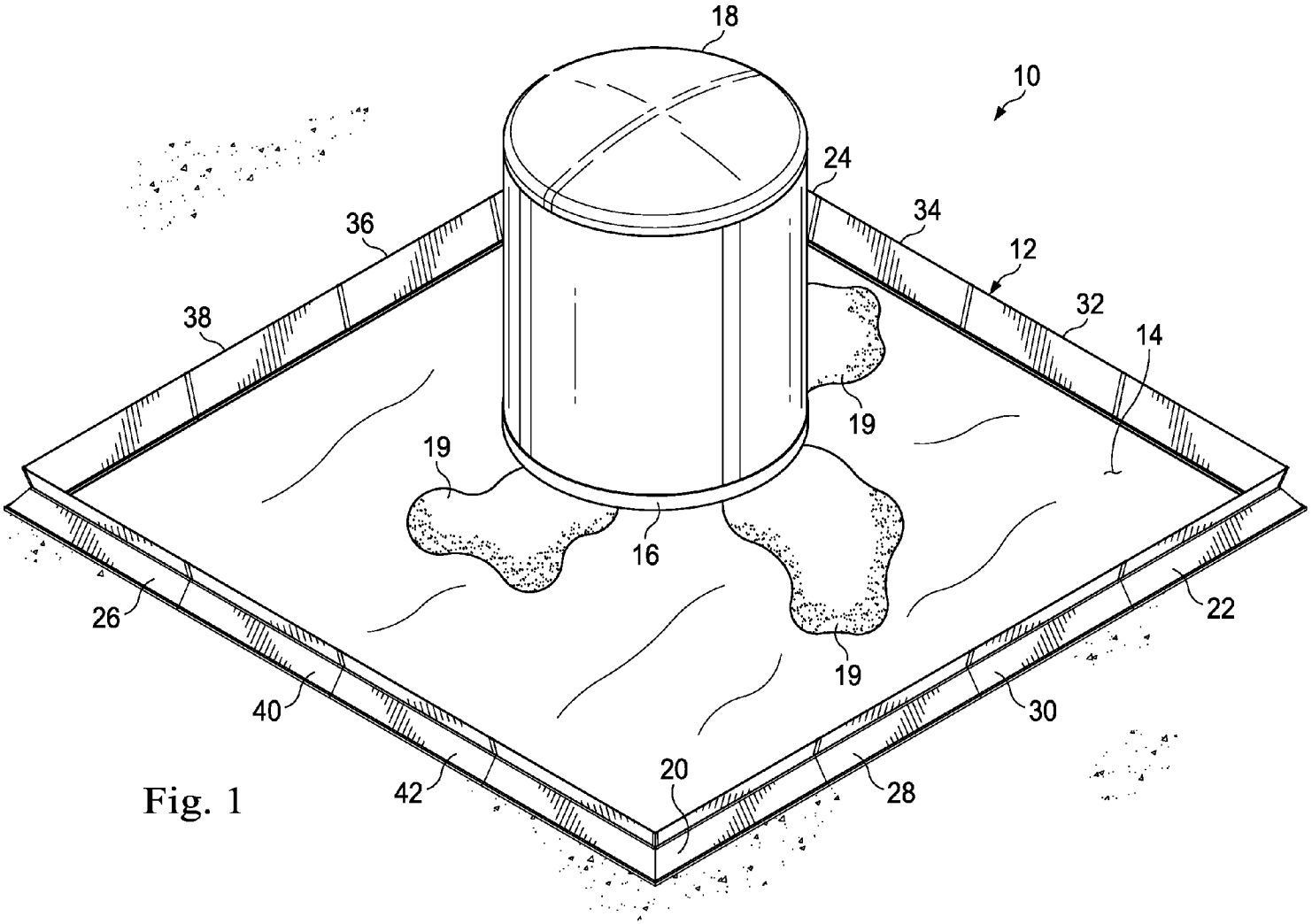
FIG. 1 is a perspective view of a secondary containment unit including a liner and surrounding an above-ground storage tank, according to an exemplary embodiment.

In an exemplary embodiment, as illustrated in FIG. 1, a system is generally referred to by the reference numeral 10 and includes a modular secondary containment unit 12 including a liner 14 that extends over the ground surface. A tank base 16 is positioned on the liner 14. An above-ground fluid storage tank 18 is positioned on, and supported by, the tank base 16. The secondary containment unit 12 surrounds the storage tank 18. In several exemplary embodiments, the overall dimensions of the secondary containment unit 12 are 40 feet by 60 feet. In several exemplary embodiments, the secondary containment unit 12 has a square or rectangular footprint, and ranges from about 10 feet to about 100 feet in length, and from about 10 feet to about 100 feet in width.

In several exemplary embodiments, the liner 14 includes a fabric having an elastomer coating on at least one side thereof, the tank base 16 engaging the side with the elastomer coating. In an exemplary embodiment, the liner 14 includes a fabric and a polyurea coating sprayed thereon; in several exemplary embodiments, the liner 14 includes a geotextile, blown fabric, felt, or other type of fabric with some degree of permeability so that the polyurea coating sufficiently adheres to the fabric and forms a solid impermeable layer. In several exemplary embodiments, the tank base 16 includes one or more polystyrene pieces, each of which is encapsulated with polyurea. In other exemplary embodiments, the tank base 16 is, or includes, a pea gravel installation.

In several exemplary embodiments, the system 10 is located at an oilfield production site. The storage tank 18 is adapted to store fluids such as, for example, water used in hydraulic fracturing operations, or oil, gas, or produced water that flows out of a completed oil and gas well. If the storage tank 18 leaks fluid 19 and/or undergoes catastrophic failure, the secondary containment unit 12 contains the leaked fluid 19 therewithin.

Figure 2:
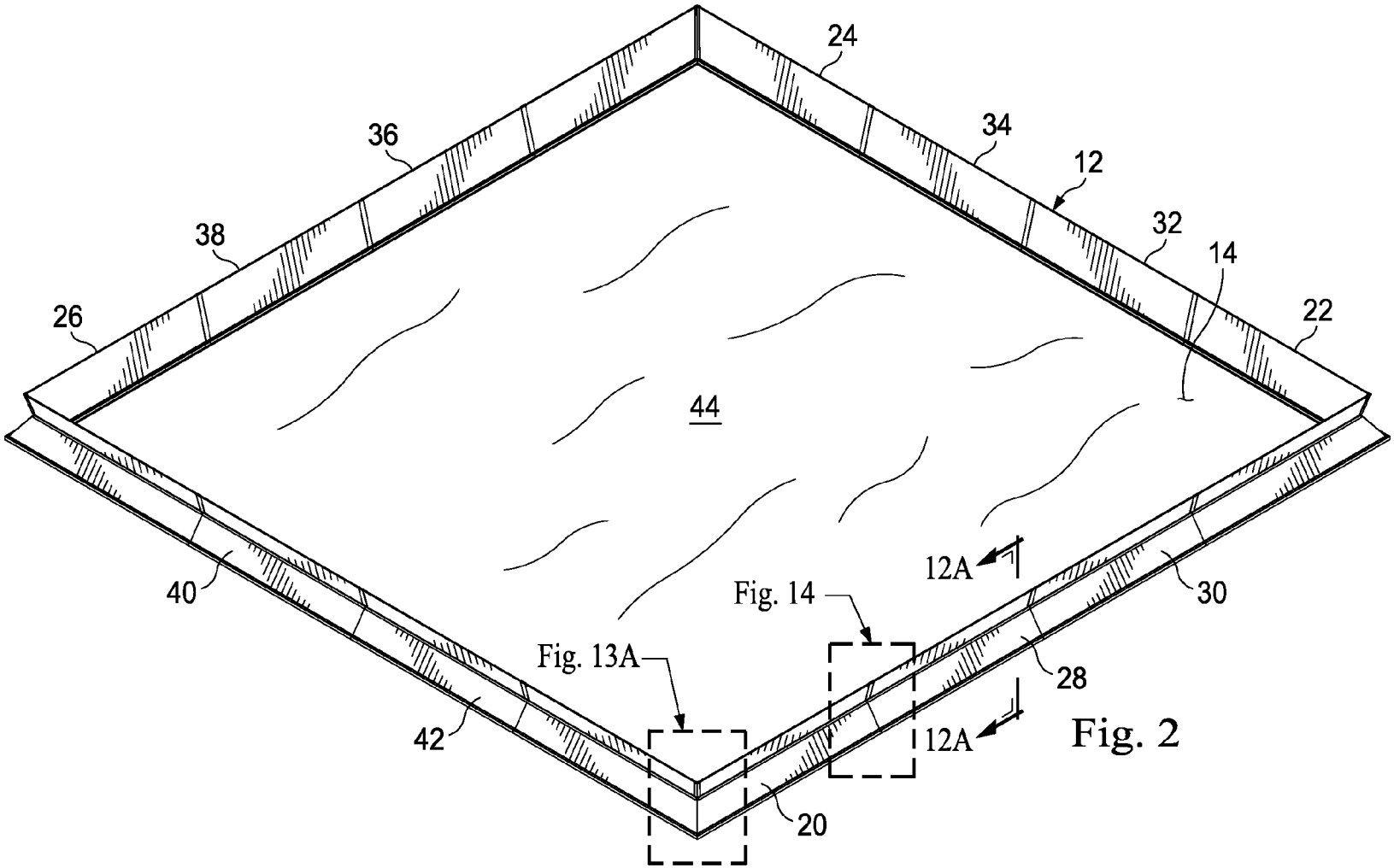
FIG. 2 is a perspective view of the secondary containment unit of FIG. 1, according to an exemplary embodiment.
Figure 3A:
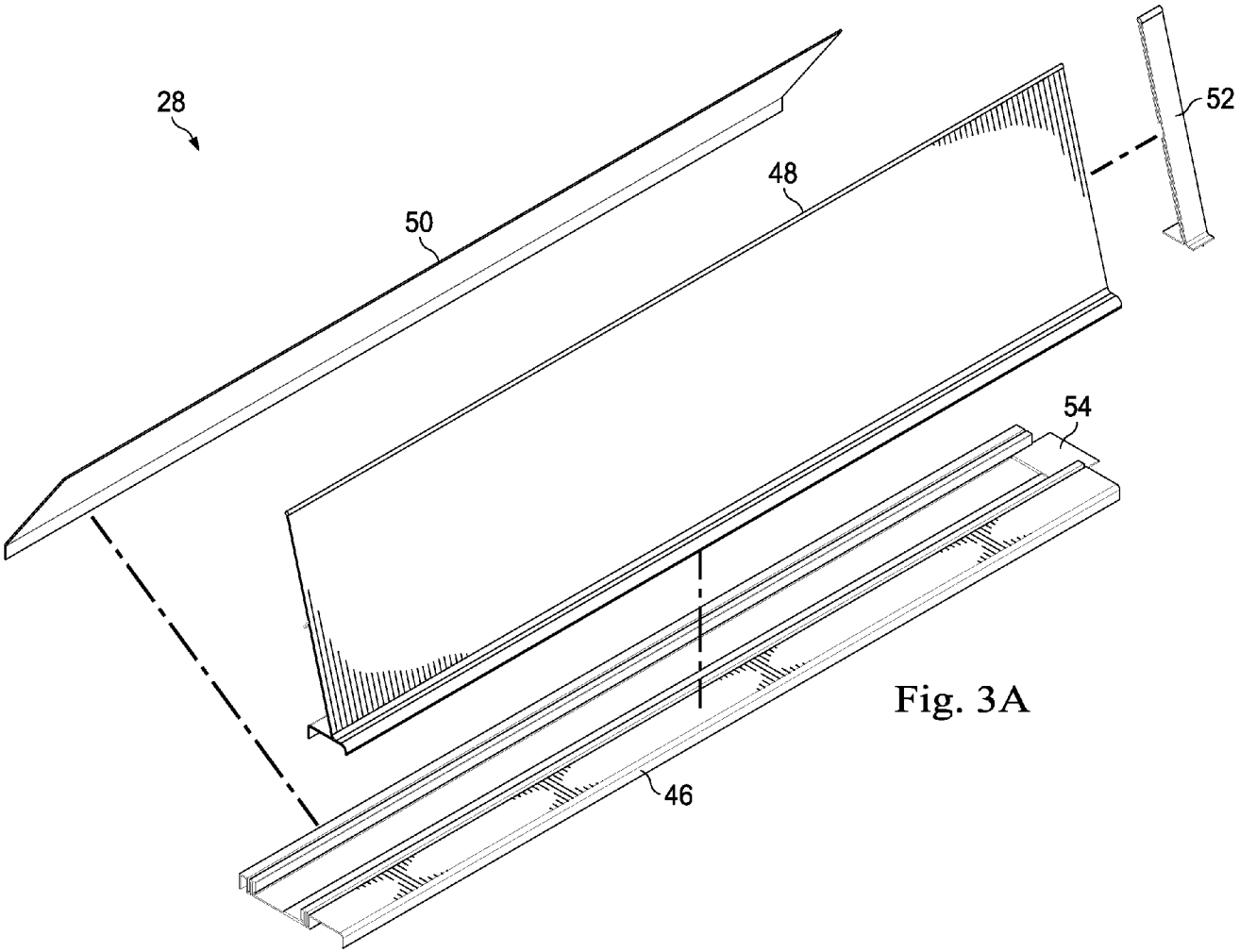
FIG. 3A is an exploded perspective view of a wall assembly of the secondary containment unit of FIGS. 1 and 2, according to an exemplary embodiment.
Figure 3B:
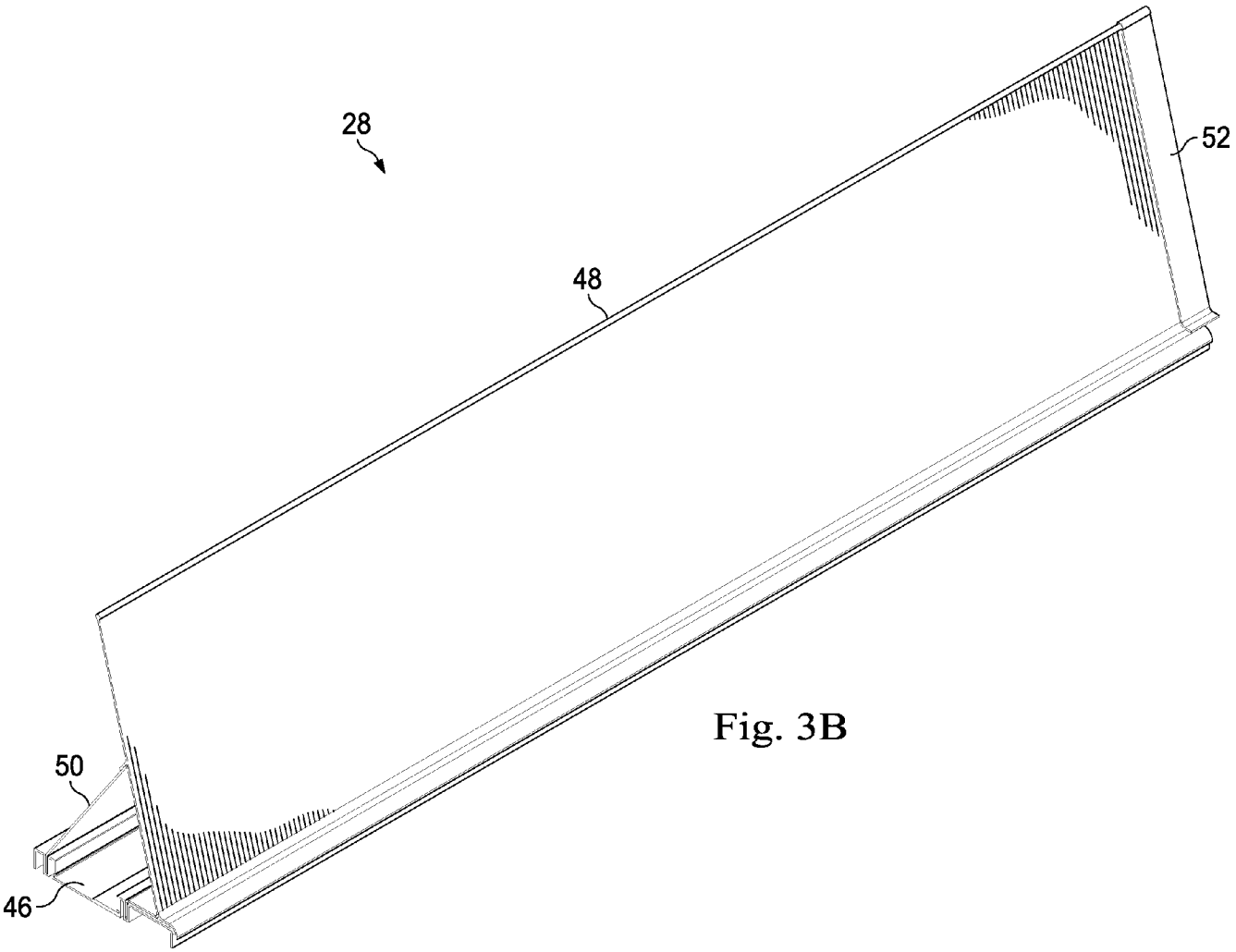
FIG. 3B is an unexploded perspective view of the wall assembly of FIG. 3A, according to an exemplary embodiment.
Figure 3C:
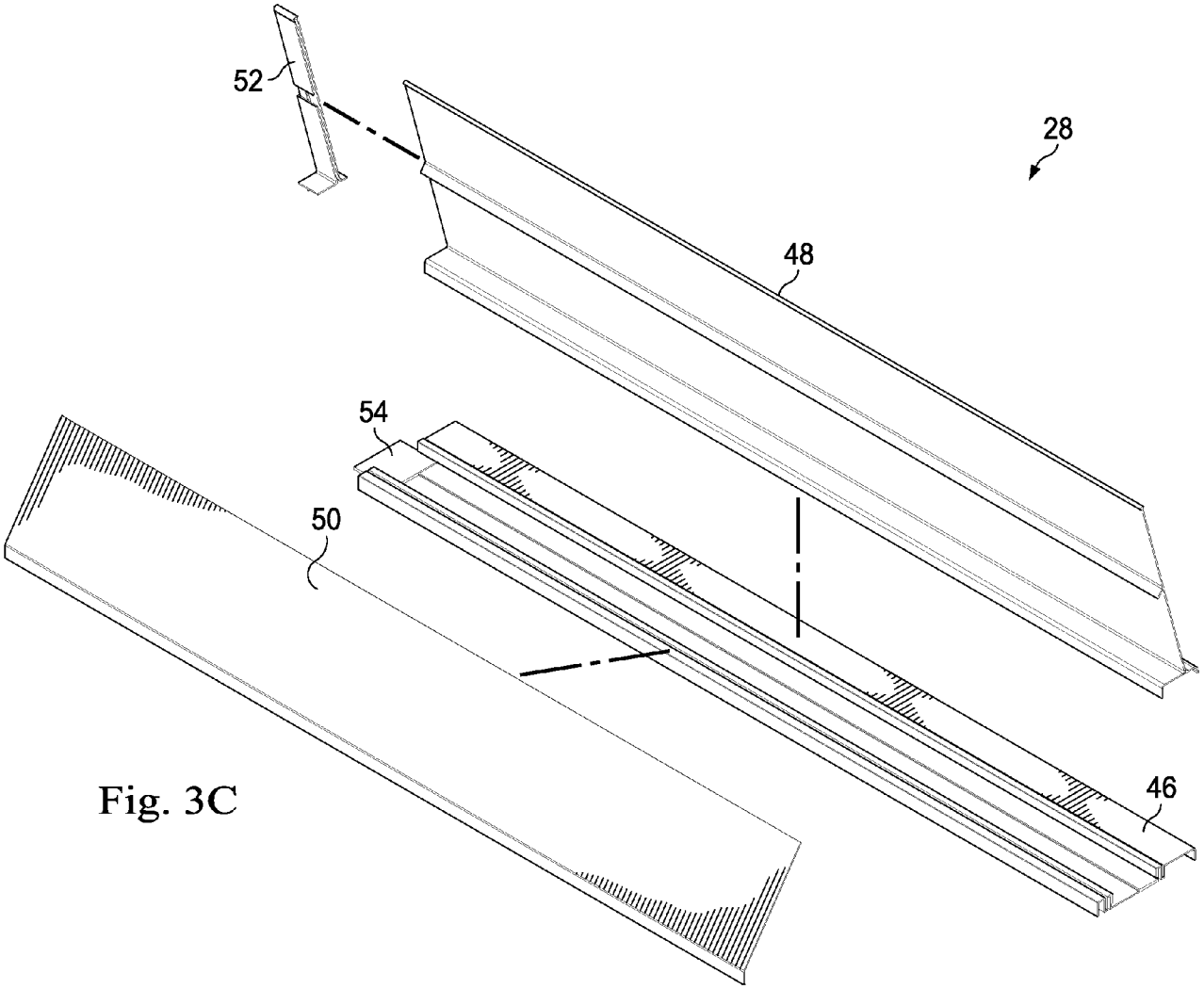
FIG. 3C is another exploded perspective view of the wall assembly of FIGS. 3A and 3B, according to an exemplary embodiment.
Figure 3D:
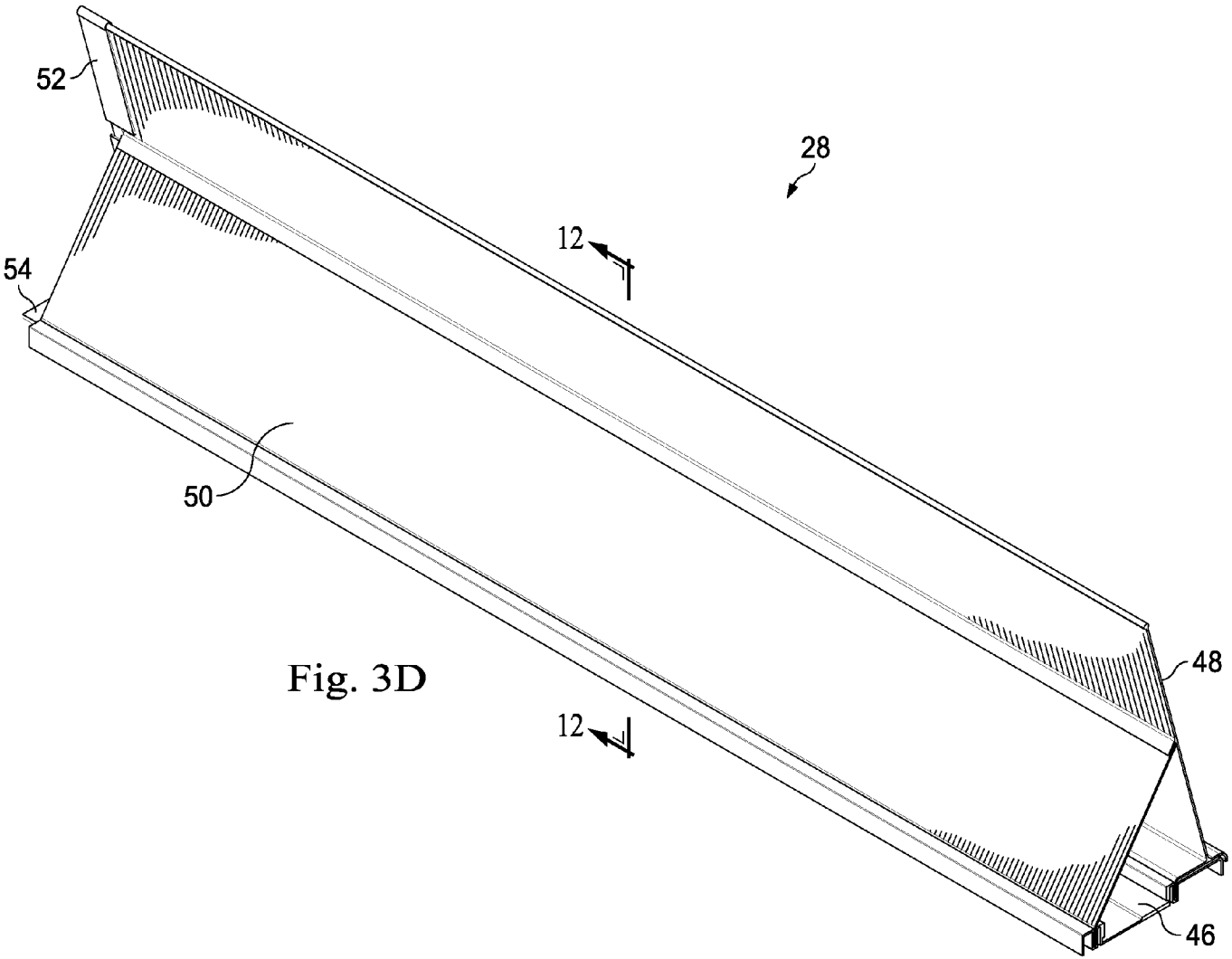
FIG. 3D is another unexploded perspective view of the wall assembly of FIGS. 3A-3C, according to an exemplary embodiment.

In an exemplary embodiment, as illustrated in FIGS. 1 and 2, the secondary containment unit 12 includes corner assemblies 20, 22, 24, and 26, and wall assemblies 28, 30, 32, 34, 36, 38, 40, and 42, all of which are connected together. The wall assembly 28 extends from the corner assembly 20, and the wall assembly 30 extends from the wall assembly 28 to the corner assembly 22. The wall assembly 32 extends from the corner assembly 22, and the wall assembly 34 extends from the wall assembly 32 to the corner assembly 24. The wall assembly 36 extends from the corner assembly 24, and the wall assembly 38 extends from the wall assembly 36 to the corner assembly 26. The wall assembly 40 extends from the corner assembly 26, and the wall assembly 42 extends from the wall assembly 40 to the corner assembly 20. The liner 14 is connected to each of the corner assemblies 20, 22, 24, and 26, and the wall assemblies 28, 30, 32, 34, 36, 38, 40, and 42, and extends across a region 44 of the ground surface defined thereby.

In an exemplary embodiment, as illustrated in FIGS. 3A, 3B, 3C, and 3D with continuing reference to FIGS. 1 and 2, the wall assembly 28 includes a straight track segment 46, a straight wall segment 48, and a straight brace 50. A straight wall connector 52 and a straight track connector 54 are adapted to connect the wall assembly 28 to the corner assembly 20. In several exemplary embodiments, one or both of the straight wall connector 52 and the straight track connector 54 are part of the wall assembly 28. In several exemplary embodiments, one or both of the straight wall connector 52 and the straight track connector 54 are not part of the wall assembly 28.

Figure 4:
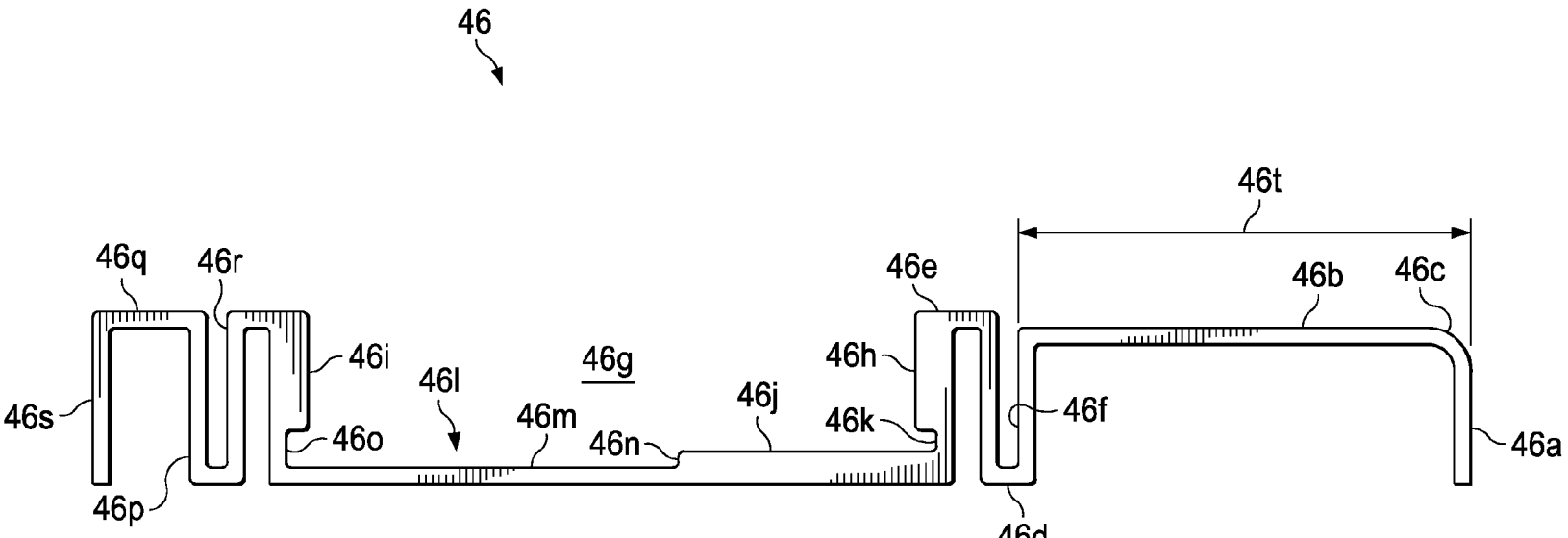
FIG. 4 is an end elevational view of a straight track segment of the wall assembly of FIGS. 3A-3D, according to an exemplary embodiment.

In an exemplary embodiment, as illustrated in FIG. 4 with continuing reference to FIGS. 1-3D, the straight track segment 46 includes a vertically-extending front wall 46*a*, which is adapted to extend upward from the ground surface, and a horizontally-extending portion 46*b*, which is adapted to be vertically offset from the ground surface. A rounded corner 46*c* joins the upper end of the front wall 46*a* to the horizontally-extending portion 46*b*. A U-shaped wall 46*d* extends downward from the horizontally-extending portion 46*b* and back up to a horizontally-extending portion 46*e*. A channel 46*f* is defined by the U-shaped wall 46*d*. A channel 46*g* is formed in the top of the horizontally-extending portion 46*e*, defining parallel-spaced vertical-extending surfaces 46*h* and 46*i*, as well as a horizontally-extending surface 46*j* that is vertically spaced downward from the top of the horizontally-extending portion 46*e*. A groove 46*k* is formed in the vertically-extending surface 46*h* at the lower end portion thereof. The groove 46*k* is adjacent the horizontally-extending surface 46*j*. A recess 461 is formed in the horizontally-spaced surface 46*j*, and defines a horizontally-extending surface 46*m*. A step 46*n* is defined by the recess 461, and extends across the vertical offset between the horizontally-extending surfaces 46*j* and 46*m*. A groove 46*o* is formed in the vertically-extending surface 46*i* at the lower end portion thereof. The groove 46*o* is adjacent the horizontally-extending surface 46*m*. A U-shaped wall 46*p* extends downward from the top of the horizontally-extending portion 46*e* so that the channel 46*g* is disposed between the U-shaped walls 46*d* and 46*p*. The U-shaped wall 46*p* extends back up to a horizontally-extending portion 46*q*. A channel 46*r* is defined by the U-shaped wall 46*p*. A vertically-extending back wall 46*s* extends downward from the edge portion of the horizontally-extending portion 46*q*. A dimension 46*t* is defined by the respective extensions of the rounded corner 46*c* and the horizontally-extending portion 46*b*, the dimension 46*t* being the distance between the front wall 46*a* and the channel 46*f*. In an exemplary embodiment, the dimension 46*t* ranges from about 3 inches to about 3.5 inches.

In several exemplary embodiments, the straight track segment 46 is configured so that it is suitable to be manufactured using a pultrusion process. In several exemplary embodiments, the end view of the straight track segment 46 shown in FIG. 4 is identical in shape to the cross-section of the straight track segment 46 at any point along its length (see, for example, FIGS. 12A and 12B); the cross-section of the straight track segment 46 is configured so that the straight track segment 46 can be manufactured using a pultrusion process. In several exemplary embodiments, the straight track segment 46 is manufactured using a pultrusion process because the straight track segment 46 has a constant cross-section along its length, and because the straight track segment 46 is composed of one or more materials, such as one or more composite materials, that are suitable for use in a pultrusion manufacturing process. In several exemplary embodiments, the straight track segment 46 is manufactured using a pultrusion process and is composed of a material, or a combination of materials, suitable for use in a pultrusion manufacturing process.

Figure 5:
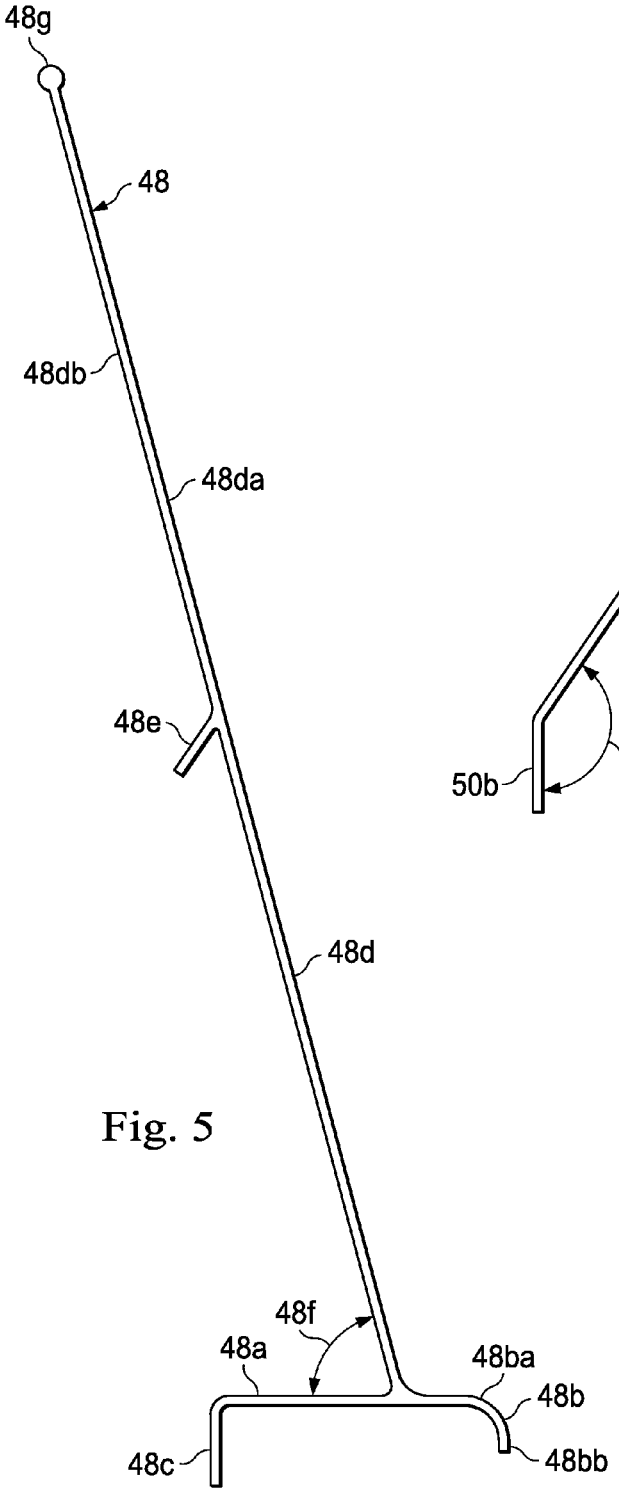
FIG. 5 is an end elevational view of a straight wall segment of the wall assembly of FIGS. 3A-3D, according to an exemplary embodiment.

In an exemplary embodiment, as illustrated in FIG. 5 with continuing reference to FIGS. 1-4, the straight wall segment 48 includes a horizontally-extending portion 48*a* and a front lip 48*b* extending therefrom. The front lip 48*b* includes a rounded corner 48*ba* and a wall or tab 48*bb* extending vertically downward therefrom. A back wall 48*c* extends vertically downward from the horizontally-extending portion 48*a* on the side thereof opposing the front lip 48*b*. An angularly-extending portion 48*d* extends angularly upward from the horizontally-extending portion 48*a*. The angularly-extending portion 48*d* defines an inside surface 48*da* and an outside surface 48*db*. An angular rib 48*e* extends along at least a portion of the outside surface 48*db*. In an exemplary embodiment, the angular rib 48*e* extends along the entire length of the outside surface 48*db*. In several exemplary embodiments, the angular rib 48*e* includes a plurality of rib segments spaced from each other in a line along the length of the outside surface 48*db*. The angular rib 48*e* extends angularly downward from the outside surface 48*db*, forming, when viewed in FIG. 5, an upside-down V shape between the angular rib 48*e* and the outside surface 48*db*. An angle 48*f* is defined between the horizontally-extending portion 48*a* and the angularly-extending portion 48*d*. In an exemplary embodiment, the angle 48*f* ranges from about 10 degrees to about less than 90 degrees. In an exemplary embodiment, the angle 48*f* ranges from about 45 degrees to about 85 degrees. In an exemplary embodiment, the angle 48*f* ranges from about 50 degrees to about 80 degrees. In an exemplary embodiment, the angle 48*f* ranges from about 60 degrees to about 80 degrees. In an exemplary embodiment, the angle 48*f* ranges from about 65 degrees to about 75 degrees. In an exemplary embodiment, the angle 48*f* ranges from about 70 degrees to about 72 degrees. In an exemplary embodiment, the angle 48*f* is about 70 degrees. In an exemplary embodiment, the angle 48*f* is about 71 degrees. In an exemplary embodiment, the angle 48*f* is about 72 degrees. A rib 48*g* having a circular cross-section extends along the top of the angularly-extending portion 48*d*.

In several exemplary embodiments, the straight wall segment 48 is configured so that it is suitable to be manufactured using a pultrusion process. In several exemplary embodiments, the end view of the straight wall segment 48 shown in FIG. 5 is identical in shape to the cross-section of the straight wall segment 48 at any point along its length (see, for example, FIGS. 12A and 12B); the cross-section of the straight wall segment 48 is configured so that the straight wall segment 48 can be manufactured using a pultrusion process. In several exemplary embodiments, the straight wall segment 48 is manufactured using a pultrusion process because the straight wall segment 48 has a constant cross-section along its length, and because the straight wall segment 48 is composed of one or more materials, such as one or more composite materials, that are suitable for use in a pultrusion manufacturing process. In several exemplary embodiments, the straight wall segment 48 is manufactured using a pultrusion process and is composed of a material, or a combination of materials, suitable for use in a pultrusion manufacturing process.

Figure 6:
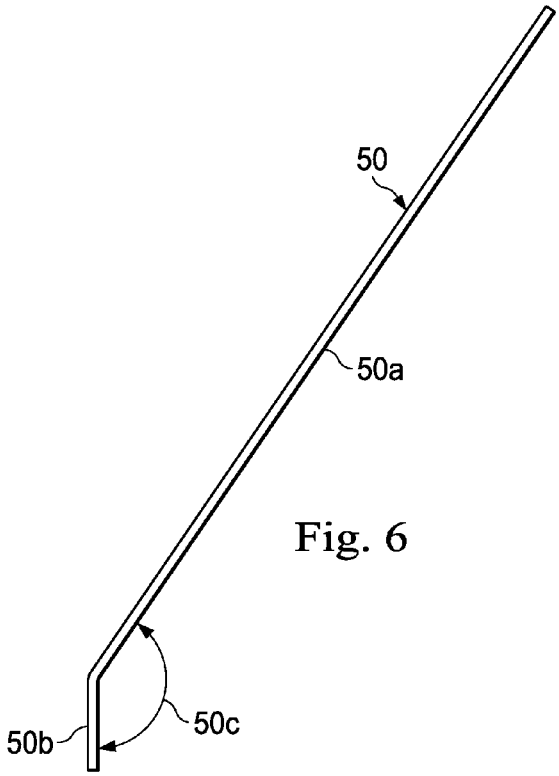
FIG. 6 is an end elevational view of a straight brace of the wall assembly of FIGS. 3A-3D, according to an exemplary embodiment.

In an exemplary embodiment, as illustrated in FIG. 6 with continuing reference to FIGS. 1-5, the straight brace 50 includes a rectangular plate 50*a* and a tab 50*b* extending along the length of the rectangular plate 50*a*. In an exemplary embodiment, the tab 50*b* includes a plurality of tabs spaced from each other in a line along the length of the rectangular plate 50*a*. An angle 50*c* is defined between the rectangular plate 50*a* and the tab 50*b*. In an exemplary embodiment, the angle 50*c* is greater 90 degrees. In an exemplary embodiment, the straight brace 50 includes a plurality of straight braces, each of which is identical to the straight brace 50 but with a shorter length. In several exemplary embodiments, the straight brace 50 is configured so that it is suitable to be manufactured using a pultrusion process. In several exemplary embodiments, the end view of the straight brace 50 shown in FIG. 5 is identical in shape to the cross-section of the straight brace 50 at any point along its length (see, for example, FIGS. 12A and 12B); the cross-section of the straight brace 50 is configured so that the straight brace 50 can be manufactured using a pultrusion process. In several exemplary embodiments, the straight brace 50 is manufactured using a pultrusion process because the straight brace 50 has a constant cross-section along its length, and because the straight brace 50 is composed of one or more materials, such as one or more composite materials, that are suitable for use in a pultrusion manufacturing process. In several exemplary embodiments, the straight brace 50 is manufactured using a pultrusion process and is composed of a material, or a combination of materials, suitable for use in a pultrusion manufacturing process.

Figure 7:
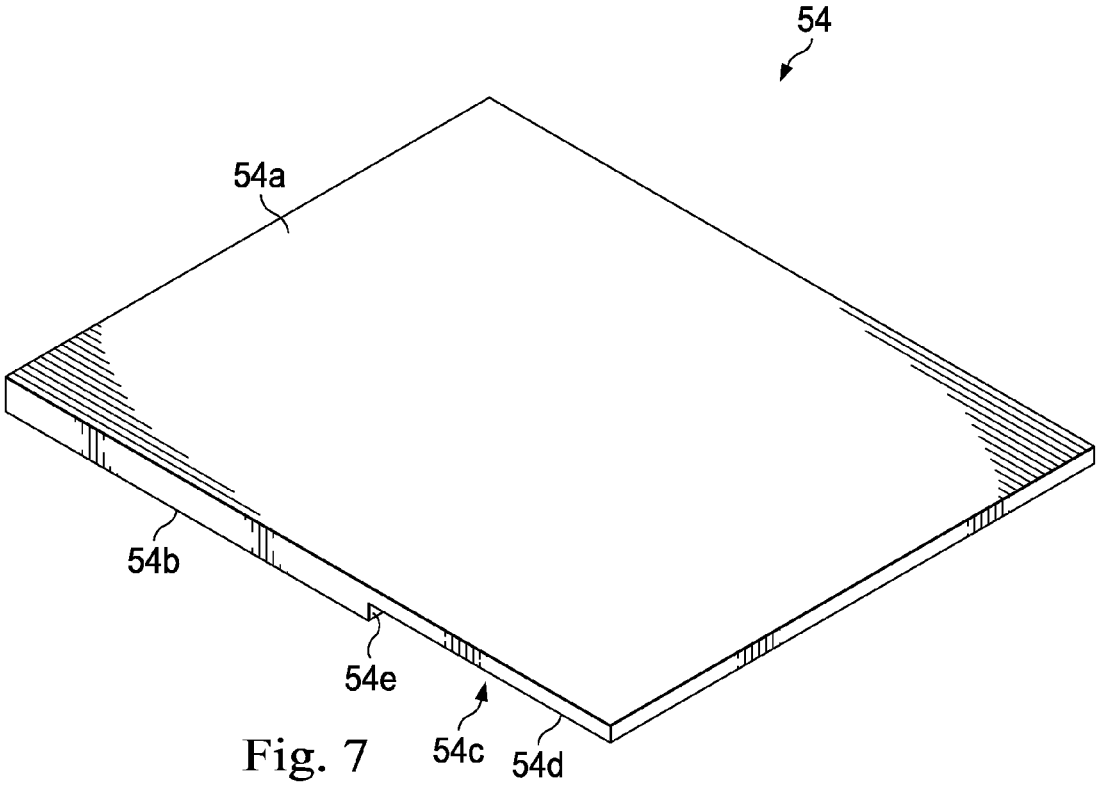
FIG. 7 is a perspective view of a straight track connector of the wall assembly of FIGS. 3A-3D, according to an exemplary embodiment.

In an exemplary embodiment, as illustrated in FIG. 7 with continuing reference to FIGS. 1-6, the straight track connector 54 includes a plate 54*a* that defines a bottom surface 54*b*. A recess 54*c* is formed in the bottom surface 54*b*, and defines a horizontally-extending surface 54*d*. A step 54*e* is defined by the recess 54*c*, and extends across the vertical offset between the bottom surface 54*b* and the horizontally-extending surface 54*d*.

Figure 8A:
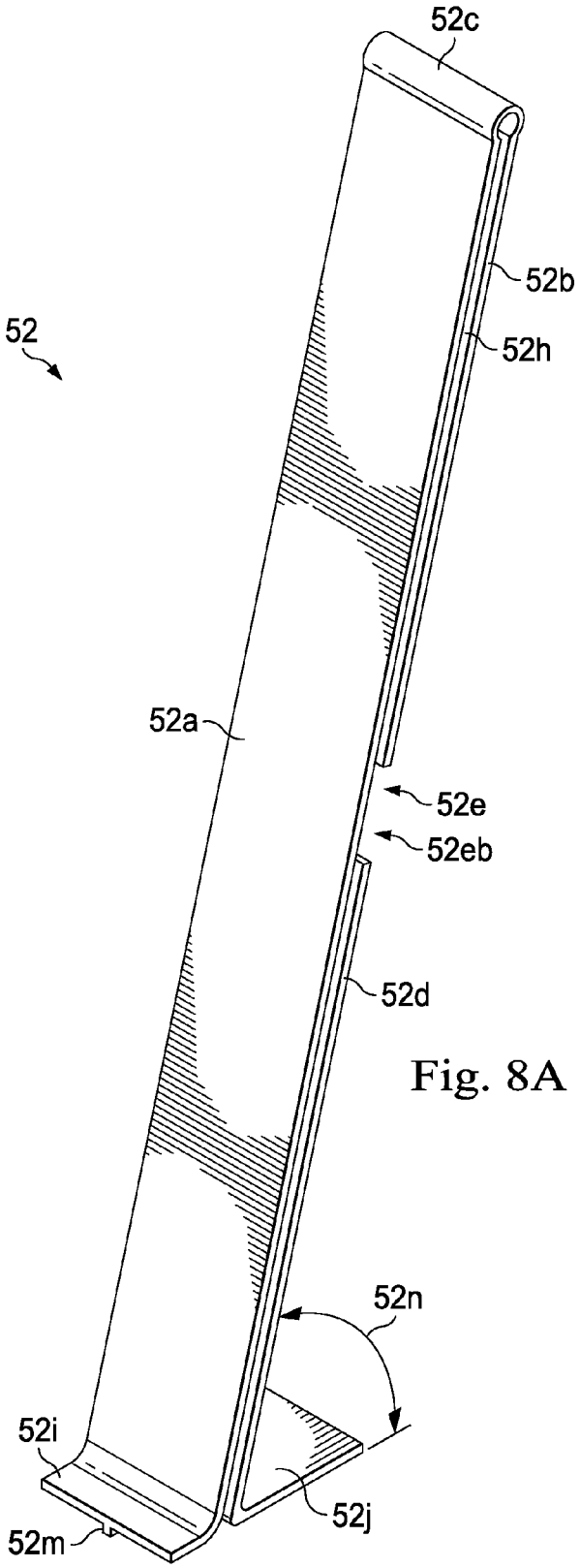
FIGS. 8A-8C are perspective views of a straight wall connector of the wall assembly of FIGS. 3A-3D, according to an exemplary embodiment.
Figure 8B:
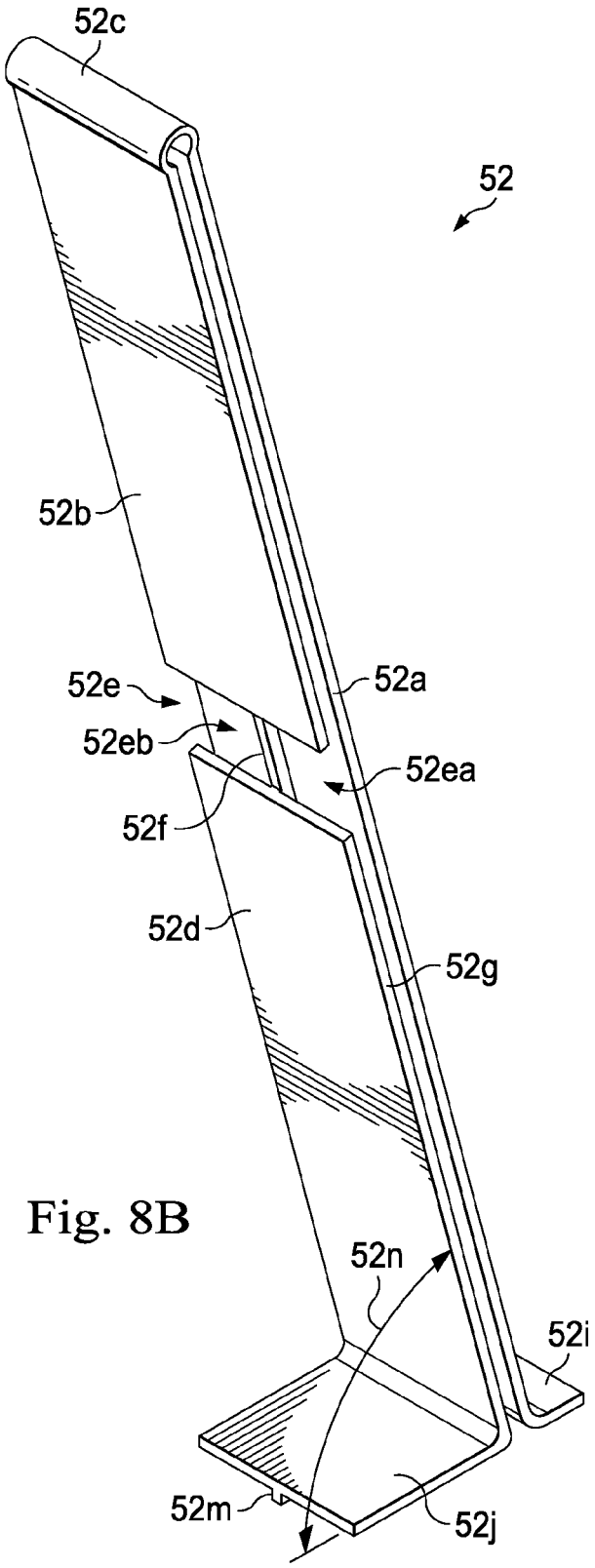
Figure 8C:
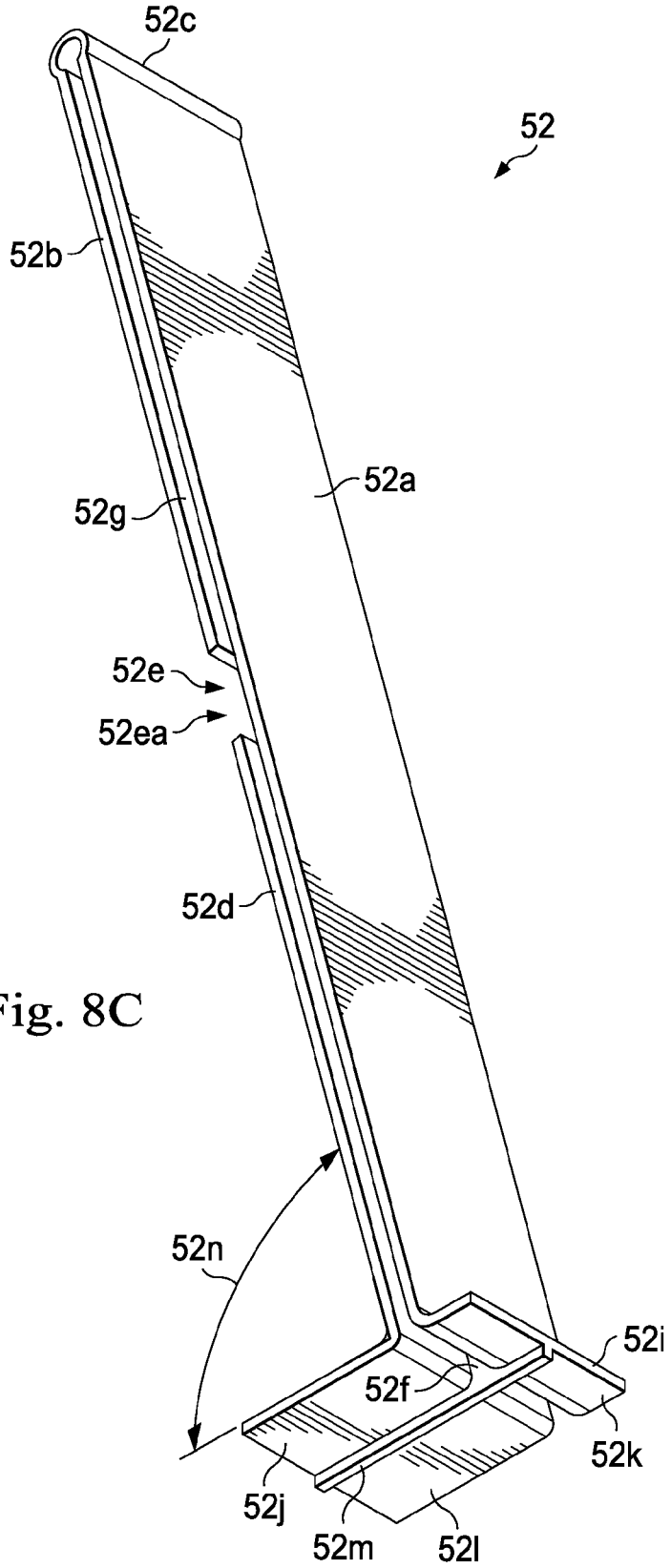
Figure 9A:
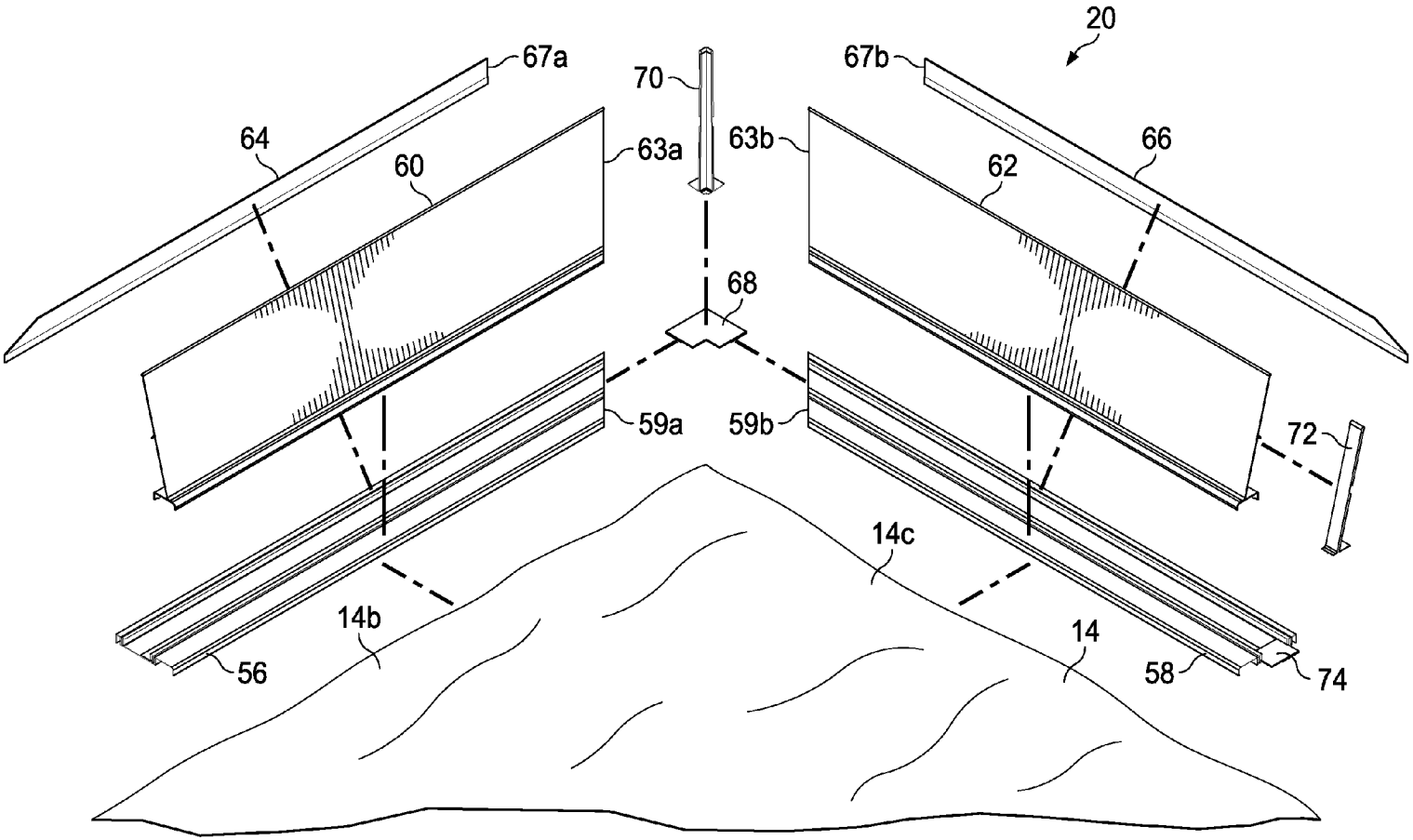
FIG. 9A is an exploded perspective view of a corner assembly of the secondary containment unit of FIGS. 1 and 2, according to an exemplary embodiment.
Figure 9B:
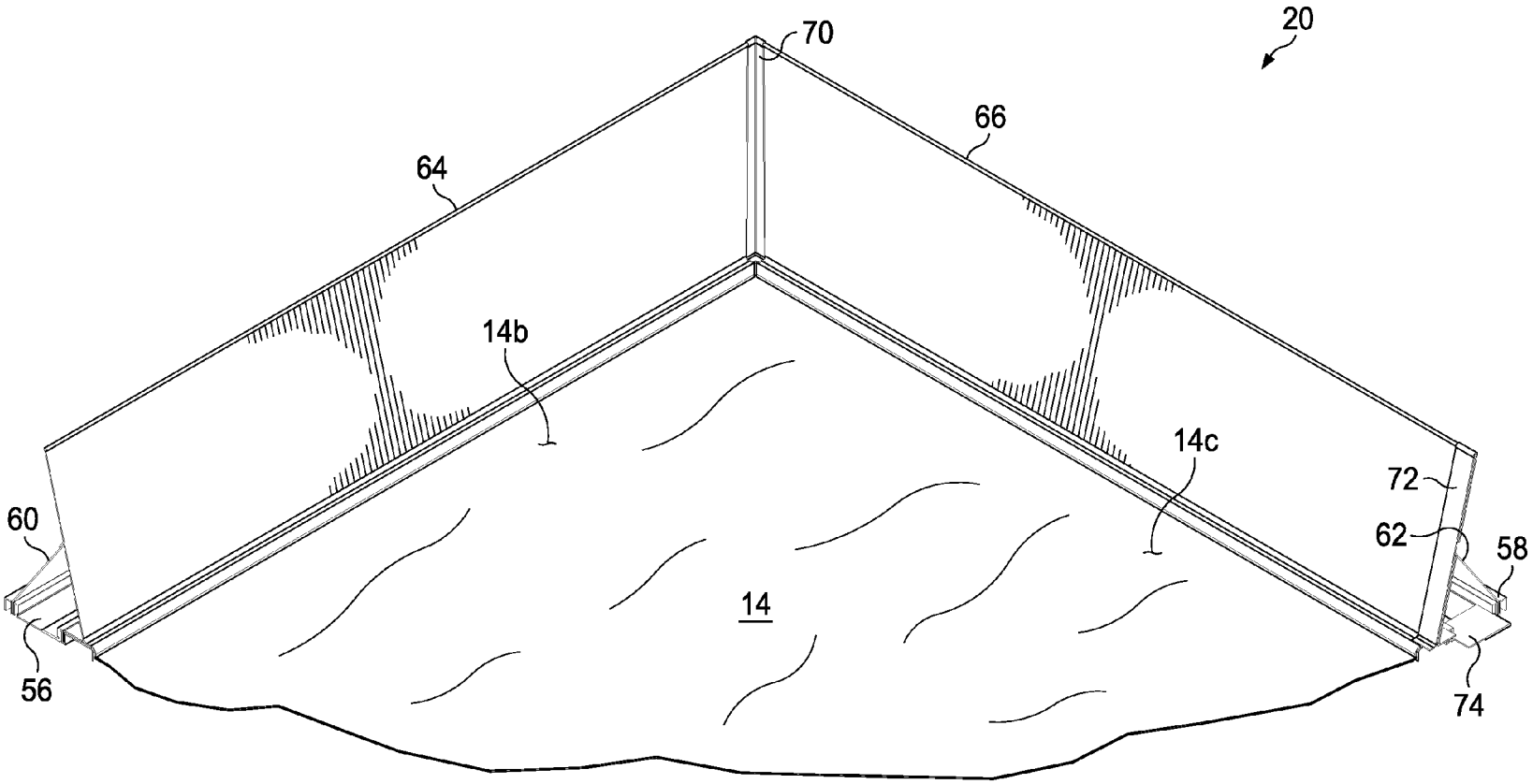
FIG. 9B is an unexploded perspective view of the corner assembly of FIG. 9A, according to an exemplary embodiment.
Figure 9C:
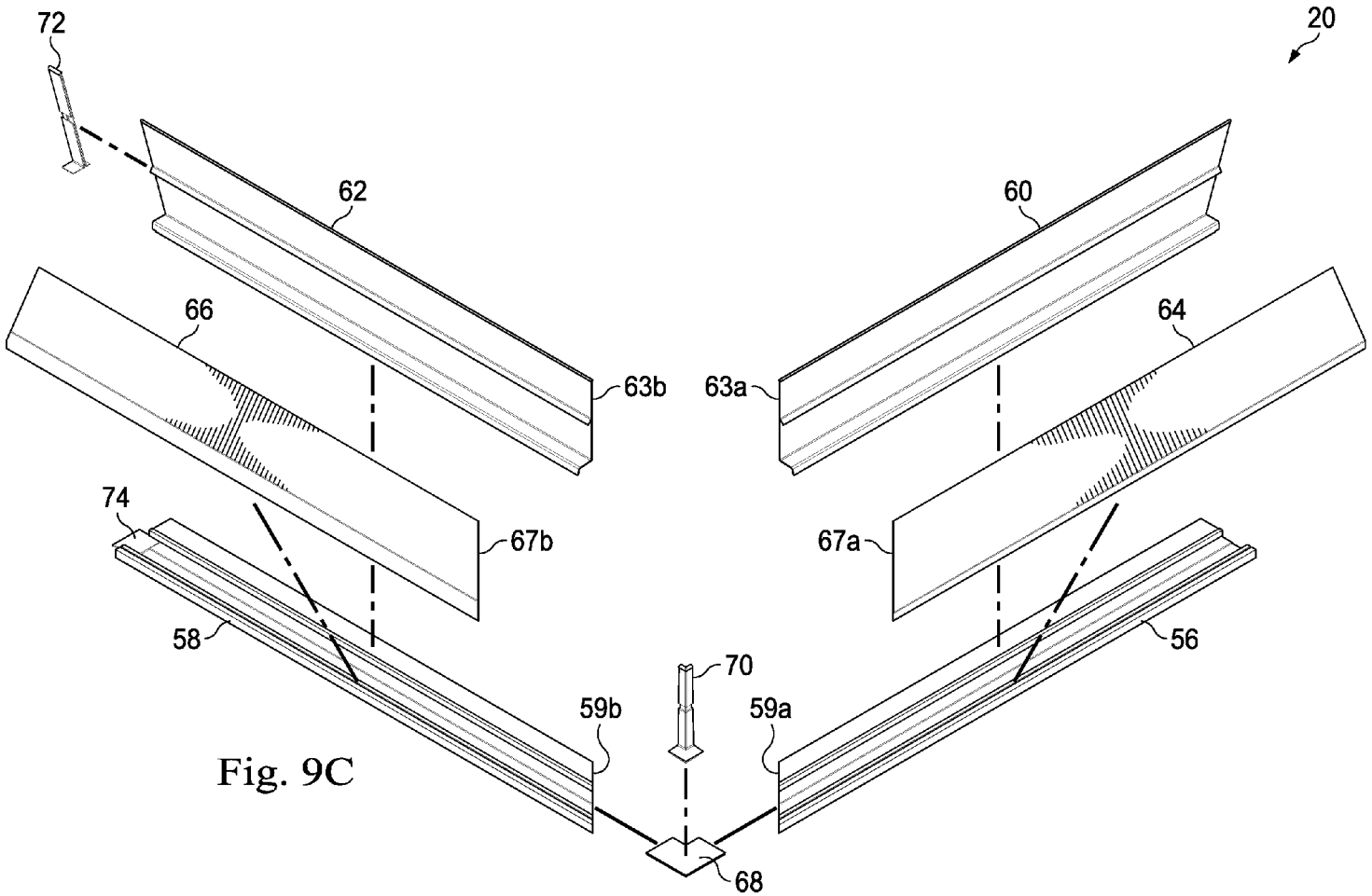
FIG. 9C is another exploded perspective view of the corner assembly of FIGS. 9A and 9B, according to an exemplary embodiment.
Figure 9D:
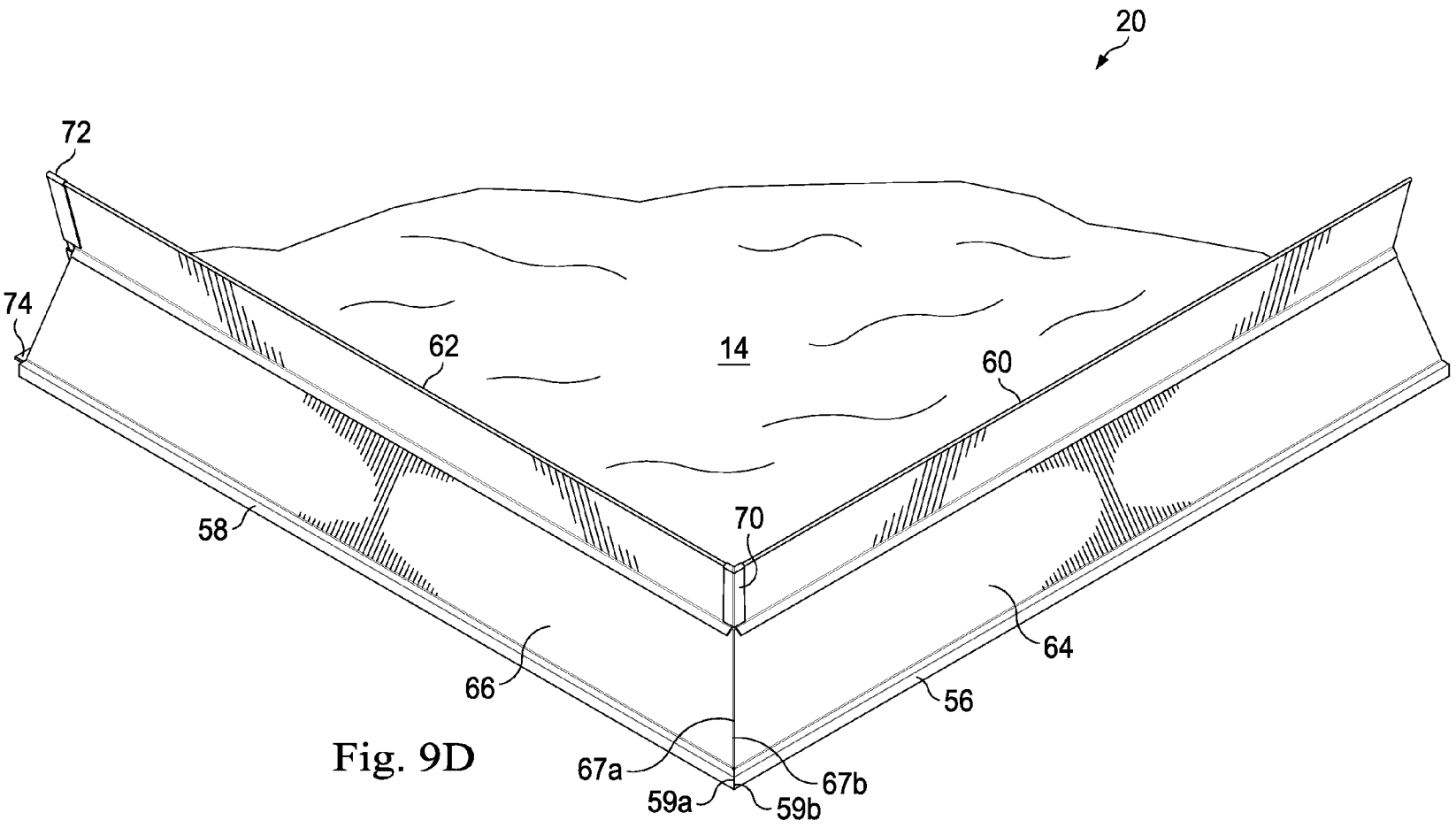
FIG. 9D is another unexploded perspective of the corner assembly of FIGS. 9A-9C, according an exemplary embodiment.

In an exemplary embodiment, as illustrated in FIGS. 8A, 8B, and 8C with continuing reference to FIGS. 1-7, the straight wall connector 52 includes a front planar portion 52*a* and an upper back planar portion 52*b* spaced in a parallel relation therefrom. A tubular feature 52*c* joins the respective upper end portions of the planar portions 52*a* and 52*b*. A lower back planar portion 52*d* is spaced from, and coplanar with, the upper back planar portion 52*b*; thus, the lower back planar portion 52*d* is also spaced from the front planar portion 52*a* in a parallel relation. A spacing 52*e* is defined between the back planar portions 52*b* and 52*d*. A rib 52*f* is connected to, and extends between, the planar portions 52*a* and 52*b*, as well as between the planar portions 52*a* and 52*d*. The rib 52*f* extends along the respective lengths of the planar portions 52*a*, 52*b*, and 52*d*. The rib 52*f* divides the spacing 52*e* into spacing portions 52*ea* and 52*eb*. A channel 52*g* is defined by the front planar portion 52*a*, the back planar portions 52*b* and 52*d*, and the rib 52*f*. A channel 52*h* is also defined by the front planar portion 52*a*, the back planar portions 52*b* and 52*d*, and the rib 52*f*. The rib 52*f* separates, and is the boundary between, the channels 52*g* and 52*h*. A front tab 52*i* extends from the lower end portion of the front planar portion 52*a*. A back tab 52*j* extends from the lower end portion of the lower back planar portion 52*d* in a direction opposite the direction of extension of the front tab 52*i*. The front tab 52*i* and the back tab 52*j* define generally coplanar bottom surfaces 52*k* and 52*l*, respectively. A rib 52*m* extends along the bottom surfaces 52*k* and 52*l*. The rib 52*m* is connected to the rib 52*f* at the lower end portion thereof.

An angle 52*n* is defined between the lower back planar portion 52*d* and the back tab 52*j*. In an exemplary embodiment, the angle 52*n* is equal to the angle 48*f*. In an exemplary embodiment, the angle 52*n* ranges from about 10 degrees to about less than 90 degrees. In an exemplary embodiment, the angle 52*n* ranges from about 45 degrees to about 85 degrees. In an exemplary embodiment, the angle 52*n* ranges from about 50 degrees to about 80 degrees. In an exemplary embodiment, the angle 52*n* ranges from about 60 degrees to about 80 degrees. In an exemplary embodiment, the angle 52*n* ranges from about 65 degrees to about 75 degrees. In an exemplary embodiment, the angle 52*n* ranges from about 70 degrees to about 72 degrees. In an exemplary embodiment, the angle 52*n* is about 70 degrees. In an exemplary embodiment, the angle 52*n* is about 71 degrees. In an exemplary embodiment, the angle 52*n* is about 72 degrees.

In an exemplary embodiment, each of the wall assemblies 30, 32, 34, 36, 38, 40, and 42 is identical to the wall assembly 28 and thus the respective combinations of components of the wall assemblies 30, 32, 34, 36, 38, 40, and 42 will not be described in further detail. In the description below, any components of the wall assemblies 30, 32, 34, 36, 38, 40, and 42 will be given the same reference numerals as the corresponding components of the wall assembly 28.

In an exemplary embodiment, as illustrated in FIGS. 9A, 9B, 9C, and 9D with continuing reference to FIGS. 1-8C, the corner assembly 20 includes: corner track segments 56 and 58 including mitered end portions 59*a* and 59*b*, respectively; corner wall segments 60 and 62 including mitered end portions 63*a* and 63*b*, respectively; corner braces 64 and 66 including mitered end portions 67*a* and 67*b*, respectively; a corner track connector 68; and a corner wall connector 70. A straight wall connector 72 and a straight track connector 74 are adapted to connect the corner assembly 20 to the wall assembly 42. The straight wall connector 72 and the straight track connector 74 are identical to the straight wall connector 52 and the straight track connector 54, respectively, of the wall assembly 28; therefore, the straight wall connector 72 and the straight track connector 74 will not be described in further detail. In the description below, reference numerals used to refer to features of the straight wall connector 72 and the straight track connector 74 will correspond to the reference numerals for the features of the straight wall connector 52 and the straight track connector 54, respectively, except that the numeric prefix for each of the reference numerals used to describe the straight wall connector 52 or the straight track connector 54, that is, 52 or 54, will be replaced by numeric prefixes of the straight wall connector 72 or the straight track connector 74, that is, 72 or 74. In several exemplary embodiments, one or both of the straight wall connector 72 and the straight track connector 74 are part of the corner assembly 20. In several exemplary embodiments, one or both of the straight wall connector 72 and the straight track connector 74 are not part of the wall assembly 28.

In an exemplary embodiment, each of the corner track segments 56 and 58 is identical to the straight track segment 46, except that the corner track segments 56 and 58 include the mitered end portions 59*a* and 59*b*, respectively. That is, instead of the opposing end edges of the corner track segment 56 being spaced in a parallel relation, an angle is defined between the mitered end portion 59*a* and the non-mitered end portion opposing the mitered end portion 59*a*; in several exemplary embodiments, the angle ranges from about 10 degrees to about 80 degrees, and, in an exemplary embodiment, the angle is about 45 degrees. Likewise, instead of the opposing end edges of the corner track segment 58 being spaced in a parallel relation, an angle is defined between the mitered end portion 59*b* and the non-mitered end portion opposing the mitered end portion 59*b*; in several exemplary embodiments, the angle ranges from about 10 degrees to about 80 degrees, and, in an exemplary embodiment, the angle is about 45 degrees. Since with the exception of the mitered end portions 59*a* and 59*b* each of the corner track segments 56 and 58 is identical to the straight track segment 46, the corner track segments 56 and 58 will not be described in further detail. In the description below, reference numerals used to refer to features of the corner track segments 56 and 58 will correspond to the reference numerals for the features of the straight track segment 46, except that the numeric prefix for the reference numerals used to describe the straight track segment 46, that is, 46, will be replaced by numeric prefixes of the corner track segments 56 and 58, that is, 56 and 58.

In an exemplary embodiment, each of the corner wall segments 60 and 62 is identical to the straight wall segment 48, except that the corner wall segments 60 and 62 include the mitered end portions 63*a* and 63*b*, respectively. That is, instead of the opposing end edges of the corner track segment 60 being spaced in a parallel relation, an angle is defined between the mitered end portion 63*a* and the non-mitered end portion opposing the mitered end portion 63*a*; in several exemplary embodiments, the angle ranges from about 10 degrees to about 80 degrees, and, in an exemplary embodiment, the angle is about 45 degrees. Likewise, instead of the opposing end edges of the corner track segment 62 being spaced in a parallel relation, an angle is defined between the mitered end portion 63*b* and the non-mitered end portion opposing the mitered end portion 63*b*; in several exemplary embodiments, the angle ranges from about 10 degrees to about 80 degrees, and, in an exemplary embodiment, the angle is about 45 degrees. Since with the exception of the mitered end portions 63*a* and 63*b* each of the corner wall segments 60 and 62 is identical to the straight wall segment 48, the corner wall segments 60 and 62 will not be described in further detail. In the description below, reference numerals used to refer to features of the corner wall segments 60 and 62 will correspond to the reference numerals for the features of the straight wall segment 48, except that the numeric prefix for the reference numerals used to describe the straight wall segment 48, that is, 48, will be replaced by numeric prefixes of the corner wall segments 60 and 62, that is, 60 and 62.

In an exemplary embodiment, each of the corner braces 64 and 66 is identical to the straight brace 50, except that the corner braces 64 and 66 include the mitered end portions 67*a* and 67*b*, respectively. That is, instead of the opposing end edges of the corner brace 64 being spaced in a parallel relation, an angle is defined between the mitered end portion 67*a* and the non-mitered end portion opposing the mitered end portion 67*a*; in several exemplary embodiments, the angle ranges from about 10 degrees to about 80 degrees, and, in an exemplary embodiment, the angle is about 45 degrees. Likewise, instead of the opposing end edges of the corner brace 66 being spaced in a parallel relation, an angle is defined between the mitered end portion 67*b* and the non-mitered end portion opposing the mitered end portion 67*b*; in several exemplary embodiments, the angle ranges from about 10 degrees to about 80 degrees, and, in an exemplary embodiment, the angle is about 45 degrees. Since with the exception of the mitered end portions 67*a* and 67*b* each of the corner braces 64 and 66 is identical to the straight brace 50, the corner braces 64 and 66 will not be described in further detail. In the description below, reference numerals used to refer to features of the corner braces 64 and 66 will correspond to the reference numerals for the features of the straight brace 50, except that the numeric prefix for the reference numerals used to describe the straight brace 50, that is, 50, will be replaced by numeric prefixes of the corner braces 64 and 66, that is, 64 and 66.

In several exemplary embodiments, each of the corner track segments 56 and 58, the corner wall segments 60 and 62, and the corner braces 64 and 66, is manufactured using a pultrusion process and has a constant cross-section along its length after the pultrusion process; subsequently, in several exemplary embodiments, the corresponding mitered end portion 59*a*, 59*b*, 63*a*, 63*b*, 67*a*, or 67*b* is formed by, for example, a cutting process during which the component is cut to form the mitered end portion. In several exemplary embodiments, each of the corner track segments 56 and 58, the corner wall segments 60 and 62, and the corner braces 64 and 66, is composed of one or more materials, such as one or more composite materials, that are suitable for use in a pultrusion manufacturing process.

Figure 10:
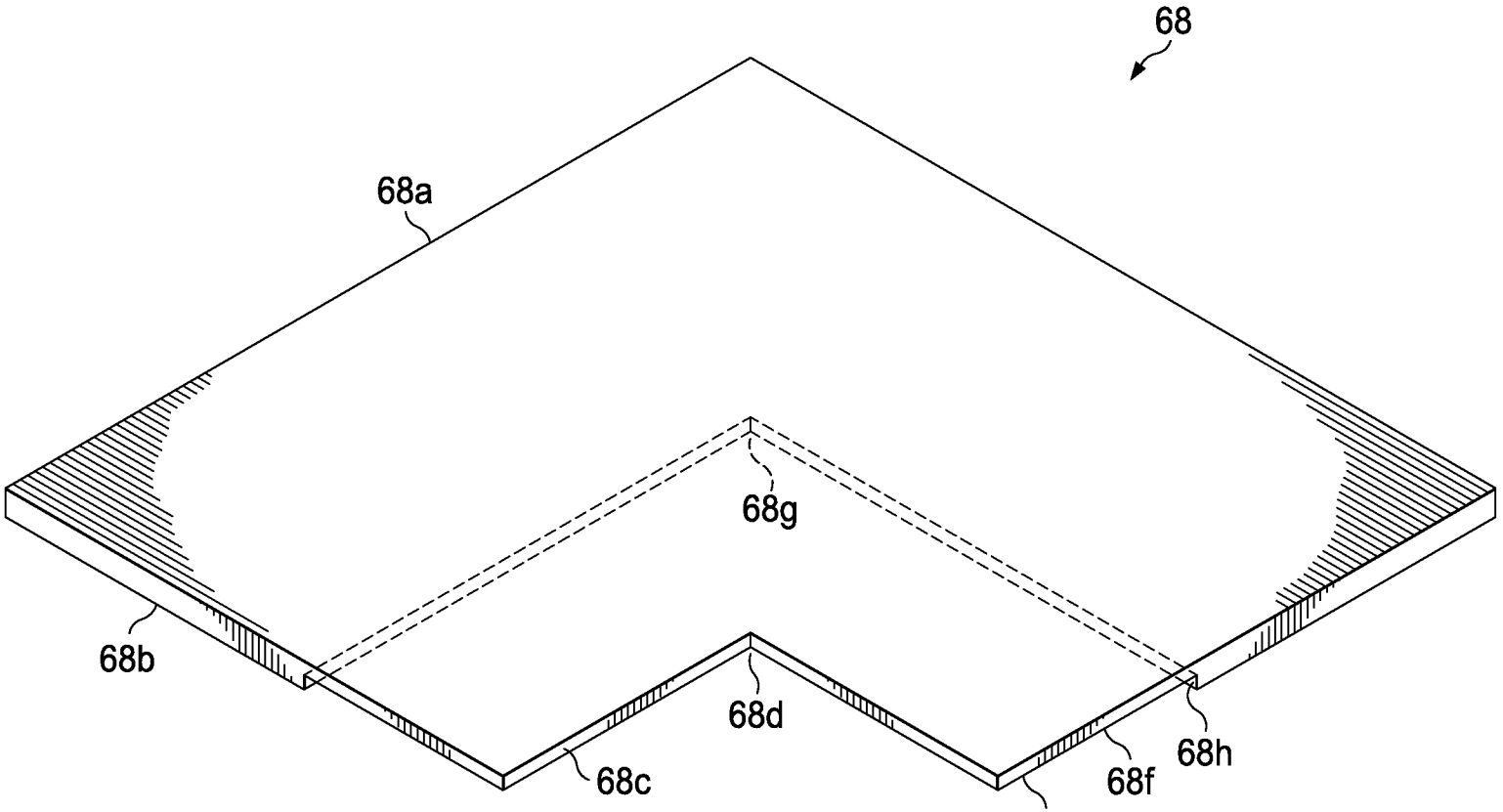
FIG. 10 is a perspective view of a corner track connector of the corner assembly of FIGS. 9A-9D, according to an exemplary embodiment.

In an exemplary embodiment, as illustrated in FIG. 10 with continuing reference to FIGS. 1-9, the corner track connector 68 includes a plate 68*a* that defines a bottom surface 68*b*. A notch 68*c* is formed in one corner of the plate 68*a*, defining an internal corner 68*d*. A recess 68*e* is formed in the bottom surface 68*b* proximate the notch 68*c*. The recess 68*e* defines a horizontally-extending surface 68*f*, an internal corner 68*g*, and a step 68*h*. The step 68*h* extends across the vertical offset between the bottom surface 68*b* and the horizontally-extending surface 68*f*.

Figure 11A:
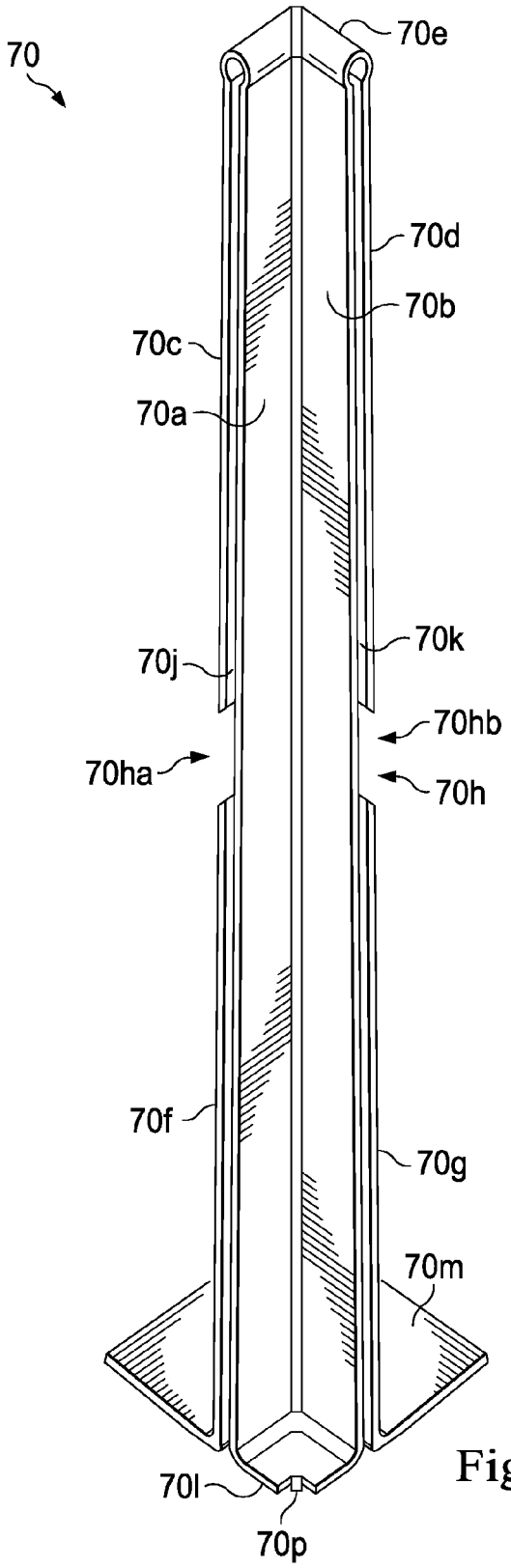
FIGS. 11A and 11B are perspective views of a corner wall connector of the corner assembly of FIGS. 9A-9D, according to an exemplary embodiment.
Figure 11B:
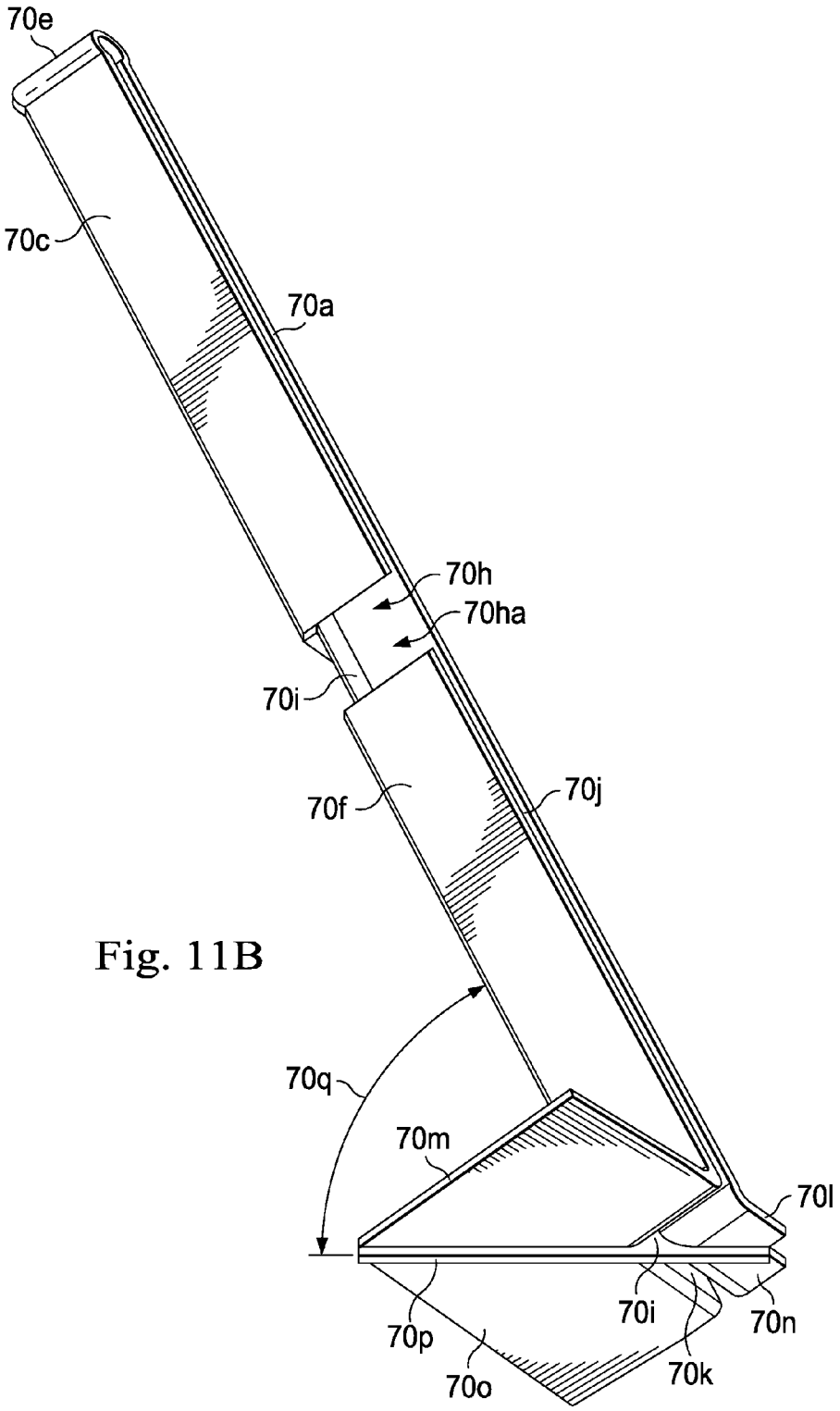

In an exemplary embodiment, as illustrated in FIGS. 11A and 11B with continuing reference to FIGS. 1-10, the corner wall connector 70 includes front planar portions 70*a* and 70*b* connected together in a generally perpendicular relation. Upper back planar portions 70*c* and 70*d* are connected together in a generally perpendicular relation. The upper back planar portions 70*c* and 70*d* are nested with the front planar portions 70*a* and 70*b* so that the front planar portion 70*a* and the upper back planar portion 70*c* are spaced in a parallel relation, and so that the front planar portion 70*b* and the upper back planar portion 70*d* are spaced in a parallel relation. A corner tubular feature 70*e* joins the respective upper end portions of the planar portions 70*a* and 70*c*, as well as the respective upper end portions of the planar portions 70*b* and 70*d*. Lower back planar portions 70*f* and 70*g* are connected together in a perpendicular relation. The lower back planar portions 70*f* and 70*g* are spaced from the upper back portions 70*c* and 70*d* so that the planar portions 70*c* and 70*f* are coplanar, and so that the planar portions 70*d* and 70*g* are coplanar; thus, the lower back planar portions 70*f* and 70*g* are also spaced in a parallel relation from the front planar portions 70*a* and 70*b*, respectively. A spacing 70*h* is defined between the upper back planar portions 70*c* and 70*d* and the lower back planar portions 70*f* and 70*g*.

A rib 70*i* is connected to, and extends between, the respective corners formed by the front planar portions 70*a* and 70*b* and the upper back planar portions 70*c* and 70*d*, as well as between the front planar portions 70*a* and 70*b* and the lower back planar portions 70*f* and 70*g*. The rib 70*i* extends along the respective lengths of the planar portions 70*a*, 70*b*, 70*c*,

70*d*, 70*f*, and 70*g*. The rib 70*i* divides the spacing 70*h* into spacing portion 70*ha* between the planar portions 70*c* and 70*f*, and spacing portion 70*hb* between the planar portions 70*d* and 70*g*. A channel 70*j* is defined by the front planar portion 70*a*, the back planar portions 70*c* and 70*f*, and the rib 70*i*. A channel 70*k* is defined by the front planar portion 70*b*, the back planar portions 70*d* and 70*g*, and the rib 70*i*. The channel 70*k* is generally perpendicular to the channel 70*j*. A front tab 701 extends from the respective lower end portions of the front planar portions 70*a* and 70*b*. A back tab 70*m* extends from the respective lower end portions of the lower back planar portions 70*f* and 70*g*. The tabs 70*i* and 70*m* define generally coplanar bottom surfaces 70*n* and 70*o*, respectively. A rib 70*p* extends along the bottom surfaces 70*n* and 70*o*. The rib 70*p* is connected to the rib 70*i* at the lower end portion thereof.

An angle 70*q* is defined between the rib 70*p* and the generally perpendicular intersection of the lower planar back portions 70*f* and 70*g* (as well as the intersection of the upper planar back portions 70*c* and 70*d*). In an exemplary embodiment, the angle 70*q* is equal to the angle 48*f*. In an exemplary embodiment, the angle 70*q* ranges from about 10 degrees to about less than 90 degrees. In an exemplary embodiment, the angle 70*q* ranges from about 45 degrees to about 85 degrees. In an exemplary embodiment, the angle 70*q* ranges from about 50 degrees to about 80 degrees. In an exemplary embodiment, the angle 70*q* ranges from about 60 degrees to about 80 degrees. In an exemplary embodiment, the angle 70*q* ranges from about 65 degrees to about 75 degrees. In an exemplary embodiment, the angle 70*q* ranges from about 70 degrees to about 72 degrees. In an exemplary embodiment, the angle 70*q* is about 70 degrees. In an exemplary embodiment, the angle 70*q* is about 71 degrees. In an exemplary embodiment, the angle 70*q* is about 72 degrees.

In an exemplary embodiment, each of the corner assemblies 22, 24, and 26 is identical to the corner assembly 20 and thus the respective combinations of components of the corner assemblies 22, 24, and 26 will not be described in further detail. In the description below, any components of the corner assemblies 22, 24, and 26 will be given the same reference numerals as the corresponding components of the corner assembly 20.

In an exemplary embodiment, as illustrated in FIGS. 1, 2, 3A, 3B, 3C, 3D, 12A, and 12B, when the secondary containment unit 12 is an assembled condition, each of the wall assemblies 28, 30, 32, 34, 36, 38, 40, and 42 is in an assembled condition.

Figure 12A:
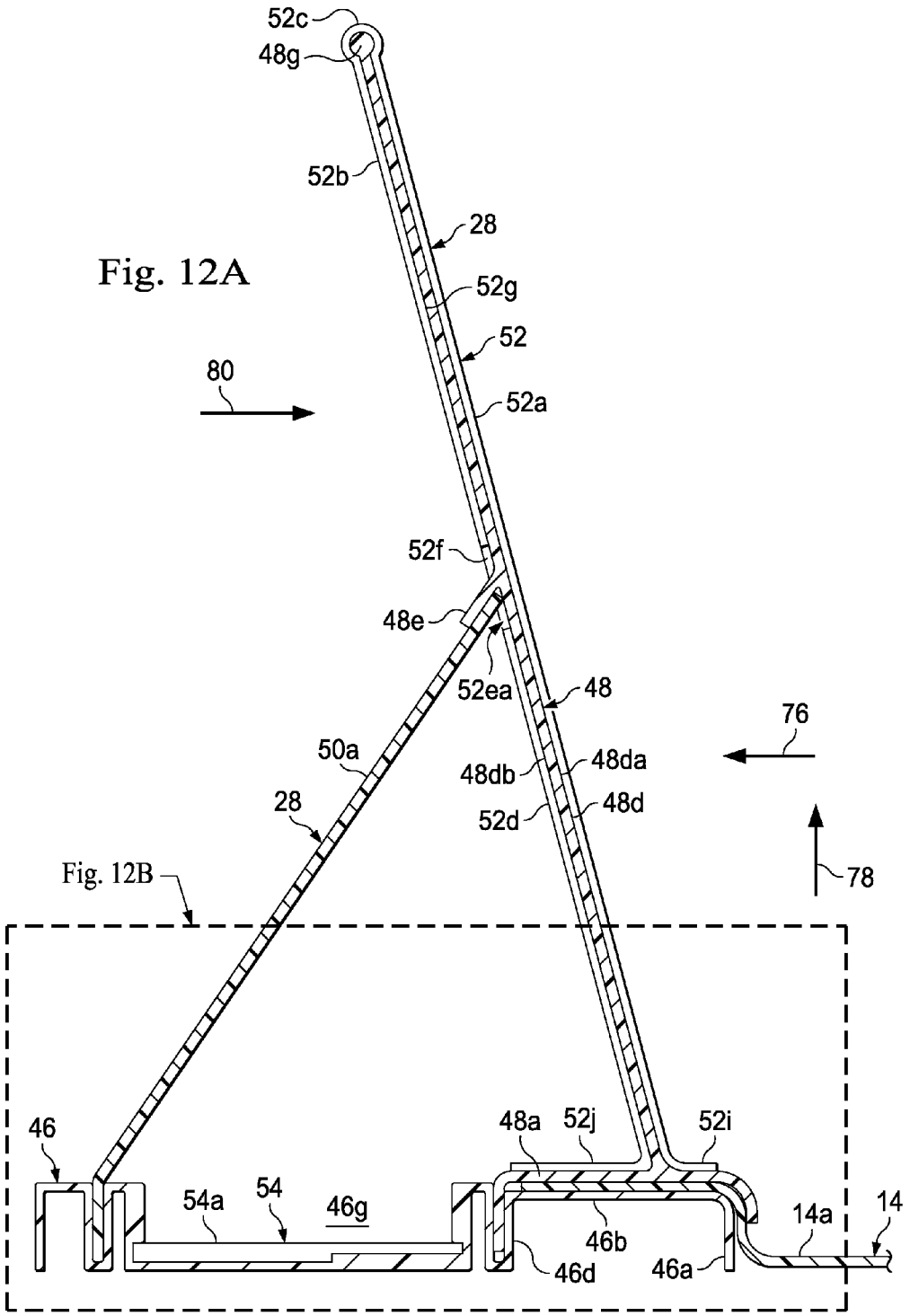
FIG. 12A is a sectional view of the secondary containment unit of FIGS. 1 and 2 taken along line 12A-12A of FIG. 2, according to an exemplary embodiment.
Figure 12B:
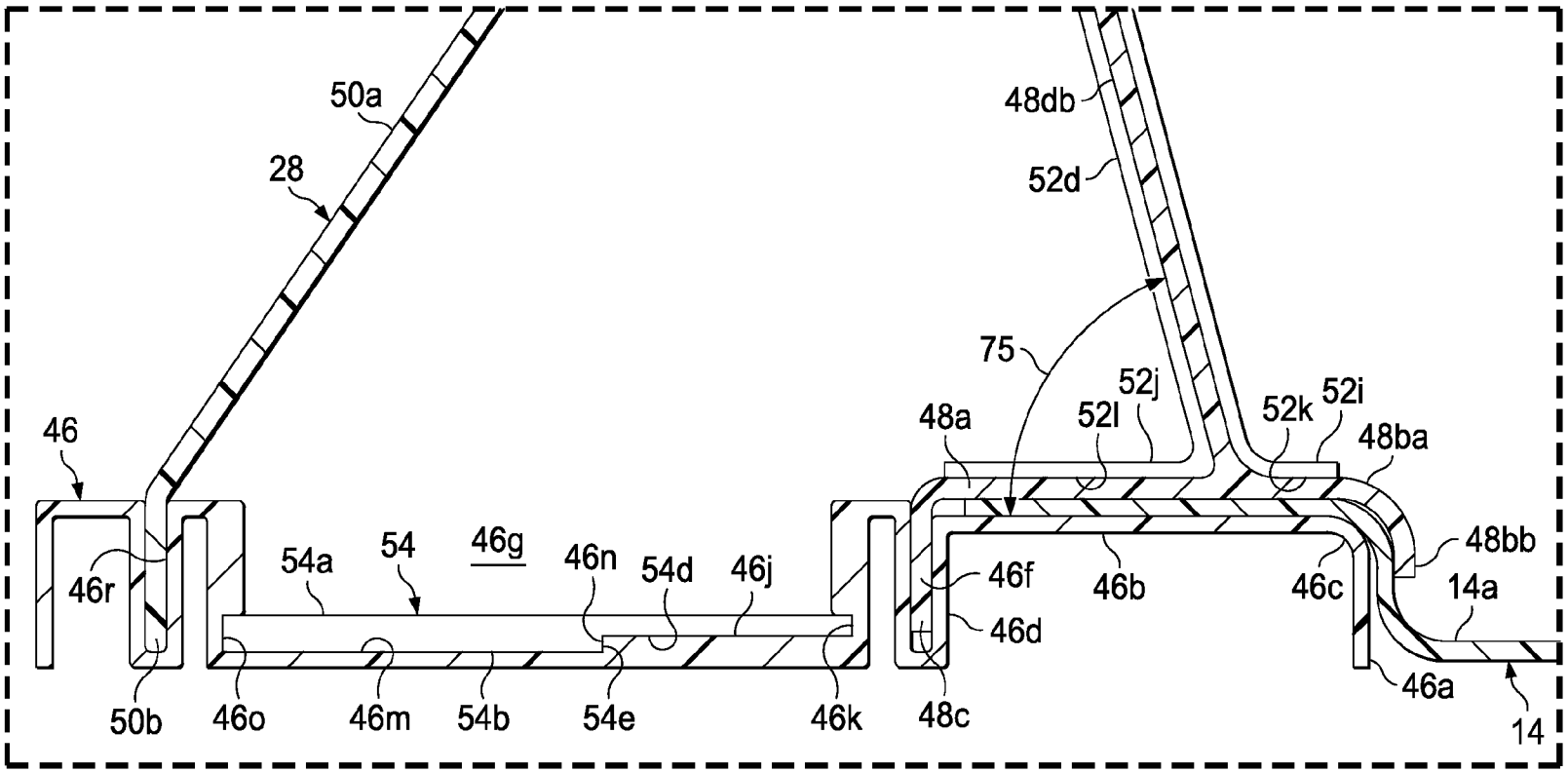
FIG. 12B is an enlarged view of a portion of FIG. 12A.
Figure 13A:
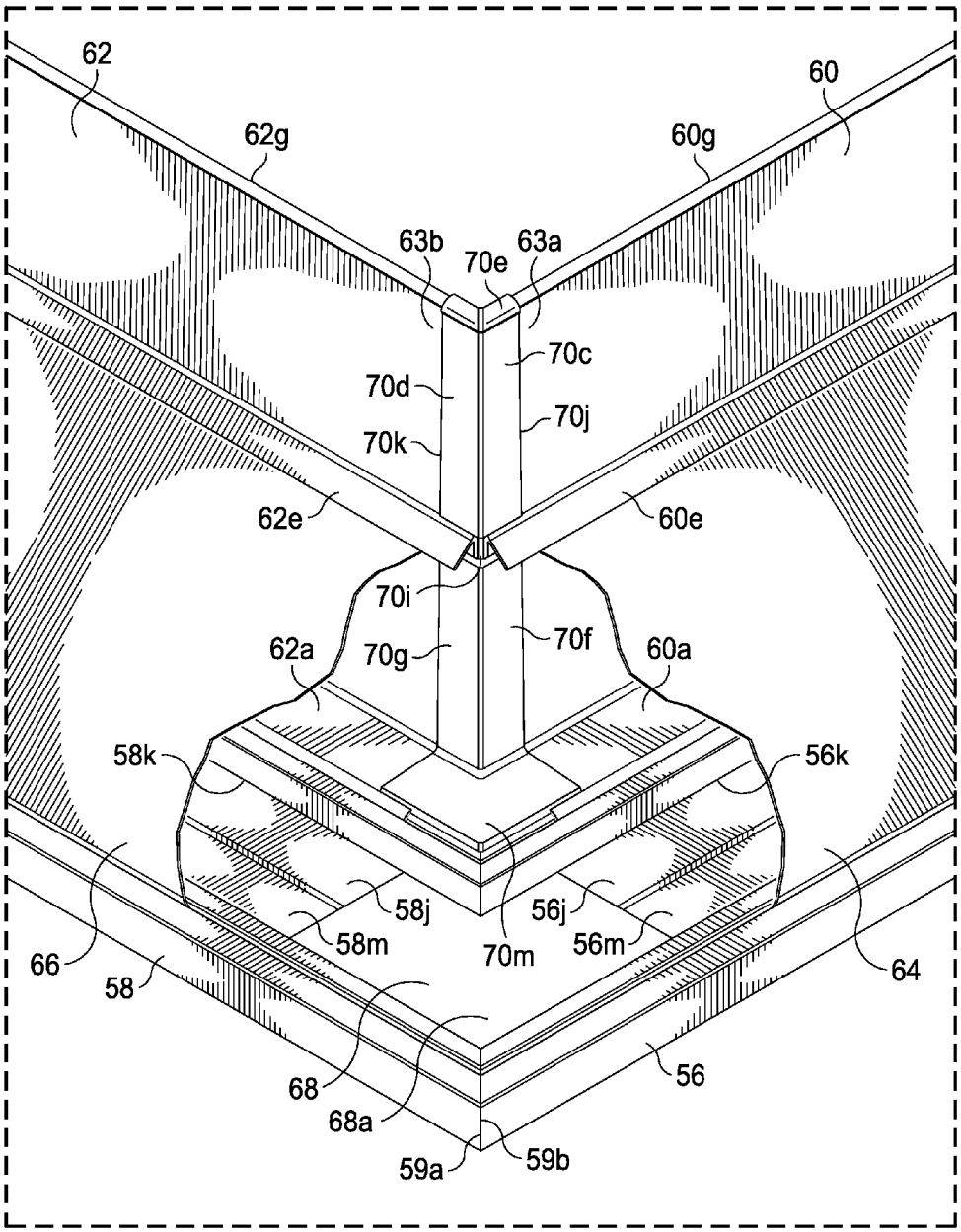
FIG. 13A is a perspective view of a corner assembly of the secondary containment unit of FIGS. 1 and 2, according to an exemplary embodiment.
Figure 13B:
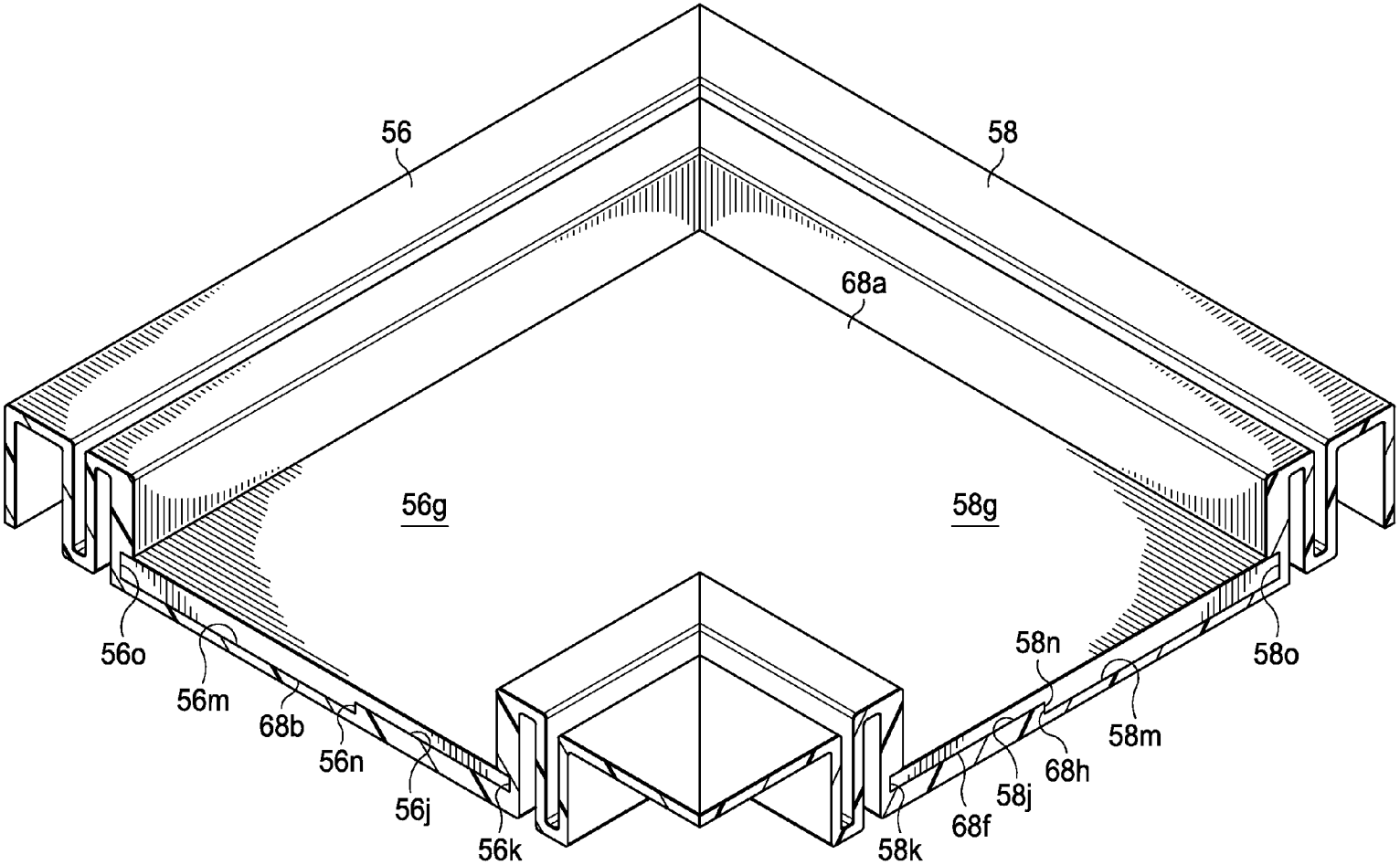
FIG. 13B is a perspective view of a portion of the corner assembly of FIG. 13A, according to an exemplary embodiment.

As shown most clearly in FIGS. 12A and 12B but also shown in FIGS. 1, 2, 3A, 3B, 3C, and 3D, when the wall assembly 28 is in an assembled condition, an edge portion 14*a* of the liner 14 is disposed on the horizontally-extending portion 46*b* of the straight track segment 46. In an exemplary embodiment, one or more fasteners, such as one or more screws, extend through the edge portion 14*a* and engage the horizontally-extending portion 46*b*, securing the edge portion 14*a* to the straight track segment 46. In an exemplary embodiment, instead of, or in addition to the aforementioned fasteners, an adhesive is disposed between at least the edge portion 14*a* and the horizontally-extending portion 46*b*, securing the edge portion 14*a* to the straight track segment 46. The straight wall segment 48 is mounted on the straight track segment 46 so that the edge portion 14*a* of the liner 14 is sandwiched or otherwise disposed between the horizontally-extending portion 46*b* of the straight track segment 46 and the horizontally-extending portion 48*a* of the straight wall segment 48. The edge portion 14*a* is also disposed between the rounded corner 46*c* and the rounded corner 48*ba* of the front lip 48*b*, and between the front wall 46*a* and the tab 48*bb* of the front lip 48*b*. The horizontally-extending portions 46*b* and 48*a* are spaced in a generally parallel relation. The front wall 46*a* and the tab 48*bb* of the front lip 48*b* are spaced in a generally parallel relation. In an exemplary embodiment, an adhesive is disposed between at least the edge portion 14*a* of the liner 14 and the horizontally-extending portion 48*a* of the straight wall segment 48, securing the straight wall segment 48 to the liner 14.

The back wall 48*c* of the straight wall segment 48 extends within the channel 46*f* of the straight track segment 46. The tab 50*b* of the straight brace 50 extends within the channel 46*r* of the straight track segment 46. The rectangular plate 50*a* of the straight brace 50 extends angularly upward from the straight track segment 46 so that the upper edge thereof is disposed in the vertex between the angular rib 48*e* and the outside surface 48*db* of the angularly-extending portion 48*d*, engaging the outside surface 48*db*. Thus, the brace 50 supports the angularly-extending portion 48*d*. An angle 75 is defined between the angularly-extending portion 48*d* and the horizontally-extending portion 46*b* of the straight track segment 46, the angle being substantially equal to the angle 48*f*. Since the angle 75 is substantially equal to the angle 48*f*, in several exemplary embodiments the angle 75 has ranges and values that are the same as the above-described ranges and values of the angle 48*f*.

As shown in FIGS. 12A and 12B with reference to FIGS. 1-8C, the end of the angularly-extending portion 48*d* proximate the corner assembly 20 extends into the channel 52*g* of the straight wall connector 52. The rib 48*g* extends into the tubular feature 52*c*. In an exemplary embodiment, an adhesive may be disposed in the channel 52*g* to secure the angularly-extending portion 48*d* to the straight wall connector 52. The bottom surfaces 52*k* and 52*l* of the tabs 52*i* and 52*j*, respectively, are positioned on the horizontally-extending portion 48*a* of the straight wall segment 48. In an exemplary embodiment, an adhesive may be disposed between the horizontally-extending portion 48*a* and the bottom surface(s) 52*k* and/or 521 to secure the straight wall connector 52 to the straight wall segment 48. The angular rib 48*e* extends into the spacing portion 52*ea* and contacts, or is at least adjacent, the rib 52*f*. The end of the horizontally-extending portion 48*a* proximate the corner assembly 20 also contacts, or is at least adjacent, the rib 52*m* of the straight wall connector 52. At least a portion of the rib 52*m* rests upon the edge portion 14*a* of the liner 14 at the horizontally-extending portion 46*b* of the straight track segment 46. In an exemplary embodiment, the height of the rib 52*m* is generally equal to the thickness of the horizontally-extending portion 48*a* of the straight wall segment 48. In an exemplary embodiment, the height of the rib 52*m* is slightly less than the thickness of the horizontally-extending portion 48*a* of the straight wall segment 48.

As shown in FIGS. 12A and 12B, a portion of the plate 54*a* of the straight track connector 54 is disposed in the channel 46*g* of the straight track segment 46 so that: the plate 54*a* extends within the groove 46*o*; the bottom surface 54*b* contacts the horizontally-extending surface 46*m*; the step 54*e* is adjacent the step 46*n*; the horizontally-extending surface 54*d* contacts the horizontally-extending surface 46*j*; and the edge plate 54*a* extends within the groove 46*k*. In this position, as viewed in FIGS. 12A and 12B, relative vertical movement between the straight track connector 54 and the straight track segment 46 is prevented because the of the extension of the plate 54*a* within the grooves 46*o* and 46*k*. In an exemplary embodiment, to so position the straight track connector 54, a portion of the straight track connector 54 is slid into the channel 46*g* at the end of the straight track segment 46 that either is, or is intended to be, proximate the corner assembly 20. In an exemplary embodiment, an adhesive is disposed between the bottom surface 54*b* and the horizontally-extending surface 46*m*, and/or between the horizontally-extending surface 54*d* and the horizontally-extending surface 46*j*, to secure the straight track connector 54 to the straight track segment 46. In an exemplary embodiment, instead of, or in addition to the aforementioned adhesive, one or more fasteners extend through the plate 54*a* and into the horizontally-extending surface(s) 46*m* and/or 46*j*, in order to secure the straight track connector 54 to the straight track segment 46.

In several exemplary embodiments, fasteners, such as anchors and/or screws, extend through the straight track segment 46 and into the ground to maintain the position of the wall assembly 28. In an exemplary embodiment, one or more fasteners, such as one or more ground anchors or screws, extend through the horizontally-extending surface 46*j* and/or 46*m* and into the ground.

In several exemplary embodiments, each of the respective assembled conditions of the wall assemblies 30, 32, 34, 36, 38, 40, and 42 is identical to the above-described assembled condition of the wall assembly 28. Therefore, the respective assembled conditions of the wall assemblies 30, 32, 34, 36, 38, 40, and 42 will not be described in further detail.

In several exemplary embodiments, at least the corner track segments 56 and 58, the corner wall segments 60 and 62, and the corner braces 64 and 66 of the corner assemblies 20, 22, 24, and 26, and at least the straight track segments 46, the straight wall segments 48, and the straight braces 50 of the wall assemblies 28, 30, 32, 34, 36, 38, 40, and 42, are composed of one or more reinforced resin composite materials. In several exemplary embodiments, each of these components includes from about 10% to about 90% by weight of a resin material. In other exemplary embodiments, each of these components include from about 20% to about 70% by weight of a resin material. In several exemplary embodiments, these components include from about 30% to about 50% by weight of a resin material. In several exemplary embodiments, the resin material is a thermoset resin, including without limitation vinyl esters, epoxies, polyurethanes, polyureas, acrylics or styrenics, melamines, phenol-formaldehydes, and polyimides. In several exemplary embodiments, the thermoset resin is selected based on several criteria, including the physical properties necessary to ensure that the final composite structure is self-supporting, fracture and puncture resistant, resistant to the chemicals to which it will be exposed, and resistant to the environmental conditions to which it will be exposed (including wind velocity, precipitation, UV exposure, pH, and temperature). In several exemplary embodiments, the resin is reinforced with fibrous material to improve the strength of these components, particularly along the long continuous direction of the fiber reinforcement. In several exemplary embodiments, the reinforced resin composite material contains up to about 60% by weight of the fibrous material. In some embodiments, the resin is reinforced with carbon or glass fibers that are added to the resin in the form of woven fiber mats layered on top of one another at different angles, such as zero degree, fifteen degree, twenty degree, thirty degree, forty degree, forty-five degree, fifty degree, sixty degree, seventy degree and seventy-five degree, and ninety degree angles. The angled orientation of the fibrous material gives the resin high tensile and flexural strength that is less sensitive to the direction of the application force and beyond what is commonly seen in the art with traditional fiberglass, which can be significantly lower in the orthogonal direction to the reinforcing fibers. In several exemplary embodiments, the fibrous material may include synthetic fibers, such as Kevlar®, and natural fibers from organic materials, such as those derived from coconut hulls. In several embodiments, the reinforced resin composite material further includes filler materials at a rate of up to 50% by weight, up to 25% by weight, up to 10% by weight and up to 1% by weight of the resin. Such filler materials include without limitation ground silica, talc, calcium carbonate, clay or combinations thereof. Such filler materials add reinforcement to the resin and improve the modulus and impact resistance of the tank segments.

In several exemplary embodiments, at least the corner track segments 56 and 58, the corner wall segments 60 and 62, and the corner braces 64 and 66 of the corner assemblies 20, 22, 24, and 26, and at least the straight track segments 46, the straight wall segments 48, and the straight braces 50 of the wall assemblies 28, 30, 32, 34, 36, 38, 40, and 42, also include additives. For example, in several exemplary embodiments, these components include additives to increase UV resistance. These additives include hindered phenols, aromatic amines, hindered amine light stabilizers (HALS), benzofuranones, divalent sulfur compounds, phosphorous III compounds (phosphates and phosphines), multidentate metal ligands such as EDTA and other various metal compounds, or combinations thereof. In several exemplary embodiments, these components include additives for decreasing flammability, such as halogenated organics, char formers, cross-linkers, mineral fillers, intumescent materials, phosphorous compounds, as well as certain metal and boron compounds. In several exemplary embodiments, these components include additives that affect certain properties, including density, pH, chemical resistance, abrasion resistance, hardness, rheology; and other conventional additives such as stabilizers, curatives, dispersants and emulsifiers. In several exemplary embodiments, a copper mesh substrate is embedded in the resin to facilitate in the prevention of electrostatic build-up. In several exemplary embodiments, these components include pigments and/or dyes to add color.

In several exemplary embodiments, at least the corner track segments 56 and 58, the corner wall segments 60 and 62, and the corner braces 64 and 66 of the corner assemblies 20, 22, 24, and 26, and at least the straight track segments 46, the straight wall segments 48, and the straight braces 50 of the wall assemblies 28, 30, 32, 34, 36, 38, 40, and 42, also include one or more topcoats or coatings. For example, in several exemplary embodiments, these coatings include water-based paint, oil-based paint, acrylic paint, latex paint, polyurethane, polyurea, acrylics, or polyester, or any combination or mixture thereof. In several exemplary embodiments, the coatings can include Polane® S Plus Polyurethane Enamel, which is commercially available from Sherwin-Williams Company.

In several exemplary embodiments, at least the corner track segments 56 and 58, the corner wall segments 60 and 62, and the corner braces 64 and 66 of the corner assemblies 20, 22, 24, and 26, and at least the straight track segments 46, the straight wall segments 48, and the straight braces 50 of the wall assemblies 28, 30, 32, 34, 36, 38, 40, and 42, each have a thickness of about 3/16, or about 0.2, inches.

In several exemplary embodiments, the connectors 68, 70, 72, and 74 of the corner assemblies 20, 22, 24, and 26, and the connectors 52 and 54 of the wall assemblies 28, 30, 32, 34, 36, 38, 40, and 42, are composed of one or more of the above-described reinforced resin composite materials, additives, and coatings.

In an exemplary embodiment, as illustrated in FIGS. 1, 2, 9A, 9B, 9C, 9D, and 13A, when the secondary containment unit 12 is an assembled condition, each of the corner assemblies 20, 22, 24, and 26 is in an assembled condition.

As illustrated in FIGS. 1, 2, 9A, 9B, 9C, 9D, and 13A, when the corner assembly 20 is in an assembled condition, an edge portion 14*b* of the liner 14 is engaged with each of the corner track segment 56 and the corner wall segment 60 in a manner identical to the above-described manner in which the edge portion 14*a* of the liner 14 is engaged with each of the straight track segment 46 and the straight wall segment 48 of the wall assembly 28. Likewise, an edge portion 14*c* of the liner 14, which is perpendicular to the edge portion 14*b*, is engaged with each of the corner track segment 58 and the corner wall segment 62 in a manner identical to the above-described manner in which the edge portion 14*a* of the liner 14 is engaged with each of the straight track segment 46 and the straight wall segment 48 of the wall assembly 28. The corner wall segment 60 engages the corner track segment 56 in a manner identical to the above-described manner in which the straight wall segment 48 engages the straight track segment 46. Likewise, the straight wall segment 62 engages the corner track segment 58 in a manner identical to the above-described manner in which the straight wall segment 48 engages the straight track segment 46. The corner brace 64 engages each of the corner track segment 56 and the corner wall segment 60 in a manner identical to the above-described manner in which the straight brace 50 engages each of the straight track segment 46 and the straight wall segment 48. Likewise, the corner brace 66 engages each of the corner track segment 58 and the corner wall segment 62 in a manner identical to the above-described manner in which the straight brace 50 engages each of the straight track segment 46 and the straight wall segment 48.

As illustrated in FIGS. 1, 2, 9A, 9B, 9C, 9D, 13A, and 13B, when the corner assembly 20 is in an assembled condition, the mitered end portions 59*a* and 59*b* of the corner track segments 56 and 58, respectively, are adjacent each other. Similarly, the mitered end portions 67*a* and 67*b* of the corner braces 64 and 66, respectively, are adjacent each other. As shown in FIGS. 9A, 9C, 13A, and 13B, the plate 68*a* of the corner track connector 68 is disposed in the channels 56*g* and 58*g* of the corner track segments 56 and 58, respectively, so that: the plate 68*a* extends in each of the grooves 56*o* and 58*o*; the bottom surface 68*b* contacts each of the horizontally-extending surfaces 56*m* and 58*m*; the step 68*h* is adjacent each of the steps 56*n* and 58*n*; the horizontally-extending surface 68*f* contacts each of the horizontally-extending surfaces 56*j* and 58*j*; and the plate 68*a* extends in each of the grooves 56*k* and 58*k*. In an exemplary embodiment, to so position the corner track connector 68, a portion of the corner track connector 68 is slid into the channel 56*g* at the mitered end portion 59*a* of the corner track segment 56, and then corner track segment 58 is slid toward the corner track connector 68 so that the corner track connector 68 extends into the channel 58*g* at the mitered end portion 59*b* of the corner track segment 58.

As illustrated in FIGS. 1, 2, 9A, 9B, 9C, 9D, and 13A, when the corner assembly 20 is an assembled condition, the respective mitered end portions 63*a* and 63*b* of the corner wall segments 60 and 62 extend into the channels 70*j* and 70*k*, respectively, of the corner wall connector 70. The respective ribs 60*g* and 62*g* of the corner wall segments 60 and 62 extend into the corner tubular feature 70*e*. In an exemplary embodiment, an adhesive may be disposed in the channels 70*j* and 70*k* to secure the respective mitered end portions 63*a* and 63*b* to the corner wall connector 70. The respective bottom surfaces 70*n* and 70*o* of the tabs 70*l* and 70*m* are positioned on the horizontally-extending portions 60*a* and 62*a*, respectively, of the corner wall segments 60 and 62. In an exemplary embodiment, an adhesive may be disposed between the bottom surfaces 70*n* and 70*o* and the horizontally-extending portions 60*a* and 62*a*, respectively, to secure the corner wall connector 70 to the corner wall segments 60 and 62. The respective angular ribs 60*e* and 62*e* of the corner wall segments 60 and 62 extend into the spacings 70*ha* and 70*hb*, respectively, of the corner wall connector 70. The respective angular ribs 60*e* and 62*e* are at least proximate the rib 70*i*. The respective mitered end portions 63*a* and 63*b* of the corner wall segments 60 and 62 are at least proximate the rib 70*i* of the corner wall connector 70. Respective portions of the rib 70*p* rest upon the edge portions 14*b* and 14*c* of the liner 14 at the horizontally-extending portions 56*b* and 58*b* of the corner track segments 56 and 58 at the mitered end portions 59*a* and 59*b* thereof. In an exemplary embodiment, the height of the rib 70*p* is generally equal to each of the respective thicknesses of the horizontally-extending portions 60*a* and 62*a* of the corner wall segments 60 and 62. In an exemplary embodiment, the height of the rib 70*p* is slightly less than each of the respective thicknesses of the horizontally-extending portions 60*a* and 62*a* of the corner wall segments 60 and 62. The straight wall connector 72 is engaged with the corner wall segment 62 in a manner identical to the above-described manner in which the straight wall connector 52 is engaged with the straight wall segment 48.

In several exemplary embodiments, fasteners, such as anchors and/or screws, extend through the corner track segments 56 and 58 and into the ground to maintain the position of the corner assembly 20. In an exemplary embodiment, one or more fasteners, such as one or more ground anchors or screws, extend through the horizontally-extending surface(s) 46*j* and/or 46*m* and into the ground.

In several exemplary embodiments, each of the respective assembled conditions of the corner assemblies 22, 24, and 26 is identical to the above-described assembled condition of the corner assembly 20. Therefore, the respective assembled conditions of the corner assemblies 22, 24, and 26 will not be described in further detail.

In an exemplary embodiment, as illustrated in FIGS. 1 and 2, when the secondary containment unit 12 is in an assembled condition, each of the wall assemblies 28, 30, 32, 34, 36, 38, 40, and 42, and each of the corner assemblies 20, 22, 24, and 26, is in an assembled condition, in accordance with the foregoing. Moreover, the wall assembly 28 is connected to the corner assembly 20 via the straight wall connector 52 and the straight track connector 54 of the wall assembly 28.

Figure 14:
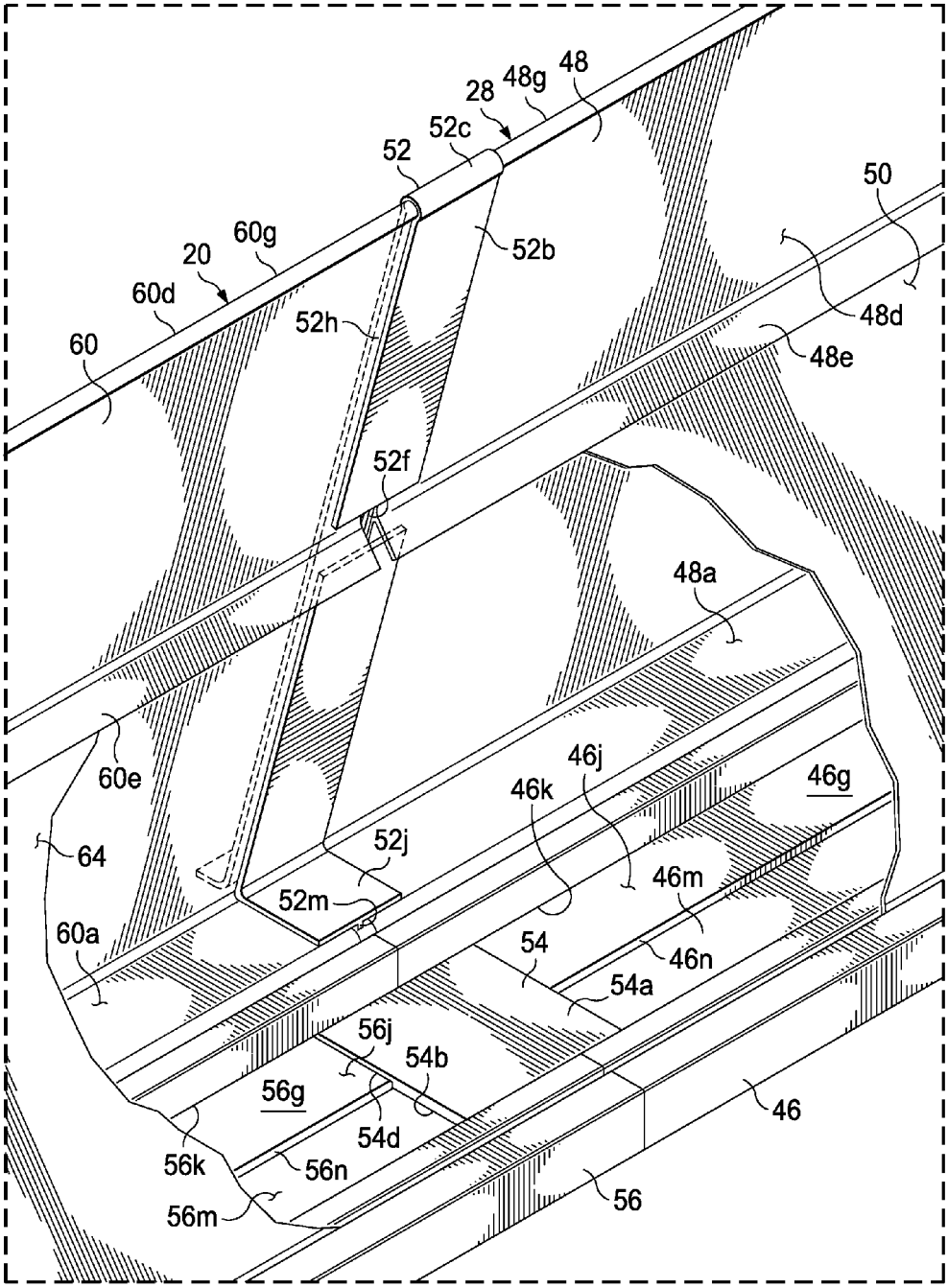
FIG. 14 is a perspective view of respective portions of wall assemblies of the secondary containment unit of FIGS. 1 and 2, according to an exemplary embodiment.

More particularly, as illustrated in FIG. 14 with continuing reference to FIGS. 1-13B, and as described above in connection with FIGS. 12A and 12B, the end of the angularly-extending portion 48*d* proximate the corner assembly 20 extends into the channel 52*g* of the straight wall connector 52. The rib 48*g* extends into the tubular feature 52*c*. In an exemplary embodiment, an adhesive may be disposed in the channel 52*g* to secure the angularly-extending portion 48*d* to the straight wall connector 52. The bottom surfaces 52*k* and 52*l* of the tabs 52*i* and 52*j*, respectively, are positioned on the horizontally-extending portion 48*a* of the straight wall segment 48. In an exemplary embodiment, an adhesive may be disposed between the horizontally-extending portion 48*a* and the bottom surface(s) 52*k* and/or 521 to secure the straight wall connector 52 to the straight wall segment 48. The angular rib 48*e* extends into the spacing portion 52*ea* and contacts, or is at least adjacent, the rib 52*f*. The end of the horizontally-extending portion 48*a* proximate the corner assembly 20 also contacts, or is at least adjacent, the rib 52*m* of the straight wall connector 52. At least a portion of the rib 52*m* rests upon the edge portion 14*a* and/or 14*b* of the liner 14 at the horizontally-extending portion 46*b* of the straight track segment 46. In an exemplary embodiment, the height of the rib 52*m* is generally equal to the thickness of the horizontally-extending portion 48*a* of the straight wall segment 48. In an exemplary embodiment, the height of the rib 52*m* is slightly less than the thickness of the horizontally-extending portion 48*a* of the straight wall segment 48.

Likewise, the end of the angularly-extending portion 60*d* of the corner wall segment 60 opposite the corner wall connector 70 extends into the channel 52*h* of the straight wall connector 52. The rib 60*g* extends into the tubular feature 52*c*. In an exemplary embodiment, an adhesive may be disposed in the channel 52*h* to secure the angularly-extending portion 60*d* to the straight wall connector 52. The bottom surfaces 52*k* and 52*l* of the tabs 52*i* and 52*j*, respectively, are positioned on the horizontally-extending portion 60*a* of the corner wall segment 60. In an exemplary embodiment, an adhesive may be disposed between the horizontally-extending portion 60*a* and the bottom surface(s) 52*k* and/or 521 to secure the straight wall connector 52 to the corner wall segment 60. The angular rib 60*e* extends into the spacing portion 52*eb* and contacts, or is at least adjacent, the rib 52*f*. The end of the horizontally-extending portion 60*a* opposite the corner wall connector 70 contacts, or is at least adjacent, the rib 52*m* of the straight wall connector 52. At least a portion of the rib 52*m* rests upon the edge portion 14*a* and/or 14*b* of the liner 14 at the horizontally-extending portion 56*b* of the corner track segment 56. In an exemplary embodiment, the height of the rib 52*m* is generally equal to the thickness of the horizontally-extending portion 60*a* of the corner wall segment 60. In an exemplary embodiment, the height of the rib 52*m* is slightly less than the thickness of the horizontally-extending portion 60*a* of the corner wall segment 60.

As a result of the foregoing, the rib 52*m* of the straight wall connector 52 rests upon, or is proximate, the edge portion 14*a* and/or 14*b* of the liner 14 at respective portions of the horizontally-extending portions 46*b* and 56*b* of the straight track segment 46 and the corner track segment 56, respectively. The rib 52*m* extends over the seam formed between the horizontally-extending portions 46*b* and 56*b*. The rib 52*m* is sandwiched between respective ends of the straight wall segment 48 and the corner wall segment 60. The tabs 52*i* and 52*j* of the straight wall connector 52 extend over the seam formed between the respective ends of the straight wall segment 48 and the corner wall segment 60.

As shown in FIGS. 12A, 12B, and 14, a portion of the plate 54*a* of the straight track connector 54 is disposed in the channel 46*g* of the straight track segment 46 so that: the plate 54*a* extends within the groove 46*o*; the bottom surface 54*b* contacts the horizontally-extending surface 46*m*; the step 54*e* is adjacent the step 46*n*; the horizontally-extending surface 54*d* contacts the horizontally-extending surface 46*j*; and the edge plate 54*a* extends within the groove 46*k*. In an exemplary embodiment, an adhesive is disposed between the bottom surface 54*b* and the horizontally-extending surface 46*m*, and/or between the horizontally-extending surface 54*d* and the horizontally-extending surface 46*j*, to secure the straight track connector 54 to the straight track segment 46. In an exemplary embodiment, instead of, or in addition to the aforementioned adhesive, one or more fasteners extend through the plate 54*a* and into the horizontally-extending surface(s) 46*m* and/or 46*j*, in order to secure the straight track connector 54 to the straight track segment 46.

Likewise, another portion of the plate 54*a* of the straight track connector 54 is disposed in the channel 56*g* of the corner track segment 56 so that: the plate 54*a* extends within the groove 56*o*; the bottom surface 54*b* contacts the horizontally-extending surface 56*m*; the step 54*e* is adjacent the step 56*n*; the horizontally-extending surface 54*d* contacts the horizontally-extending surface 56*j*; and the edge plate 54*a* extends within the groove 56*k*. In an exemplary embodiment, an adhesive is disposed between the bottom surface 54*b* and the horizontally-extending surface 56*m*, and/or between the horizontally-extending surface 54*d* and the horizontally-extending surface 56*j*, to secure the straight track connector 54 to the corner track segment 56. In an exemplary embodiment, instead of, or in addition to the aforementioned adhesive, one or more fasteners extend through the plate 54*a* and into the horizontally-extending surface(s) 56*m* and/or 56*j*, in order to secure the straight track connector 54 to the corner track segment 56. In an exemplary embodiment, to so position the straight track connector 54, a portion of the straight track connector 54 is slid into the channel 46*g*, and then relative movement is effected between the corner track segment 56 and the straight track segment 46 so that another portion of the straight track connector 54 extends into the channel 56*g* at end of the corner track segment 56 opposite the mitered end portion 59*a* of the corner track segment 56.

As a result of the foregoing, the straight track connector 54 extends across the seam formed between the segments 46 and 56.

With continuing reference to FIGS. 1-14, the wall assembly 42 is connected to the wall assembly 40, the wall assembly 40 is connected to the corner assembly 26, the wall assembly 38 is connected to the wall assembly 36, the wall assembly 36 is connected to the corner assembly 24, the wall assembly 34 is connected to the wall assembly 32, the wall assembly 32 is connected to the corner assembly 22, the wall assembly 30 is connected to the wall assembly 28, via corresponding ones of the straight wall connectors 52 and the straight track connectors 54, in respective manners each of which is identical to the above-described manner in which the wall assembly 28 is connected to the corner assembly 20 via the straight wall connector 52 and the straight track connector 54 of the wall assembly 28. Likewise, the corner assembly 20 is connected to the wall assembly 42, the corner assembly 26 is connected to the wall assembly 38, the corner assembly 24 is connected to the wall assembly 34, and the corner assembly 22 is connected to the wall assembly 30, via respective ones of the straight wall connectors 72 and the straight track connectors 74, in respective manners each of which is identical to the above-described manner in which the wall assembly 28 is connected to the corner assembly 20 via the straight wall connector 52 and the straight track connector 54 of the wall assembly 28.

In several exemplary embodiments, when the secondary containment unit 12 is the assembled condition described above, different assemblies and components of the secondary containment unit 12 are connected to each other with one or more types of adhesives, in accordance with the foregoing. Suitable adhesives may be in the form of liquids, pastes, solids, tapes, supported films, or combinations thereof. In several exemplary embodiments, the adhesive retains its strength and chemical resistance under exposure to anticipated environmental conditions and chemical events. In several exemplary embodiments, the chemical compositions of the adhesive can be determined by a variety of considerations, including but not limited to desired physical form, desired cure conditions, performance and cost. In several exemplary embodiments, the adhesive compositions include epoxy, epoxy-phenolic, polyimide, bismaleimide, cyanate ester, polyurethane, vinyl ester, or acrylic based adhesives. In several exemplary embodiments, a suitable adhesive is a thermosetting epoxy adhesive. An epoxy adhesive generally includes an epoxy resin and a hardener that is usually in liquid or fluid form before cure. As the epoxy adhesive cures, it becomes irreversibly molded to its final form. Thermosetting epoxy adhesives cure with the addition of heat to the composition. Typically, thermosetting epoxy adhesives cure at temperatures between about 200° F. and about 350° F., although some compositions can cure at temperatures as low as ambient temperatures. An example of a commercially available thermosetting epoxy adhesive suitable for use in the secondary containment unit 12 is Fastelset-x™, which is available from Fastel Adhesives, San Clemente, Calif.

In several exemplary embodiments, when the secondary containment unit 12 is in the assembled condition described above and installed at an oilfield production site (or another type of site), fasteners, such as anchors and/or screws, extend through the straight track segments 46, the corner track segments 56, and the corner track segments 58, to maintain the position of the secondary containment unit 12. In an exemplary embodiment, one or more fasteners, such as one or more ground anchors or screws, extend through one or more of the horizontally-extending surfaces 46*j*, 46*m*, 56*j*, 56*m*, 58*j*, and 58*m*, and into the ground.

In operation, in an exemplary embodiment, with continuing reference to FIGS. 1-14, if the above-ground fluid storage tank 18 leaks fluid or undergoes catastrophic failure, such as corrosion-induced catastrophic failure, the secondary containment unit 12 contains the fluid that leaks or flows from the storage tank 18, protecting the surrounding environment. The liner 14, the corner assemblies 20, 22, 24, and 26, and the wall assemblies 28, 30, 32, 34, 36, 38, 40, contain the leaking or flowing fluid, preventing the fluid from flowing into the surrounding environment. The liner 14 prevents the contained fluid from seeping into the ground.

During operation, in several exemplary embodiments, the wall assembly 28 withstands hydrostatic and/or other forces exerted or applied upon the straight wall segment 48 (including the inside surface 48*da*), among other components, which are applied in response to the containment of the fluid by the secondary containment unit 12. These forces are indicated, at least in part, by an arrow 76 in FIG. 12A. In several exemplary embodiments, the respective designs of the straight track segment 46, the straight wall segment 48, and the straight brace 50, including one or more of their respective shapes, material compositions, and thicknesses, provide a dynamic response to the forces indicated by the arrow 76. In particular, in an exemplary embodiment, a portion of the straight wall segment 48 moves upward, as indicated by an arrow 78 in FIG. 12A. In an exemplary embodiment, at least a portion of the tab 48*bb* of the straight wall segment 48 moves upwards in the direction indicated by the arrow 78 by about 0.5 inches. In several exemplary embodiments, at least portion of the straight wall segment 48 rotates in a counterclockwise direction, as viewed in FIG. 12A. In several exemplary embodiments, some relative movement or shifting between the straight wall segment 48 and the straight track segment 46 occurs. In several exemplary embodiments, some relative movement or shifting between the straight brace 50 and one, or both, of the straight wall segment 48 and the straight track segment 46 occurs. In several exemplary embodiments, the dynamic response of the wall assembly 28 facilitates in the reduction of mechanical stress levels within one or more components of the wall assembly 28. In an exemplary embodiment, the dynamic response of the wall assembly 28 facilitates the reduction of stress levels within at least the straight wall segment 48.

During operation, in several exemplary embodiments, each of the corner assemblies 20, 22, 24, and 26, and the wall assemblies 30, 32, 34, 36, 38, 40, withstands hydrostatic and/or other forces, which are applied in response to the containment of the fluid by the secondary containment unit 12, in a manner identical to the above-described manner in which the wall assembly 28 withstands hydrostatic or other forces.

During operation, in several exemplary embodiments, the wall assembly 28 withstands wind forces, which are applied against the straight wall segment 48 (including the outside surface 48*db*), among other components, as indicated by an arrow 80 in FIG. 12A. The force applied against the straight wall segment 48 in response to wind loading, as indicated by the arrow 80, is opposite in direction to that of the hydrostatic force indicated by the arrow 76. In response to the application of wind forces as indicated by the arrow 80, the straight wall segment 48 is urged to rotate clockwise, as viewed in FIG. 12A. However, this urging causes the tab 48*bb* to engage, or more firmly engage, the edge portion 14*a* of the liner 14 that is sandwiched between the tab 48*bb* and the front wall 46*a* of the straight track segment 46. This urging also causes the back wall 48*c* to engage, or more firmly engage, the U-shaped wall 46*d* and, in particular, the left portion of the U-shaped wall 46*d* as viewed in FIG. 12A. In an exemplary embodiment, the front wall 46*a* is adapted to prevent the tab 48*bb* and thus the straight wall segment 48 from appreciably rotating in response to wind forces as indicated by the arrow 80. In an exemplary embodiment, the U-shaped wall 46*d* is adapted to prevent the back wall 48*c* and thus the straight wall segment 48 from appreciably rotating in response to wind forces as indicated by the arrow 80. In an exemplary embodiment, the front wall 46*a* and the U-shaped wall 46*d* prevent the straight wall segment 48 from appreciably rotating in response to wind forces as indicated by the arrow 80. As a result, the respective relative positions of at least the straight wall segment 48 and the straight brace 50 are maintained, thereby maintaining, at least in part, the structural integrity of the wall assembly 28.

During operation, in several exemplary embodiments, each of the corner assemblies 20, 22, 24, and 26, and the wall assemblies 30, 32, 34, 36, 38, and 40, withstands wind forces in a manner identical to the above-described manner in which the wall assembly 28 withstands wind forces.

Figure 15:
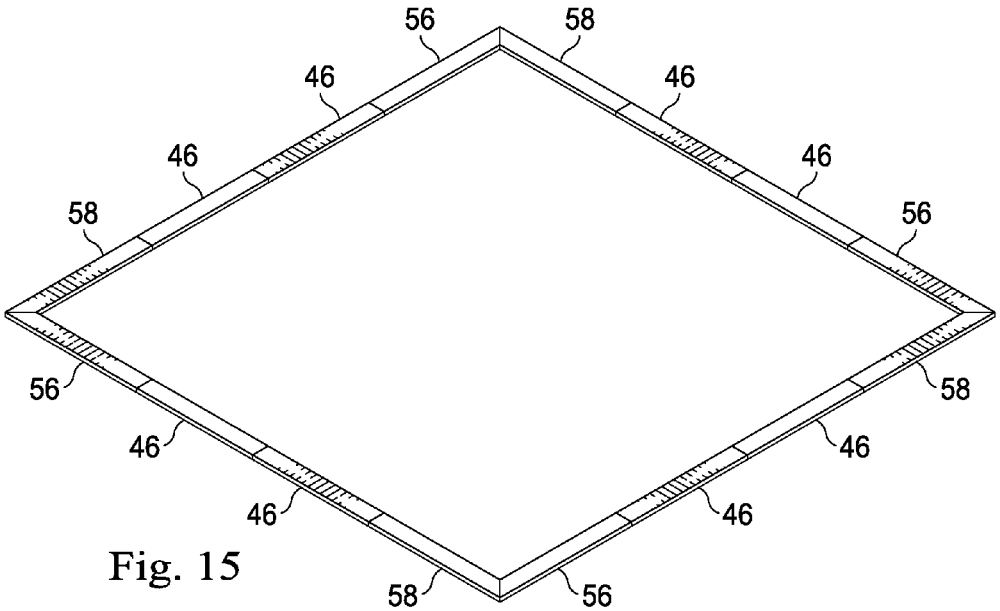
FIGS. 15-17 are perspective views illustrating a method of installing the secondary containment unit of FIGS. 1 and 2, according to an exemplary embodiment.
Figure 16:
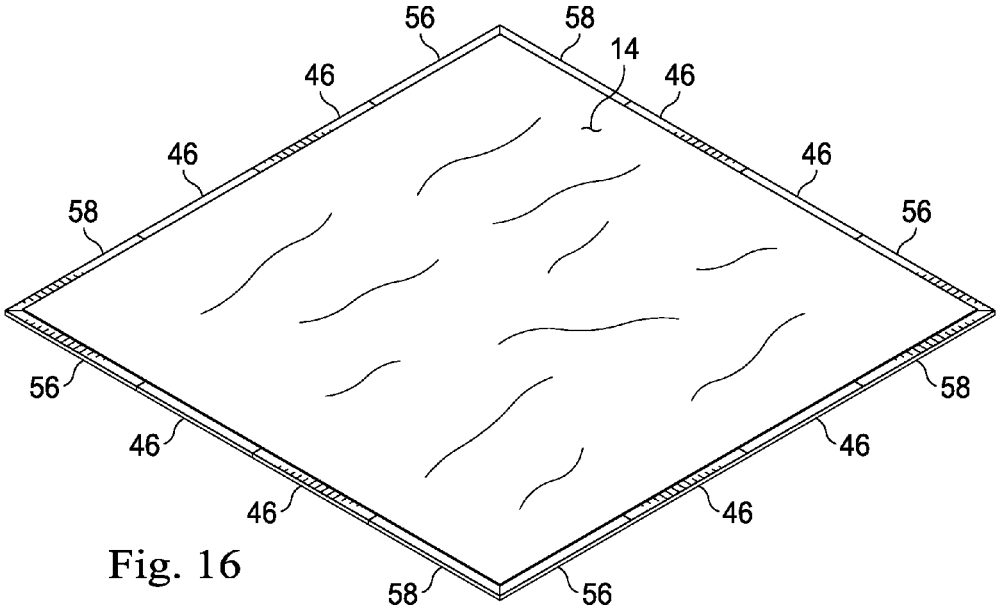
Figure 17:
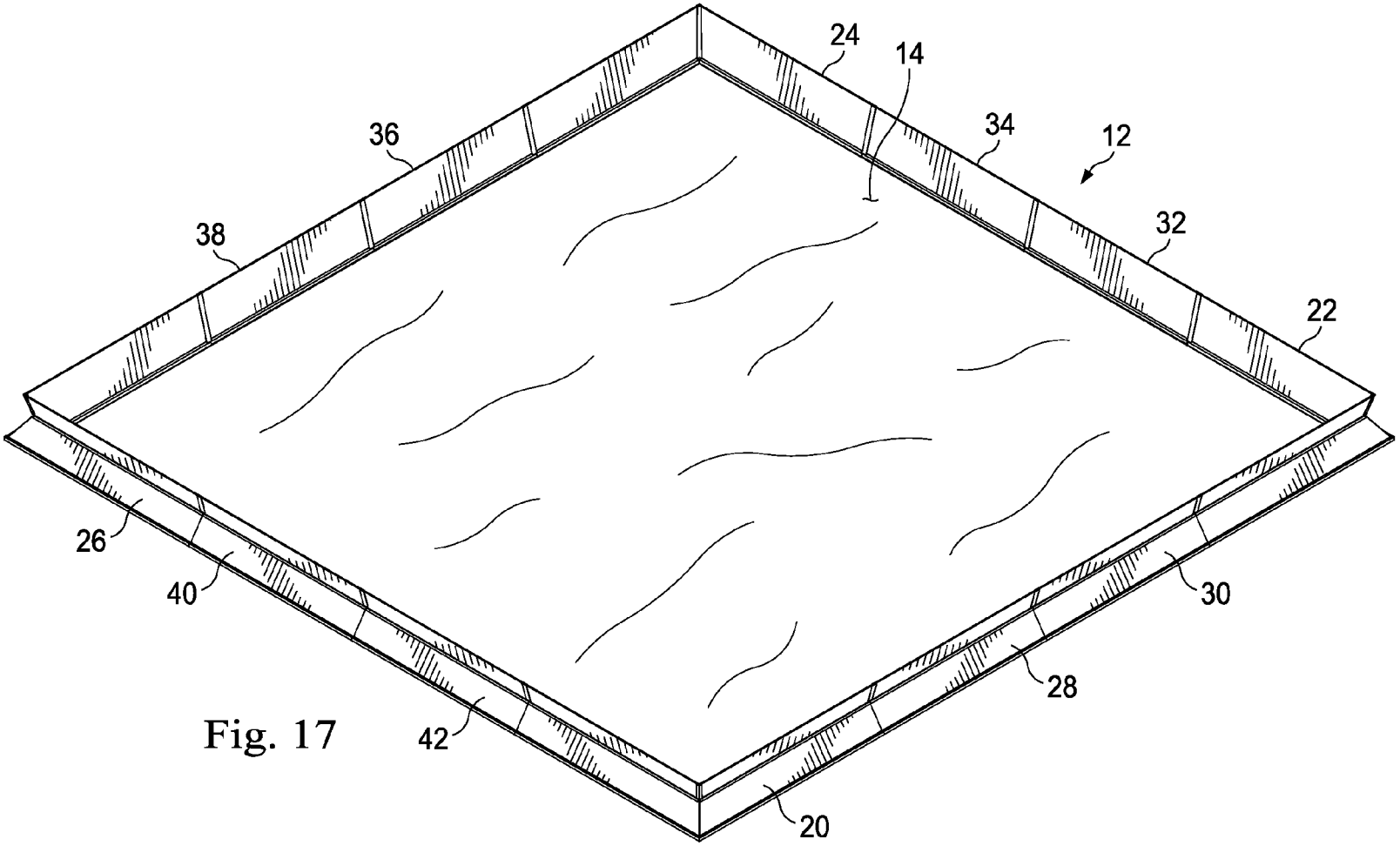

In an exemplary embodiment, as illustrated in FIGS. 15-17 with continuing reference to FIGS. 1-14, to install the secondary containment unit 12 at an oilfield production site or other site, the corner track segments 56 and 58 and the straight track segments 46 are connected, in accordance with the foregoing and as shown in FIG. 15. As shown in FIG. 16, during, and/or after, the connecting of the corner track segments 56 and 58 and the straight track segments 46, the liner 14 is connected to the corner track segments 56 and 58 and the straight track segments 46, in accordance with the foregoing. As shown in FIG. 17, during, and/or after, the connecting of the liner 14 to the corner track segments 56 and 58 and the straight track segments 46, the remainder of the secondary containment unit 12 is assembled in accordance with the foregoing. At any point during, and/or after, the construction of the secondary containment unit 12, fasteners, such as anchors and/or screws, are inserted through the straight track segments 46, the corner track segments 56, and the corner track segments 58, and into the ground, in order to maintain the position of the secondary containment unit 12. In an exemplary embodiment, one or more fasteners, such as one or more ground anchors or screws, are inserted through one or more of the horizontally-extending surfaces 46*j*, 46*m*, 56*j*, 56*m*, 58*j*, and 58*m*, and into the ground.

In several exemplary embodiments, modular secondary containment units of different sizes may be assembled using different combinations of one or more of the corner assemblies 20, 22, 24, and 26, one or more of the wall assemblies 28, 30, 32, 34, 36, 38, and 40, one or more other wall assemblies each of which is identical to the wall assembly 28, and/or any combination thereof. In several exemplary embodiments, square-shaped containment units, or rectangular-shaped containment units having different overall sizes including different lengths and/or widths, may be assembled using one or more of the corner assemblies 20, 22, 24, and 26, one or more of the wall assemblies 28, 30, 32, 34, 36, 38, and 40, one or more other wall assemblies each of which is identical to the wall assembly 28, and/or any combination thereof.

In several exemplary embodiments, circular-shaped, oval-shaped, or oblong-shaped modular containment units may be assembled using modified versions of one or more of the corner assemblies 20, 22, 24, and 26, one or more of the wall assemblies 28, 30, 32, 34, 36, 38, and 40, one or more other wall assemblies each of which is identical to the wall assembly 28, and/or any combination thereof; such modifications may include, for example, providing respective curved portions in the straight track segment 46, the straight wall segment 48, and the straight brace 50.

Figure 18:
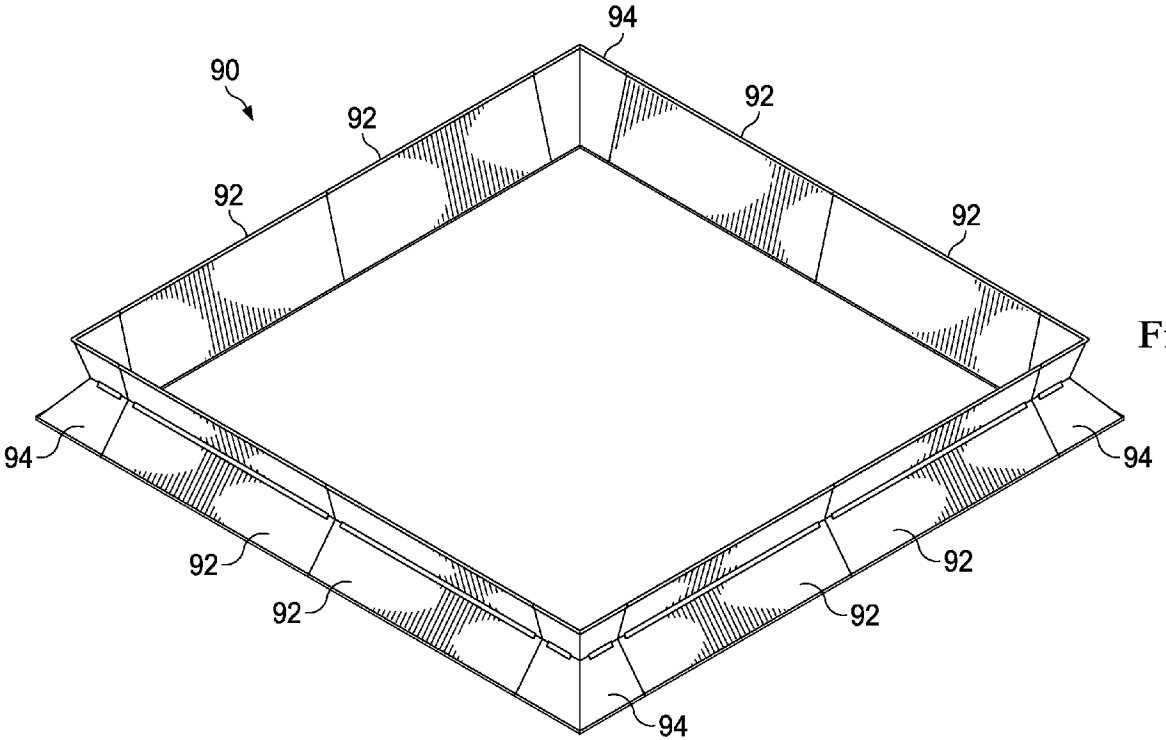
FIG. 18 is a perspective view of a secondary containment unit, according to another exemplary embodiment.
Figure 19:
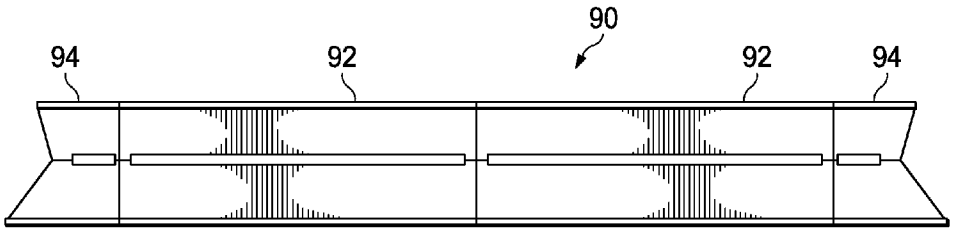
FIG. 19 is an elevational view of the secondary containment unit of FIG. 18, according to an exemplary embodiment.
Figure 20:
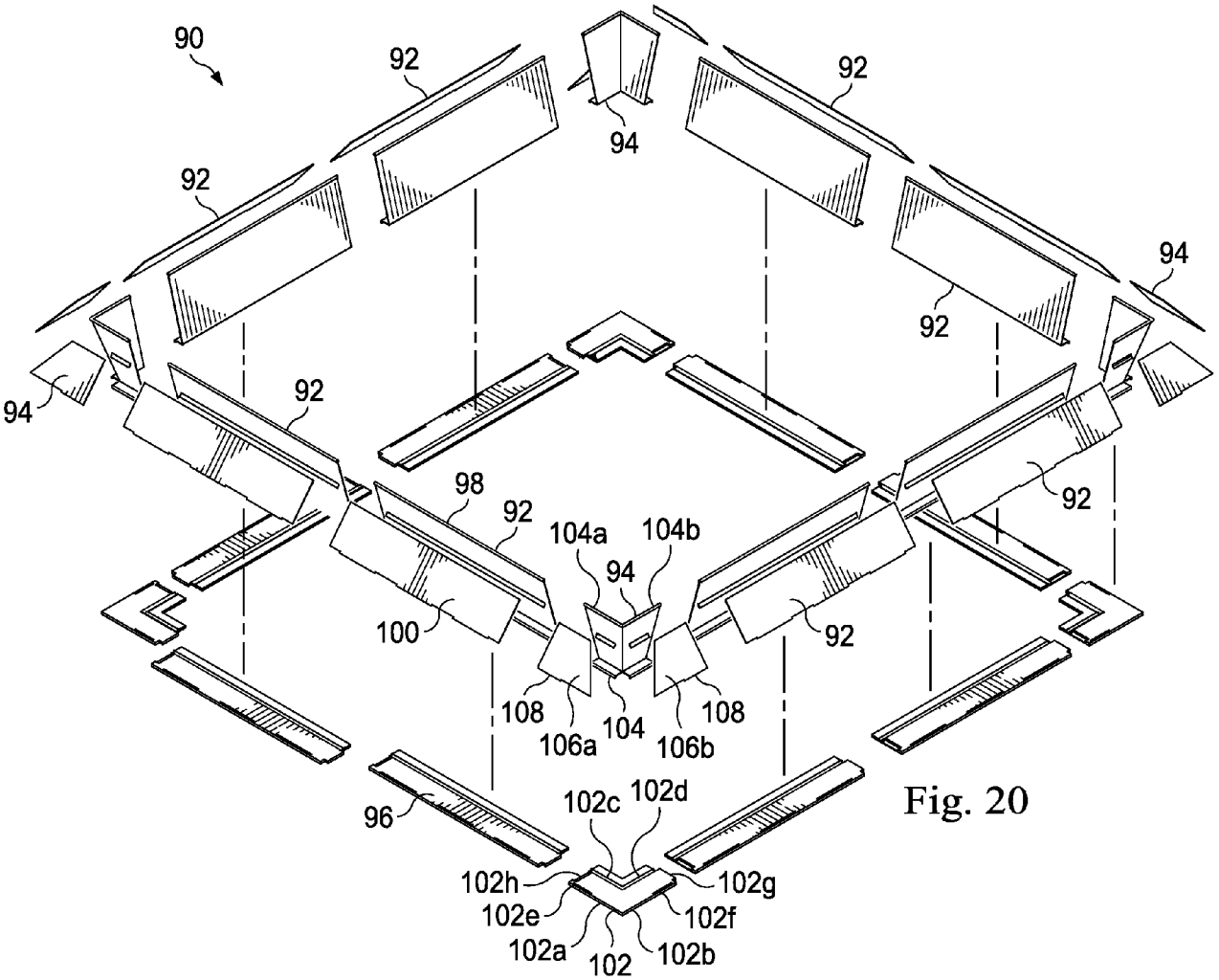
FIG. 20 is an exploded perspective view of the secondary containment unit of FIGS. 18 and 19, according to an exemplary embodiment.

Referring to FIGS. 18, 19, and 20 with continuing reference to FIGS. 1-17, a modular secondary containment unit is generally referred to by the reference numeral 90 and includes a plurality of wall assemblies 92 and a plurality of corner assemblies 94. As shown in FIGS. 18, 19, and 20, in an exemplary embodiment, the unit 90 includes eight (8) of the wall assemblies 92 and four (4) of the corner assemblies 94. Each of the wall assemblies 92 includes a straight track segment 96, a straight wall segment 98, and a straight brace 100. Each of the corner assemblies 94 includes a corner track segment 102, a corner wall segment 104, and corner braces 106*a* and 106*b*.

In several exemplary embodiments, the wall assemblies 92 and the corner assemblies 94 are made in whole or in part from a reinforced resin composite material as described above. In several exemplary embodiments, the wall assemblies 92 and the corner assemblies 94 are made in whole or in part from the material(s) described above. In several exemplary embodiments, the wall assemblies 92 and the corner assemblies 94 are made in whole or in part from the above-described material(s) from which the above-described assemblies of the secondary containment unit 12 are made.

Figure 21A:
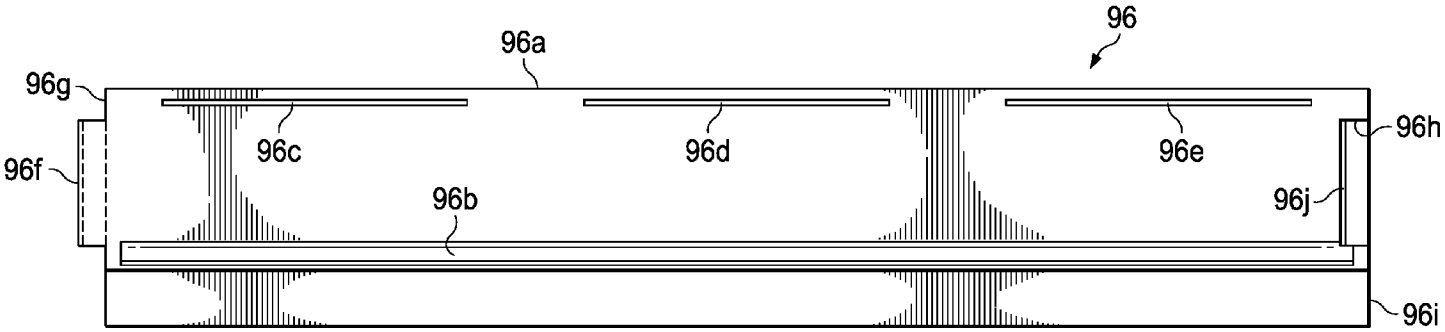
FIG. 21A is a top plan view of a straight track segment of a wall assembly of the secondary containment unit of FIGS. 18-20, according to an exemplary embodiment.
Figure 21B:
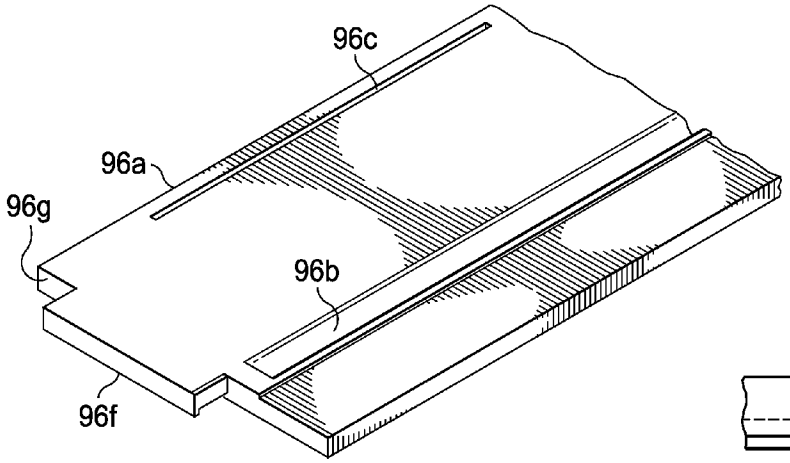
FIG. 21B is a perspective view of a portion of the straight track segment of FIG. 21A, according to an exemplary embodiment.
Figure 21C:
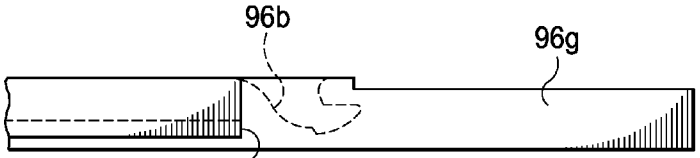
FIG. 21C is an elevational view of another portion of the straight track segment of FIGS. 21A and 21B, according to an exemplary embodiment.

Referring to FIGS. 21A, 21B and 21C with continuing reference to FIGS. 18-20, the straight track segment 96 includes a rectangular member 96*a* and a channel 96*b* formed therein. Blind slots 96*c*, 96*d* and 96*e* are formed in the rectangular member 96*a* and spaced from the channel 96*b* in a parallel relation. The blind slots 96*c*, 96*d* and 96*e* are linearly aligned and spaced apart from each other. An L-shaped tab 96*f* extends from an end portion 96*g* of the rectangular member 96*a*. A recess 96*h* is formed in an end portion 96*i*, which opposes the end portion 96*g*. A channel 96*j* is formed in a surface of the rectangular member 96*a* that is defined by the recess 96*h*. The combination of the recess 96*h* and the channel 96*j* forms a void having a shape that is complementary to the shape of the L-shaped tab 96*f*.

Figure 22A:
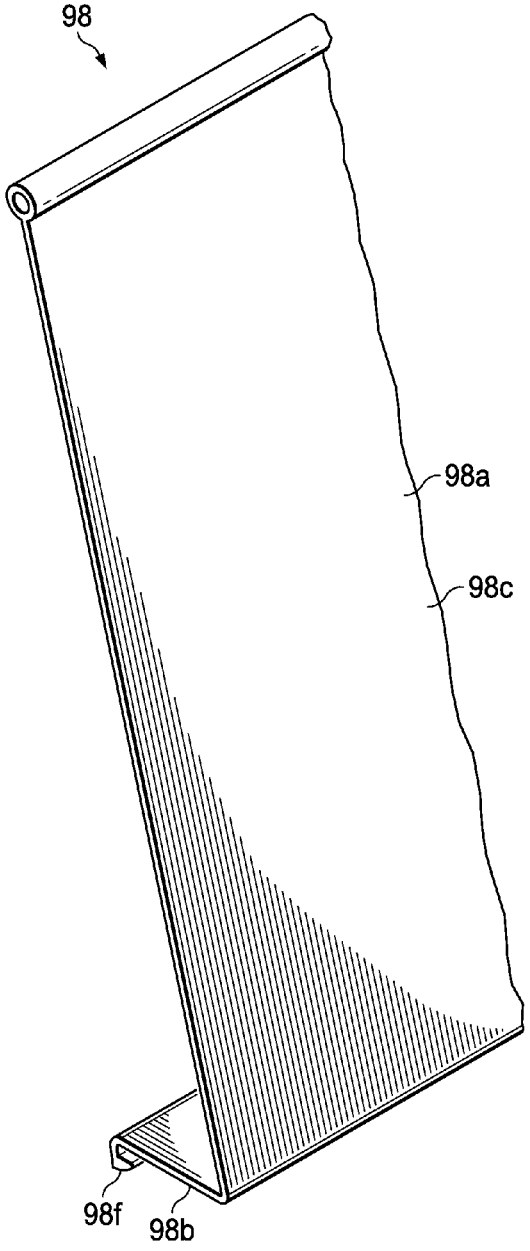
FIG. 22A is a perspective view of a portion of a straight wall segment of a wall assembly of the secondary containment unit of FIGS. 18-20, according to an exemplary embodiment.
Figure 22B:
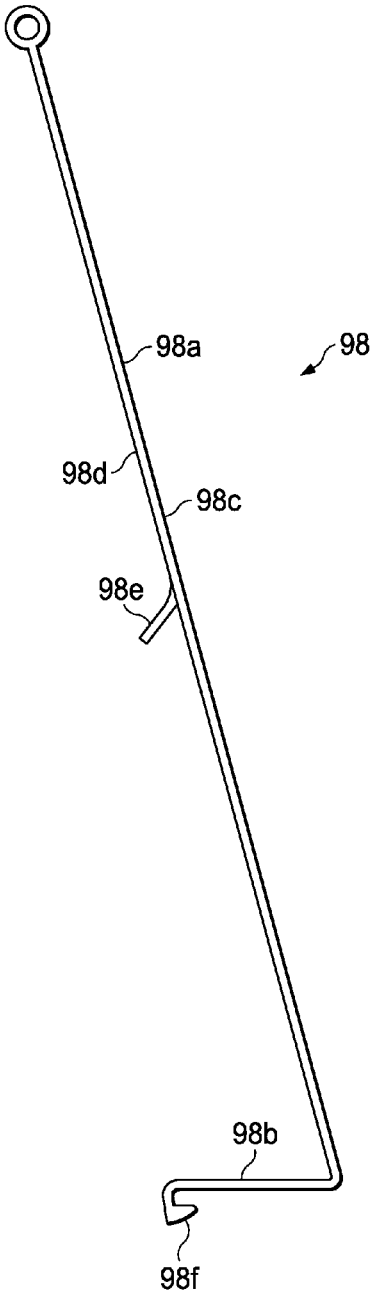
FIG. 22B is an end elevational view of the straight wall segment of FIG. 22A, according to an exemplary embodiment.

Referring to FIGS. 22A and 22B with continuing reference to FIGS. 18-21C, the straight wall segment 98 includes an angularly-extending portion 98*a* and a horizontally-extending portion 98*b* extending from the lower end thereof. The angularly-extending portion 98*a* defines an inside surface 98*c* and an outside surface 98*d*. An angular rib 98*e* extends along at least a portion of the outside surface 98*d*. A foot 98*f* extends from the horizontally-extending portion 98*b* at an end thereof opposite the angularly-extending portion 98*a*.

Figure 23:
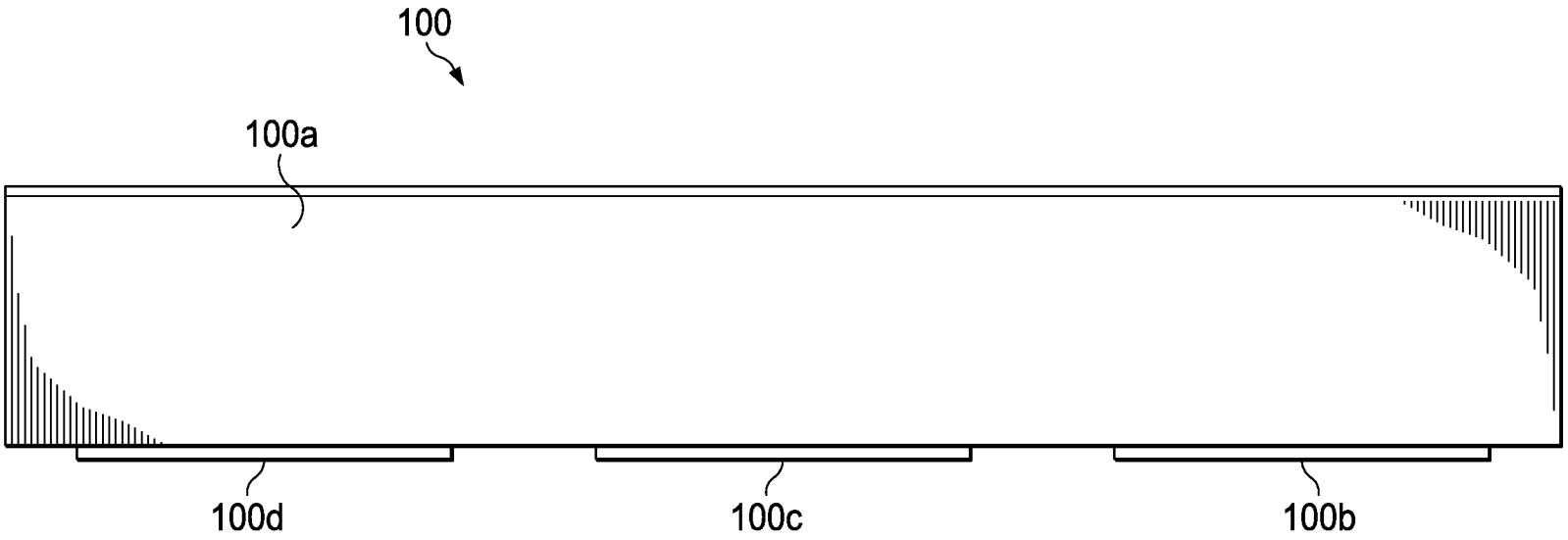
FIG. 23 is a top plan view of a straight brace of a wall assembly of the secondary containment unit of FIGS. 18-20, according to an exemplary embodiment.

Referring to FIG. 23 with continuing reference to FIGS. 18-22B, the straight brace 100 includes a rectangular plate 100*a* and tabs 100*b*, 100*c* and 100*d* extending downwardly from a lower edge thereof. The tabs 100*b*, 100*c* and 100*d* are linearly aligned and spaced apart from each other.

Figure 24A:
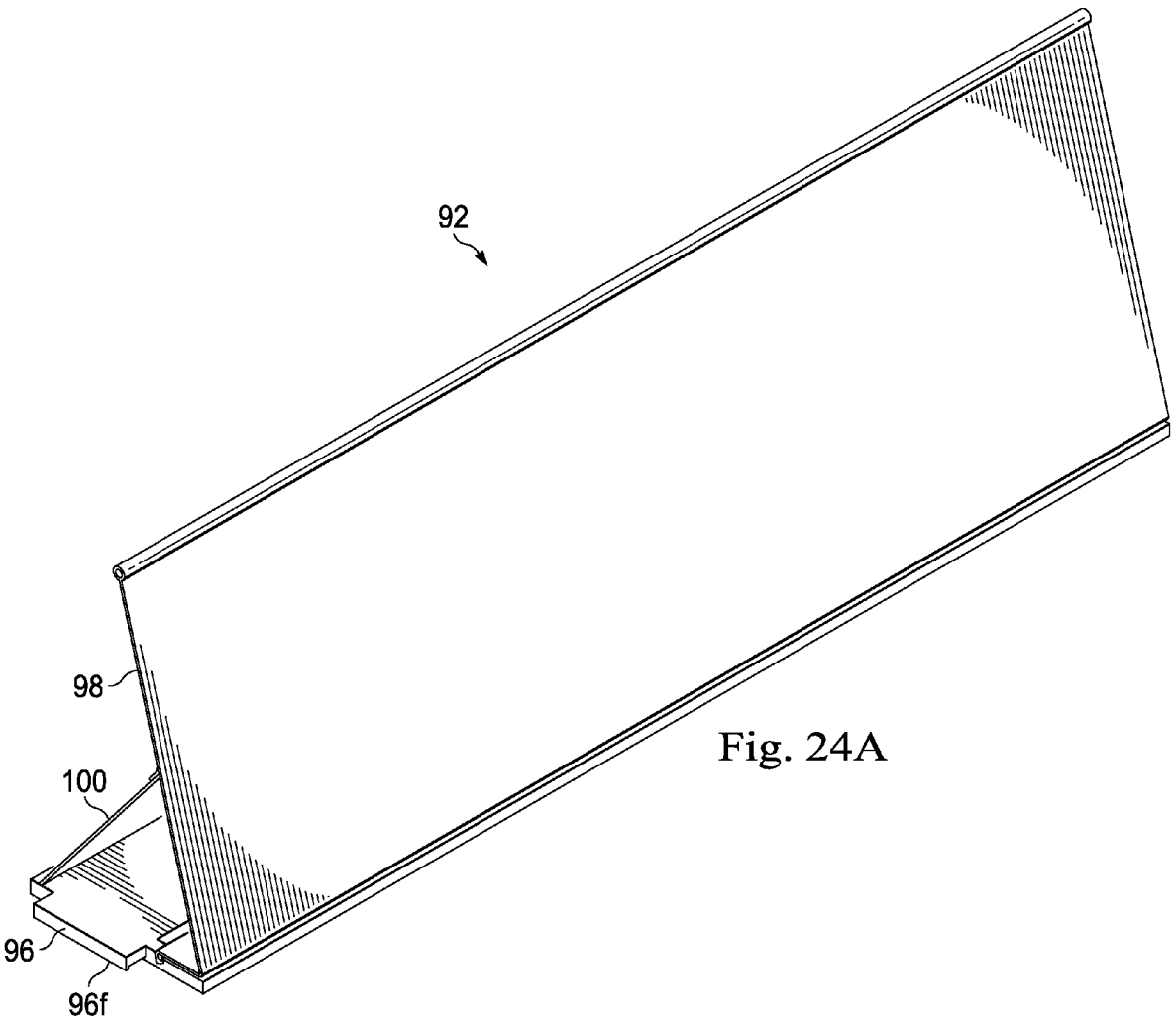
FIG. 24A is a perspective view of a wall assembly of the secondary containment unit of FIGS. 18-20, according to an exemplary embodiment.
Figure 24B:
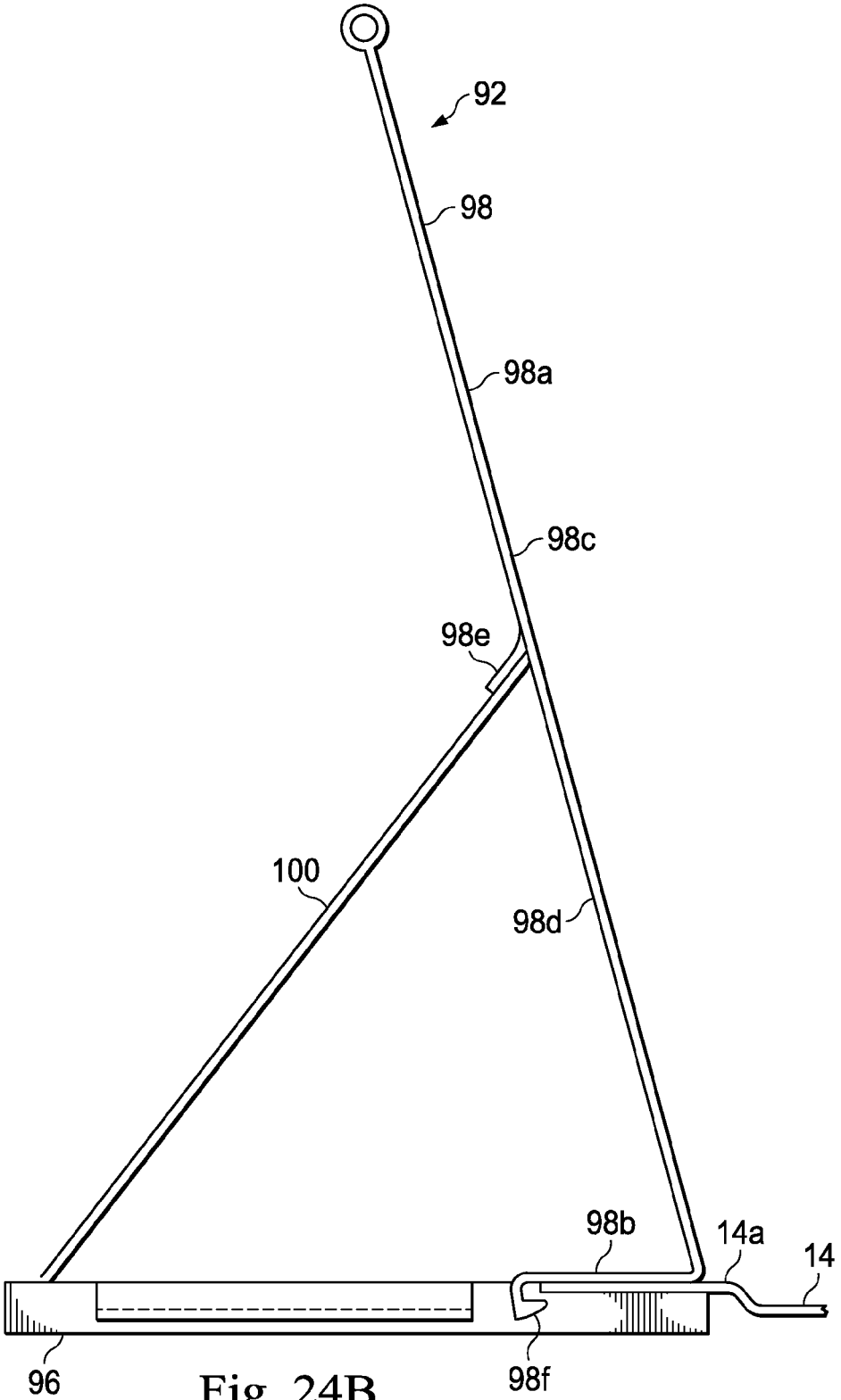
FIG. 24B is an elevational view of the wall assembly of FIG. 24A, according to an exemplary embodiment.
Figure 25:
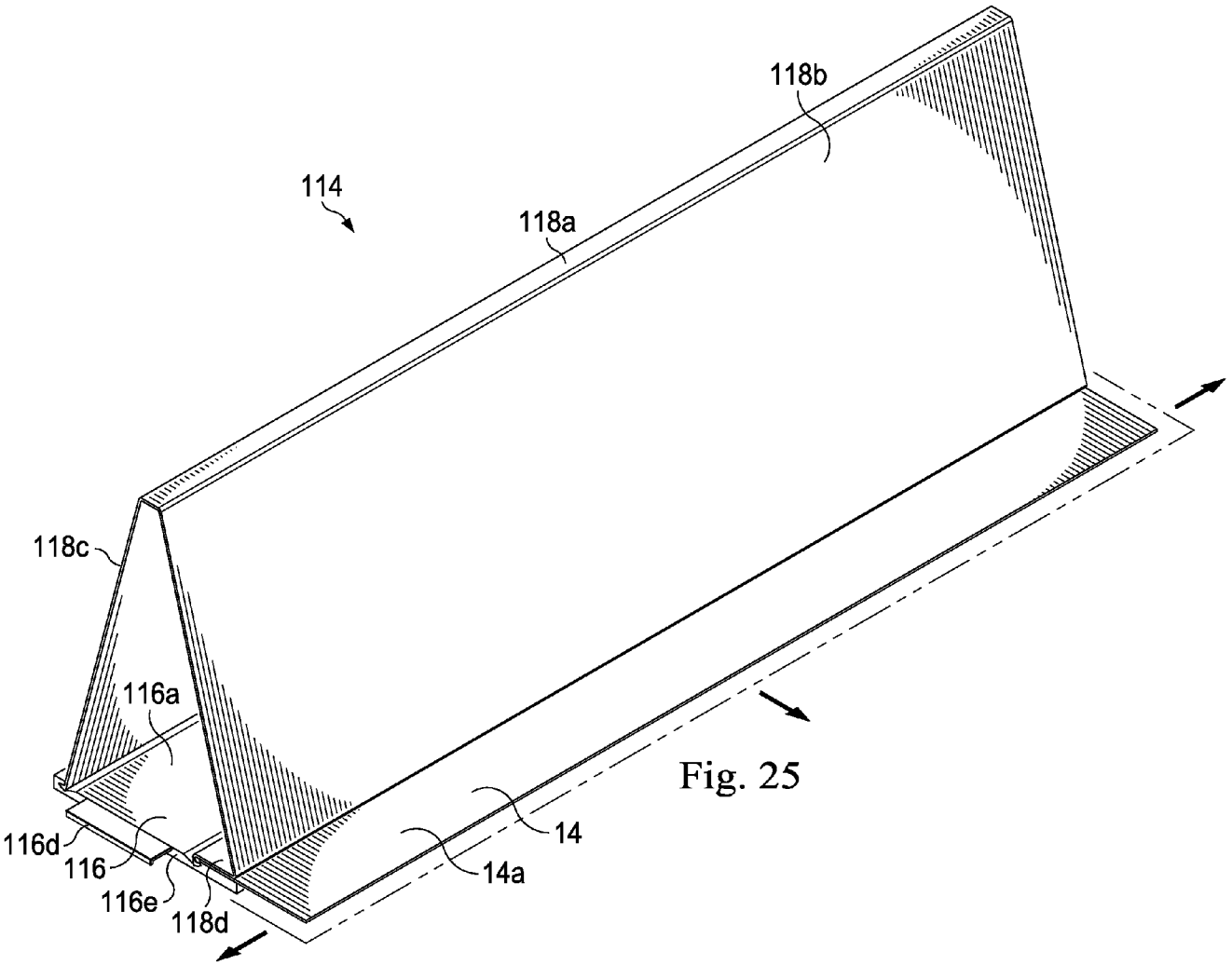
FIG. 25 is a perspective view of a straight wall assembly of a secondary containment unit, according to an exemplary embodiment.
Figure 26:
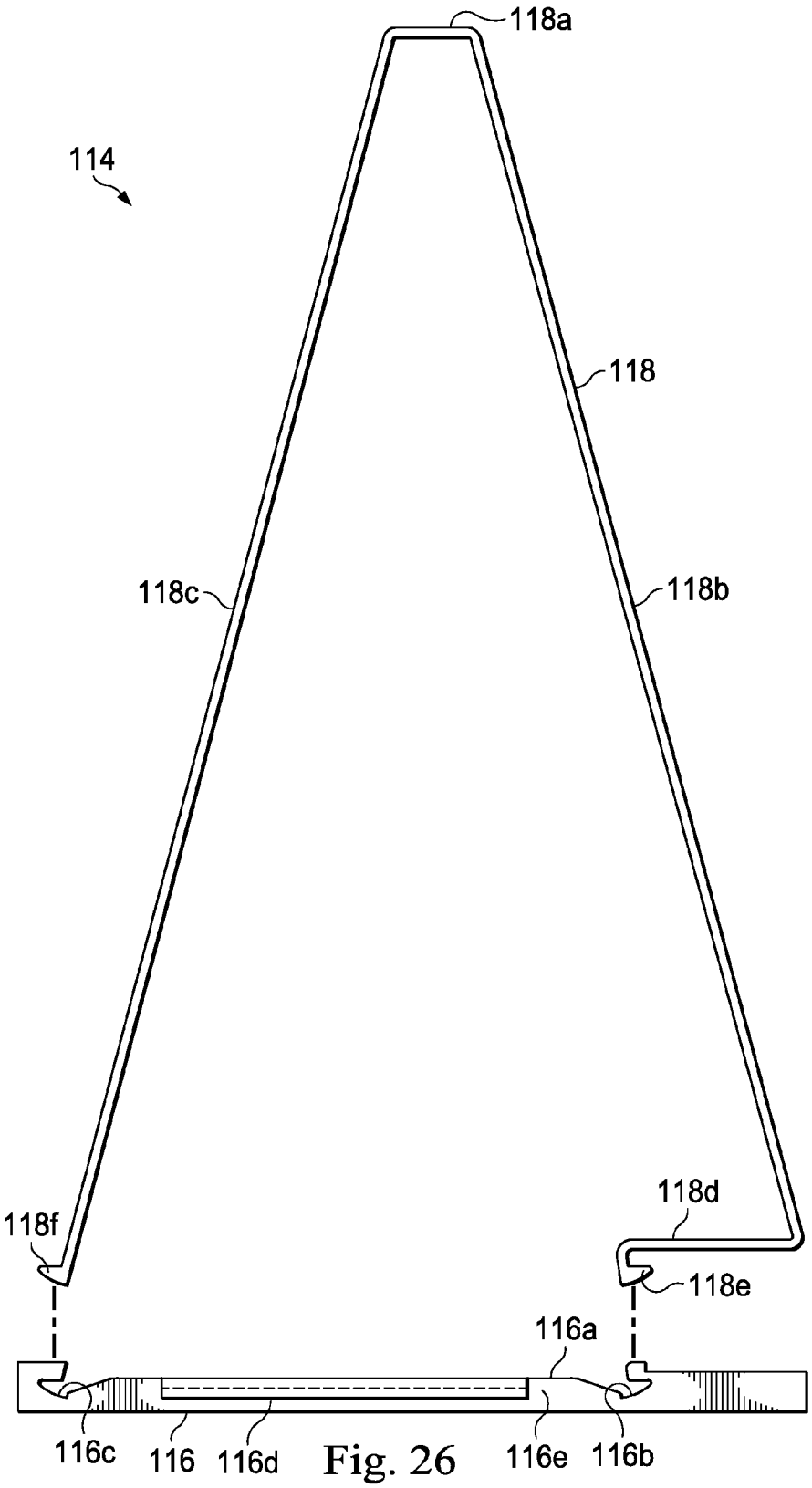
FIG. 26 is an exploded elevational view of the wall assembly of FIG. 25, according to an exemplary embodiment.

Referring to FIGS. 24A and 24B with continuing reference to FIGS. 18-23, when the wall assembly 92 is assembled, the foot 98*f* extends within the channel 96*b*, and the tabs 100*b*, 100*c* and 100*d* extend within the blind slots 96*c*, 96*d* and 96*e*, respectively. The upper edge of the straight brace 100 is disposed in the vertex between the angular rib 98*e* and the outside surface 98*d*. Thus, the straight brace 100 supports the angularly-extending portion 98*a*. The portion 14*a* of the liner 14 is disposed within a region vertically defined between the horizontally-extending portion 98*b* and the straight track segment 96. In several exemplary embodiments, the portion 14*a* of the liner 14 is pinched between the horizontally-extending portion 98*b* and the straight track segment 96, thereby connecting the liner 14 to the wall assembly 92. In several exemplary embodiments, the liner 14 is connected to the wall assembly 92 using a thermoset resin adhesive, and/or one or more other adhesives. In several exemplary embodiments, the liner 14 is connected to the wall assembly 92 using one or more of the above-described adhesives. In several exemplary embodiments, such adhesive(s) are disposed along the seams between the wall assembly 92 and the liner 14, thereby sealing the connection. Alternatively, in certain exemplary embodiments, the liner 14 extends over the wall assembly 92.

Referring back to FIGS. 18, 19, and 20, the corner track segment 102 includes perpendicular portions 102*a* and 102*b*. Perpendicular channels 102*c* and 102*d* are formed in the perpendicular portions 102*a* and 102*b*, respectively. Perpendicular blind slots 102*e* and 102*f* are formed in the perpendicular portions 102*a* and 102*b*, respectively. The blind slots 102*e* and 102*f* are spaced in a parallel relation from the channels 102*c* and 102*d*, respectively. An L-shaped tab 102*g* extends from the portion 102*b*. A recess/channel combination 102*h* defines a void, the shape of which is identical to the void defined by the combination of the recess 96*h* and the recess 96*j*. The corner wall segment 104 includes portions 104*a* and 104*b*, which are connected together to form the corner wall segment 104. Each of the portions 104*a* and 104*b* is substantially similar to the straight wall segment 98, except that the length of the portions 104*a* or 104*b* is less than that of the straight wall segment 98. Each of the portions 104*a* and 104*b* includes features that are substantially similar to corresponding features of the straight wall segment 98. Each of the corner braces 106*a* and 106*b* includes a tab 108.

When the corner section 94 is assembled, the respective feet of the wall segments 94*a* and 94*b* extend within the channels 102*c* and 102*d*, respectively. Additionally, the respective tabs 108 of the corner braces 106*a* and 106*b* extend within the blind slots 102*e* and 102*f*, respectively. The corner braces 106*a* and 106*b* support the portions 104*a* and 104*b*, respectively.

As shown in FIGS. 18 and 19, adjacent ones of the wall assemblies 92 are connected to each other, and the L-shaped tab 96*f* of one of the wall assemblies 92 extends within the recess 96*h* and the channel 96*j* of the other of the wall assemblies 92. At each of the corner assemblies 94, the L-shaped tab 96*f* of an adjacent one of the wall assemblies 92 extends within the recess/channel combination 102*h* of the corner section 94, and the L-shaped tab 102*g* of the corner section 94 extends within the recess 96*h* and the channel 96*j* of the adjacent other of the wall assemblies 92.

In several exemplary embodiments, one or more of the above-described adhesives may be used to connect and/or seal different components of the secondary containment unit 90.

In an exemplary embodiment, the liner 14 is connected to the remainder of the wall assemblies 92, as well as to the corner assemblies 94, in a manner substantially similar to the above-described manner in which the liner 14 is connected to the wall assembly 92 shown in FIG. 24B. As a result, the secondary containment unit 90 surrounds at least a portion of the liner 14. In several exemplary embodiments, a fluid storage tank such as the fluid storage tank 18 is positioned on the liner 14 and surrounded by the secondary containment unit 90.

Referring to FIGS. 25-30, a wall assembly 114 of a secondary containment unit is provided for use around storage tanks, such as the fluid storage tank 18. The wall assembly 114 includes a straight track segment 116 and a straight wall segment 118 connected thereto. In several exemplary embodiments, the straight track segment 116 and the straight wall segment 118 are made in whole or in part from a reinforced resin composite material as described above. In several exemplary embodiments, the straight track segment 116 and the straight wall segment 118 are made in whole or in part from the material(s) described above. In several exemplary embodiments, the straight track segment 116 and the straight wall segment 118 are made from one or more of the above-described material(s) from which the secondary containment unit 12 is made.

Figure 29:
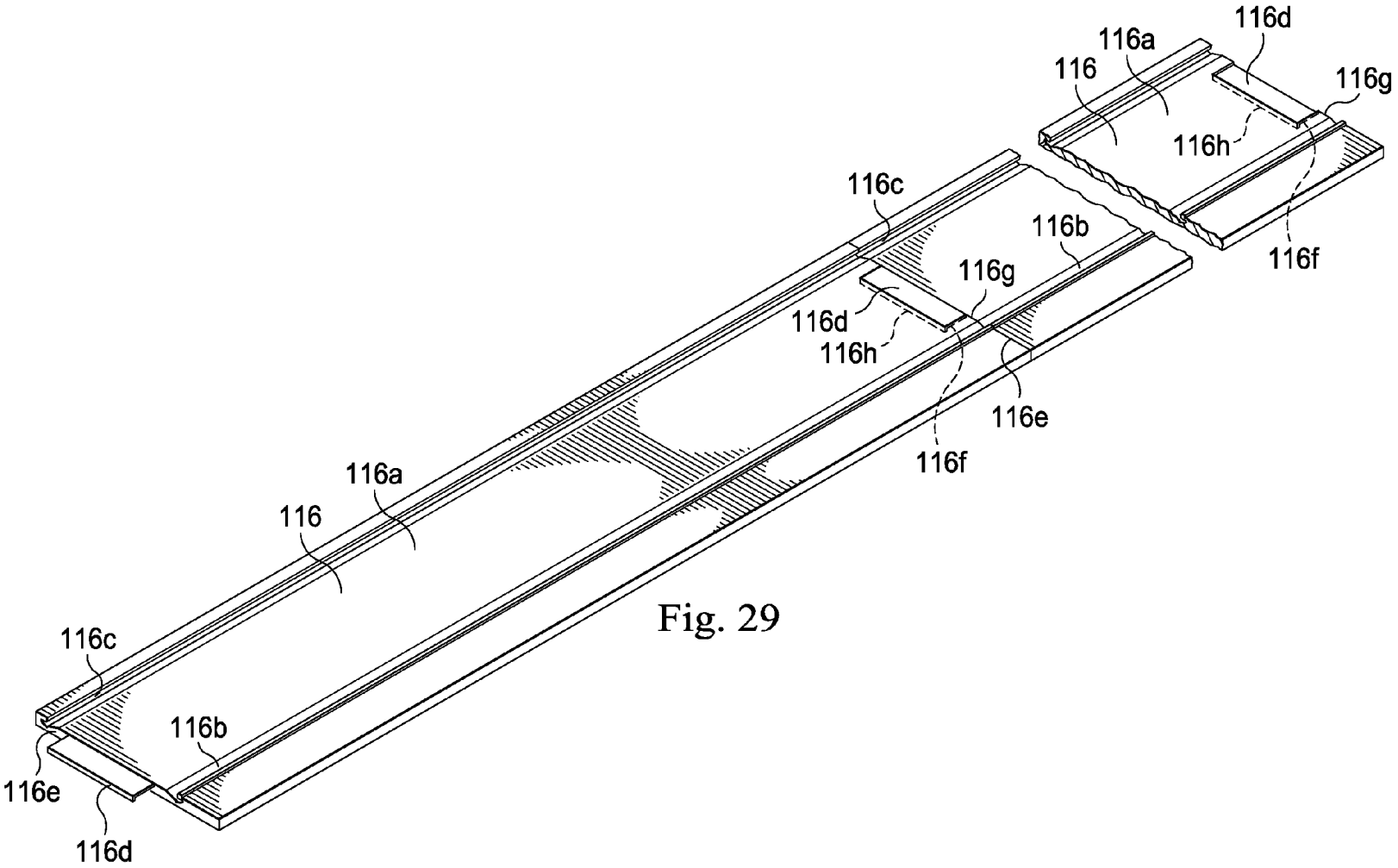
FIG. 29 is a perspective view of a connection between respective straight track segments of two adjacent wall assemblies of a secondary containment unit, according to an exemplary embodiment.

The straight track segment 116 includes a rectangular member 116*a* and parallel-spaced channels 116*b* and 116*c* formed therein. An L-shaped tab 116*d* extends from an end portion 116*e* of the rectangular member 116*a*. As shown in FIG. 29, the straight track segment 116 further includes a recess 116*f* formed in an end portion 116*g*, which opposes the end portion 116*e*. A channel 116*h* is formed in a surface of the rectangular member 116*a* that is defined by the recess 116*f*. The combination of the recess 116*f* and the channel 116*g* forms a void having a shape that is complementary to the shape of the L-shaped tab 116*d*.

As shown in FIGS. 25-28B, the straight wall segment 118 includes a top portion 118*a* and side portions 118*b* and 118*c* extending angularly downward therefrom. The top portion 118*a* and the side portions 118*b* and 118*c* together define a generally upside-down-V-shaped cross-section. A horizontally-extending portion 118*d* extends from the end of the side portion 118*b* opposite the top portion 118*a*. A foot 118*e* extends from the end of the horizontally-extending portion 118*d* opposite the side portion 118*b*. A foot 118*f* extends from the end of the side portion 118*c* opposite the top portion 118*a*.

Figure 27:
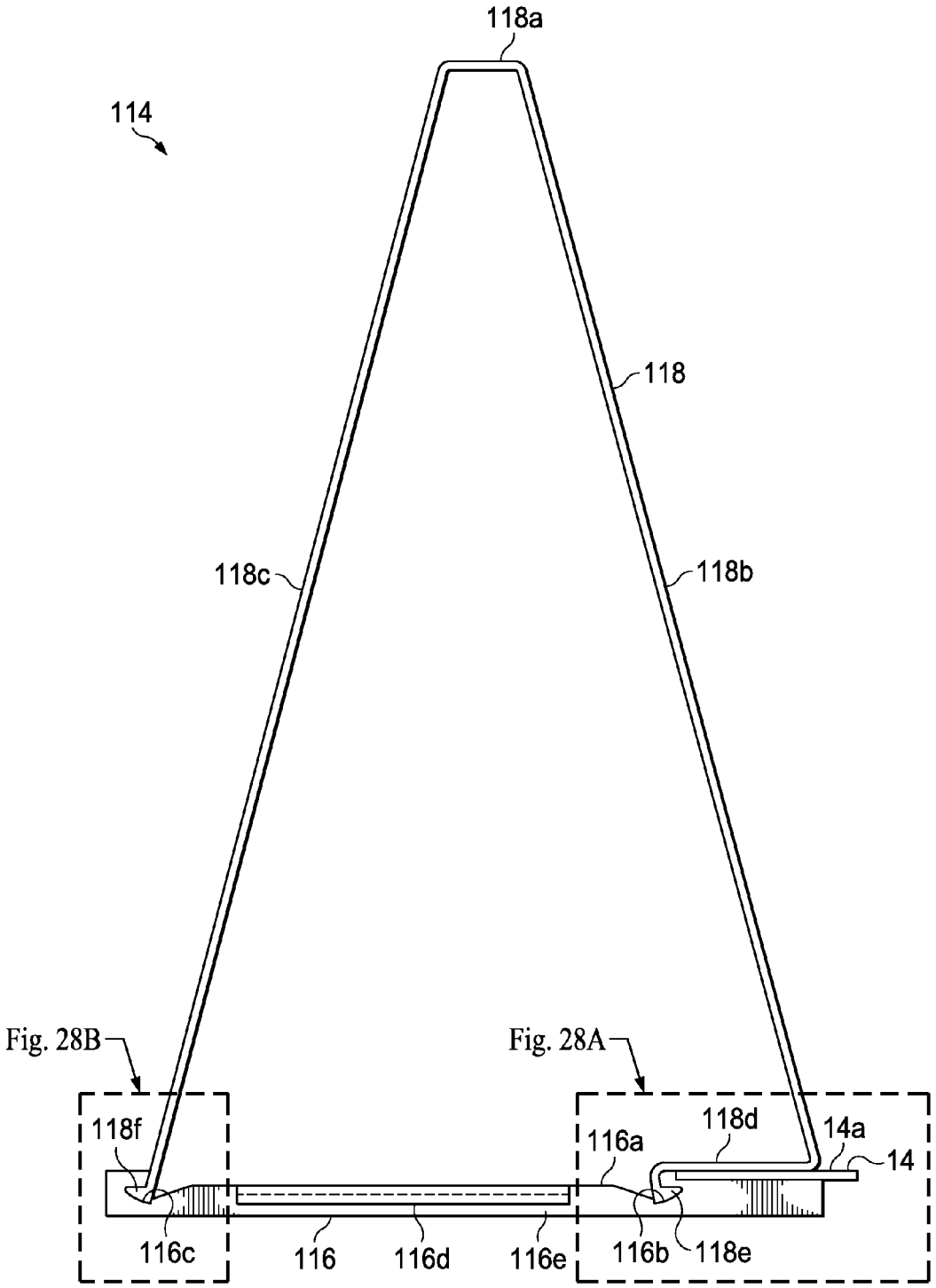
FIG. 27 is an unexploded elevational view of the wall assembly of FIGS. 25 and 26, according to an exemplary embodiment.
Figure 28A:
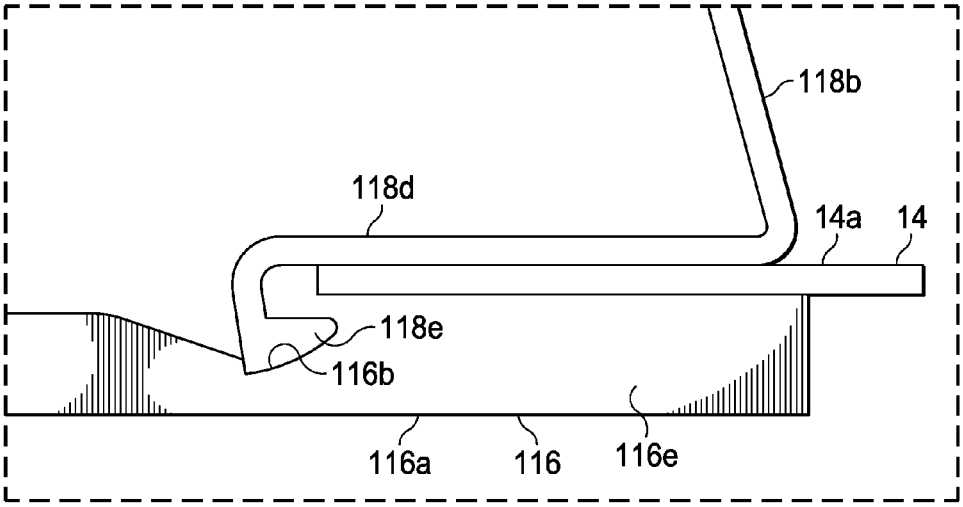
FIG. 28A is an enlarged view of a portion of FIG. 27, according to an exemplary embodiment.
Figure 28B:
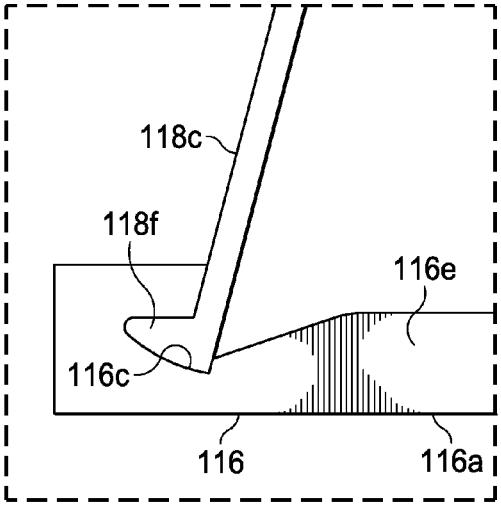
FIG. 28B is an enlarged view of another portion of FIG. 27, according to an exemplary embodiment.

As shown in FIGS. 27, 28A, and 28B, when the straight wall segment 118 is connected to the straight track segment 116, the feet 118*e* and 118*f* extend within the channels 116*b* and 116*c*, respectively. The cross-sections of the feet 118*e* and 118*f* are complementary with the cross-sections of the channels 116*b* and 116*c*, respectively. The portion 14*a* of the liner 14 is disposed within a region vertically defined between the horizontally-extending portion 118*d* and the straight track segment 116. In several exemplary embodiments, the portion 14*a* of the liner 14 is pinched between horizontally-extending portion 118*d* and the straight track segment 116, thereby connecting the liner 14 to the wall assembly 114. In several exemplary embodiments, the liner 14 is connected to the wall assembly 114 using a thermoset resin adhesive, and/or one or more other adhesives. In several exemplary embodiments, the liner 14 is connected to the wall assembly 114 using one or more of the above-described adhesives. In several exemplary embodiments, such adhesive(s) are disposed along the seams between the wall assembly 114 and the liner 14, thereby sealing the connection. Alternatively, in certain exemplary embodiments, the liner 14 extends over the wall assembly 114.

Figure 30:
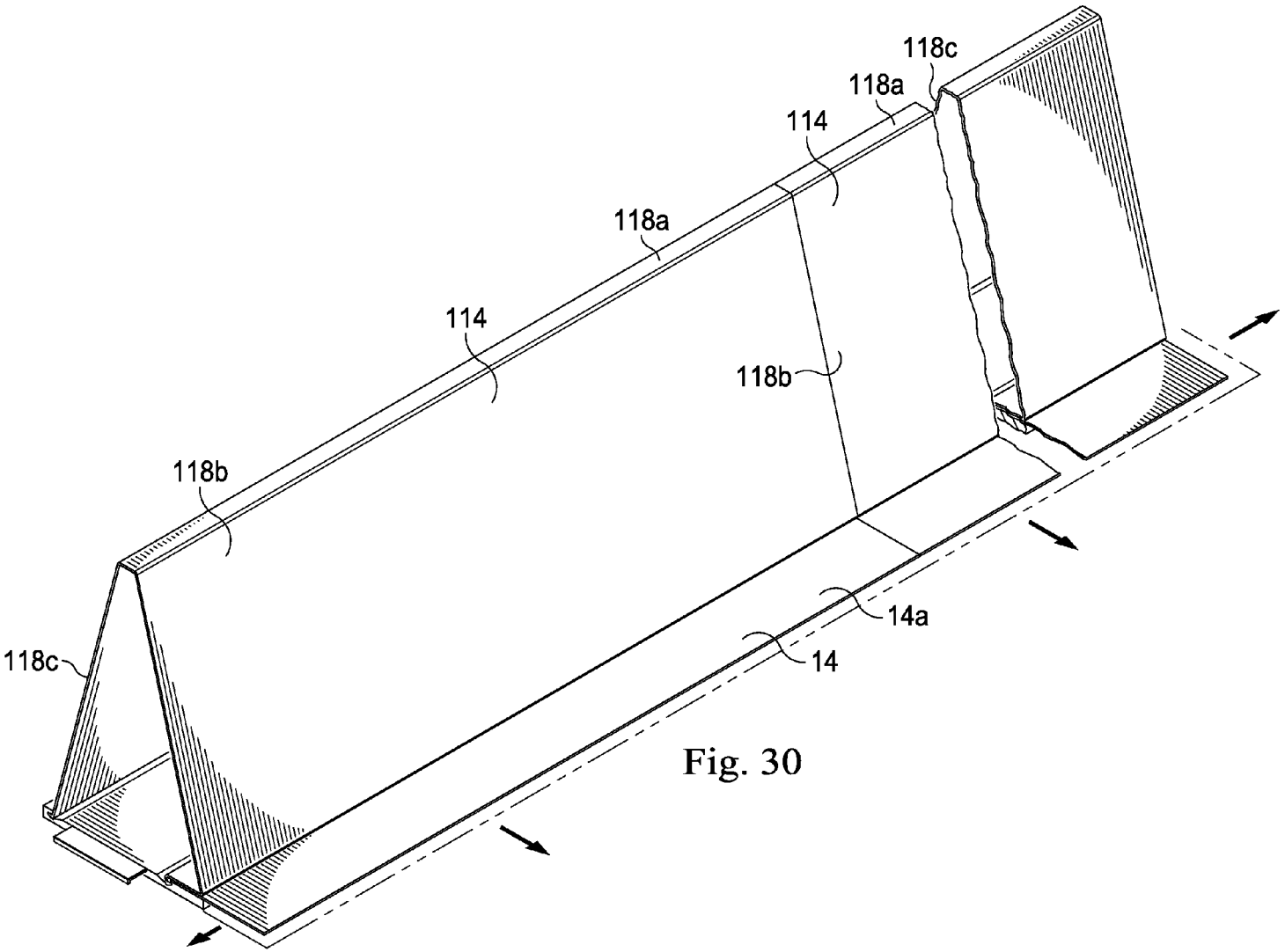
FIG. 30 is a perspective view of two adjacent wall assemblies of a secondary containment unit, according to an exemplary embodiment.

As shown in FIGS. 29 and 30, adjacent ones of the wall assembly 114 are connected to each other, and the L-shaped tab 116*d* of one of the wall assemblies 114 extends within the recess 116*f* and the channel 116*h* of the other of the wall assemblies 114. The liner 14 is connected to the adjacent ones of the wall assembly 114 in a manner identical to the above-described manner in which the liner 14 is connected the wall assembly 114 shown in FIGS. 27 and 28A. In several exemplary embodiments, respective ones of the wall assembly 114 may be used to form a secondary containment unit, which surrounds a fluid storage tank such as, for example, the fluid storage tank 18. The fluid storage tank 18 may be positioned on the liner 14. In several exemplary embodiments, respective ones of the wall assembly 114, as well as one or more of the above-described adhesives, may be used to form a secondary containment unit.

In several exemplary embodiments, one or more of the wall assemblies 114 are anchored to the ground, thereby increasing the stability of the secondary containment unit.

Figure 31:
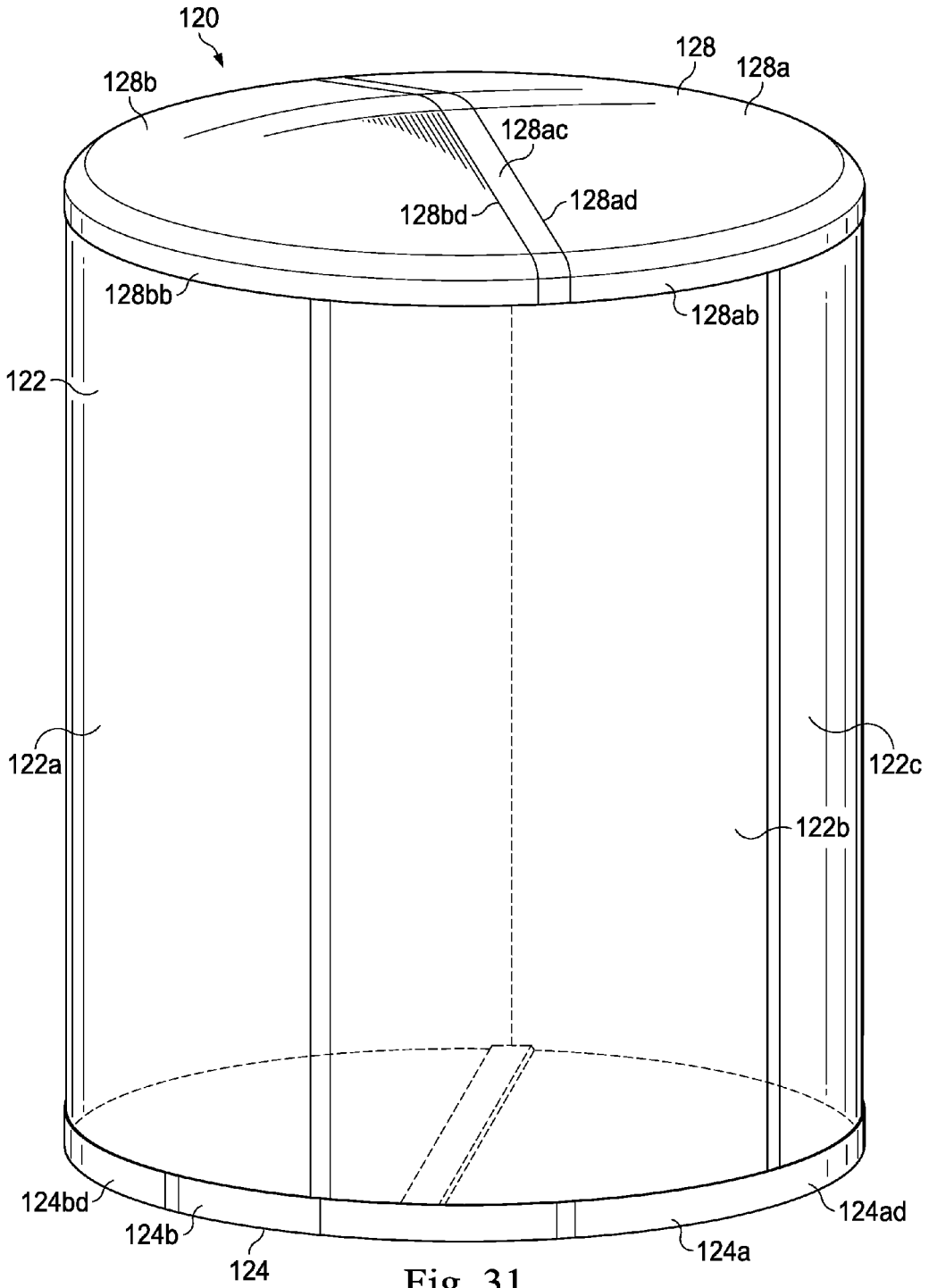
FIG. 31 is a perspective view of a modular composite above-ground fluid storage tank, according to an exemplary embodiment.
Figure 32:
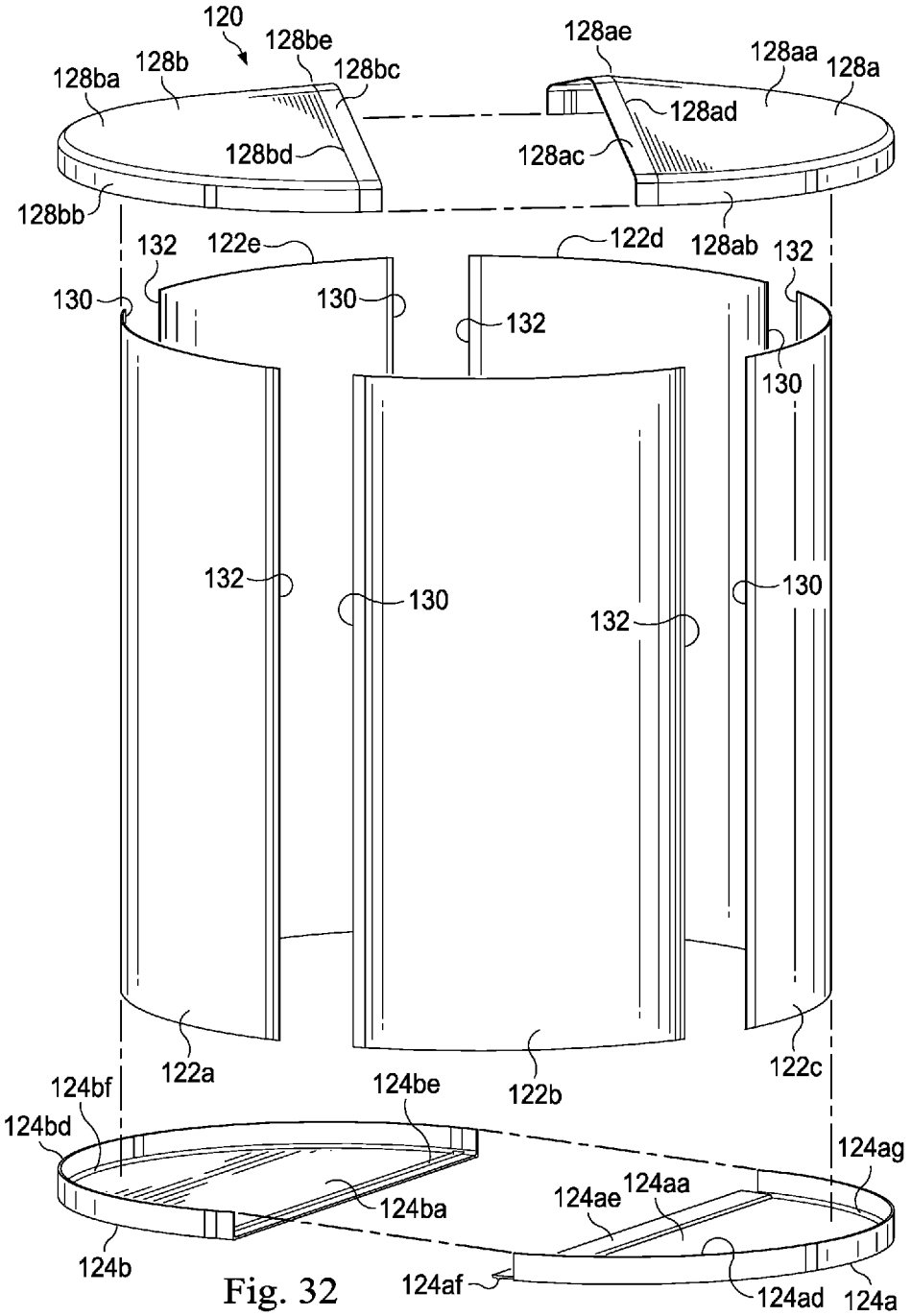
FIG. 32 is an exploded view of the modular composite above-ground fluid storage tank of FIG. 31, according to an exemplary embodiment.

Referring now to FIGS. 31 and 32, a modular fluid storage tank is generally referred to by the reference numeral 120 and includes a plurality of wall panels 122, which includes wall panels 122*a*, 122*b*, 122*c*, 122*d* and 122*e*. The fluid storage tank 120 further includes a floor 124 that includes floor segments 124*a* and 124*b*, and a tank top 128 that includes tank top segments 128*a* and 128*b*. The wall panels 122*a*, 122*b*, 122*c*, 122*d* and 122*e*, the floor segments 124*a* and 124*b*, and the tank top segments 128*a* and 128*b*, are hereinafter referred to collectively as the "tank segments".

In several exemplary embodiments, each of the tank segments is made in whole or in part from one or more of the materials described above in connection with the secondary containment unit 12.

According to several exemplary embodiments, the fluid storage tank 120 is constructed by interconnecting the tank segments to form a modular, continuous, impermeable structure. In several exemplary embodiments, adjoining tank segments are connected to each other with one or more of the adhesives described above in connection with the secondary containment unit 12.

With continuing reference to FIGS. 31 and 32, according to several exemplary embodiments, each of the wall panels 122*a*, 122*b*, 122*c*, 122*d* and 122*e* is cast separately to form a generally arcuate shape, and then interconnected with two other of the wall panels 122*a*, 122*b*, 122*c*, 122*d* and 122*e*, to form a generally cylindrical structure. As will be described in further detail below, opposing side portions of each of the wall panels 122*a*, 122*b*, 122*c*, 122*d* and 122*e* are adjacent respective complementary side portions of two other of the wall panels 122*a*, 122*b*, 122*c*, 122*d* and 122*e*.

Figure 33A:
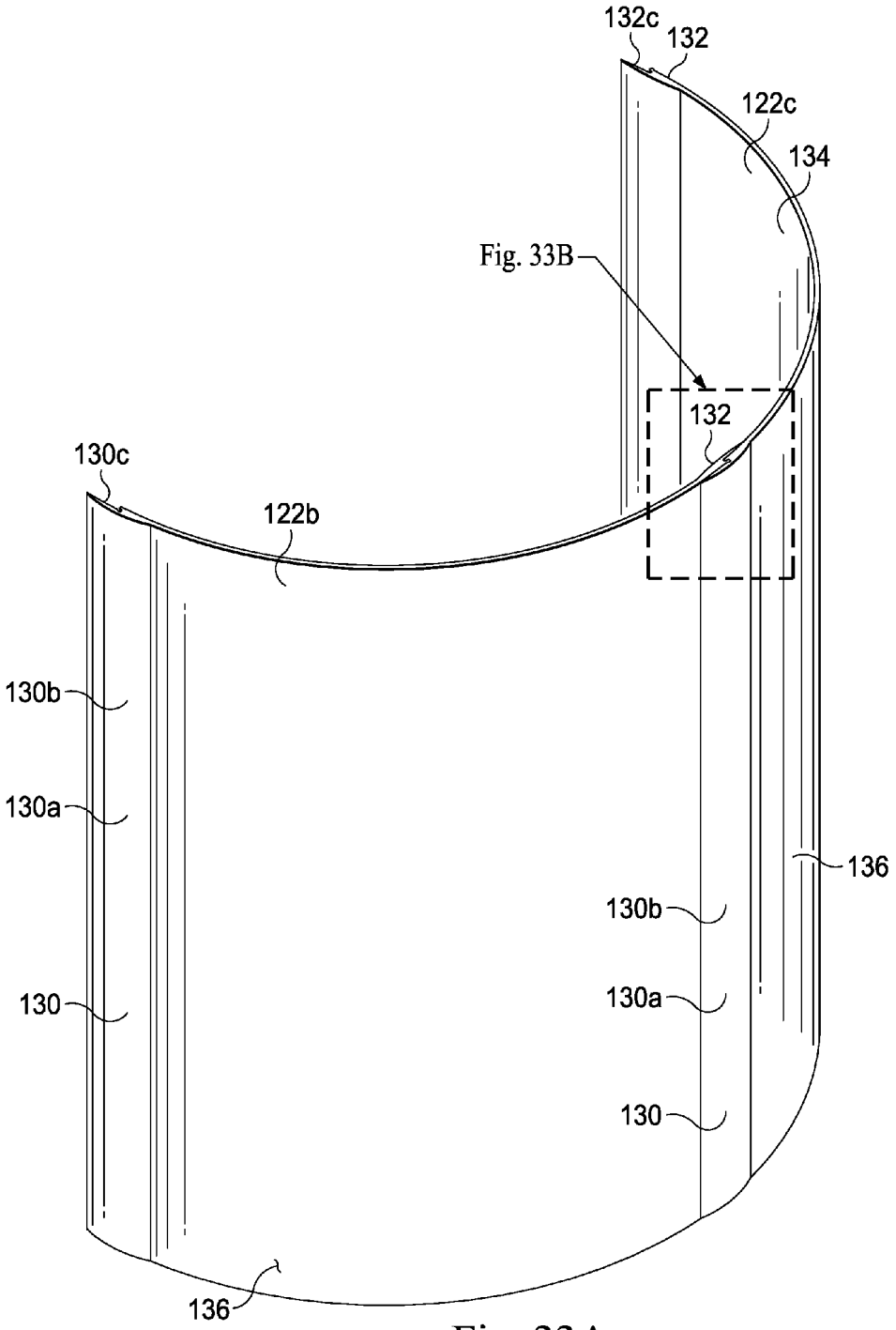
FIG. 33A is a perspective view of two interconnected wall panels of the modular composite above-ground fluid storage tank of FIGS. 31 and 32, according to an exemplary embodiment.
Figure 33C:
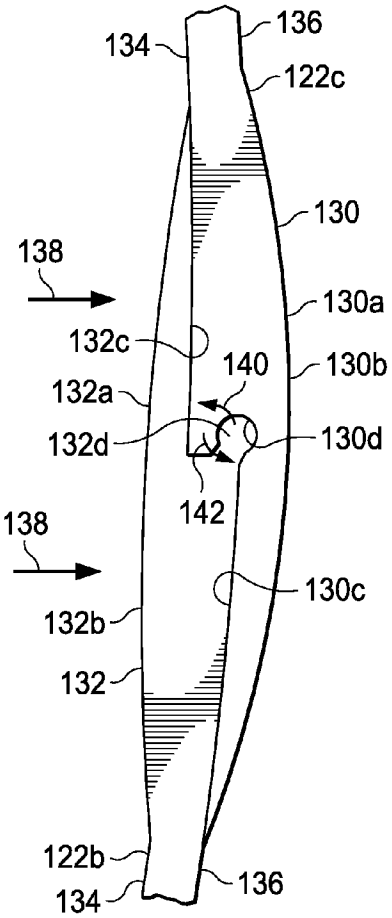
FIG. 33C is a top plan view of the interconnected joint between the two interconnected wall panels of FIG. 33B, according to an exemplary embodiment.
Figure 33B:
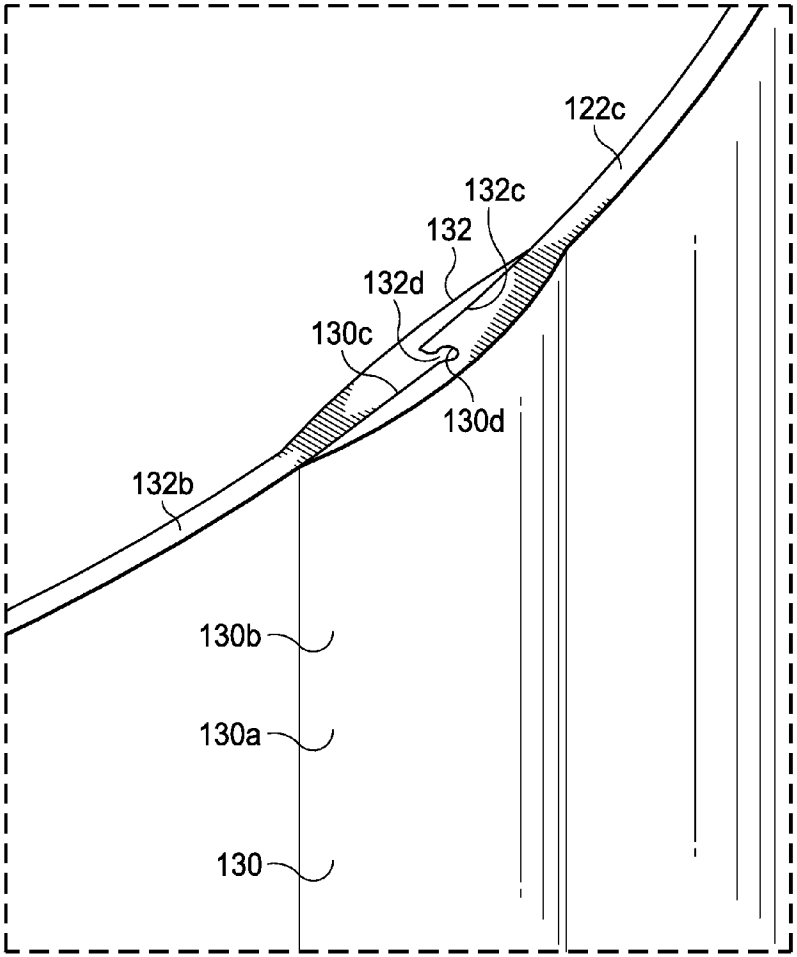
FIG. 33B is an enlarged view of a portion of FIG. 33A and illustrates an interconnected joint between the two interconnected wall panels of FIG. 33A, according to an exemplary embodiment.

Referring now to FIGS. 33A-33C with continuing reference to FIGS. 31 and 32, the wall panels 122*b* and 122*c* are identical to one another and thus the corresponding features thereof are given the same reference numerals. Each of the wall panels 122*b* and 122*c* includes opposing side portions 130 and 132, and defines an inside surface 134 and an outside surface 136. As shown in FIGS. 33A-33C, the side portion 132 of the wall panel 122*b* is connected to the side portion 130 of the wall panel 122*c*.

The side portion 130 includes an enlarged-radial-thickness portion 130*a* that defines an outside surface 130*b*, and an axially-extending channel 130*c* formed in the inside surface 134 at the enlarged-radial-thickness portion 130*a*. The channel 130*c* defines a groove 130*d*, which extends axially along the length of the side portion 130. The groove 130*d* has a generally circular cross section, as most clearly shown in FIG. 33C.

The side portion 132 includes an enlarged-radial-thickness portion 132*a* that defines an inside surface 132*b*, and an axially-extending channel 132*c* formed in the outside surface 136 at the enlarged-radial-thickness portion 132*a*. The channel 132*c* defines a bulbous protrusion 132*d*, which extends axially along the length of the side portion 132. The bulbous protrusion 132*d* has a generally circular cross section that is complementary to the generally circular cross section of the groove 130*d*, as most clearly shown in FIG. 33C.

The wall panels 122*a*, 122*d* and 122*e* are identical to each of the wall panels 122*b* and 122*c* and therefore the wall panels 122*a*, 122*d* and 122*e* will not be described in further detail. Thus, the respective features of the wall panels 122*a*, 122*b*, 122*c*, 122*d* and 122*e* are given the same reference numerals.

As noted above, as shown in FIGS. 33A-33C, the side portion 132 of the wall panel 122*b* is connected to the side portion 130 of the wall panel 122*c*. More particularly, the bulbous protrusion 132*d* of the side portion 132 of the wall panel 122*b* extends within the groove 130*d* of the side portion 130 of the wall panel 122*c*. The respective circular cross-sections of the bulbous protrusion 132*d* of the wall panel 122*b* and the groove 130*d* of the wall panel 122*c* are complementary to one another, providing a large contact surface area and ensuring that the interconnection between the wall panels 122*b* and 122*c* is secure. In several exemplary embodiments, one or more of the adhesives described above are disposed on respective surfaces defined by at least the bulbous protrusion 132*d* and the groove 130*d* to further secure the interconnection between the wall panels 122*b* and 122*c*.

In several exemplary embodiments, to cause the extension of the bulbous protrusion 132*d* of the wall panel 122*b* within the groove 130*d* of the wall panel 122*c* in accordance with the foregoing, the wall panels 122*b* and 122*c* are offset axially from one another by about their axial length. Relative axial movement between the wall panels 122*b* and 122*c* is then effected so that one of the bulbous protrusion 132*d* and the groove 130*d* slides within (or along) the other of the bulbous protrusion 132*d* and the groove 130*d*. This relative axial movement is continued until the opposing axial ends of the bulbous protrusion 132*d* are axially aligned with the corresponding axial ends of the groove 130*d*, as shown in FIG. 33A.

In several exemplary embodiments, when the fluid storage tank 120 stores fluid, hydrostatic pressure is applied radially outwardly against the wall panels 122*b* and 122*c*, as indicated by arrows 138. In response to this hydrostatic pressure, the bulbous protrusion 132*d* is urged to extend even further into the groove 130*d*, thereby increasing the frictional engagement between the wall panels 122*b* and 122*c*. Thus, the interconnection between the wall panels 122*b* and 122*c* is reinforced when subjected to hydrostatic pressure, facilitating the continued storage of the fluid within the fluid storage tank 120. In several exemplary embodiments, in response to the hydrostatic forces indicated by the arrows 138, the bulbous protrusion 132*d* rotates in the direction indicated by an arrow 140. This rotation in the direction indicated by the arrow 140 pushes the bulbous protrusion 132*d* further into the groove 130*d*. Consequently, the enlarged-radial-thickness portion 130*a* adjacent the groove 130*d* rotates in the direction indicated by an arrow 142. As a result, the frictional engagement between the wall panels 122*b* and 122*c* is increased. Thus, the interconnection between the wall panels 122*b* and 122*c* is reinforced when subjected to hydrostatic pressure, facilitating the continued storage of the fluid within the fluid storage tank 120.

The side portion 132 of the wall panel 122*a* is connected to the side portion 130 of the wall panel 122*b* in a manner identical to the above-described manner in which the side portion 132 of the wall 122*b* is connected to the side portion 130 of the wall panel 122*c*. The side portion 132 of the wall panel 122*c* is connected to the side portion 130 of the wall panel 122*d* in a manner identical to the above-described manner in which the side portion 132 of the wall 122*b* is connected to the side portion 130 of the wall panel 122*c*. The side portion 132 of the wall panel 122*d* is connected to the side portion 130 of the wall panel 122*e* in a manner identical to the above-described manner in which the side portion 132 of the wall 122*b* is connected to the side portion 130 of the wall panel 122*c*. The side portion 132 of the wall panel 122*e* is connected to the side portion 130 of the wall panel 122*a* in a manner identical to the above-described manner in which the side portion 132 of the wall 122*b* is connected to the side portion 130 of the wall panel 122*c*. Each of the respective interconnections between the wall panels 122*c* and 122*d*, between the wall panels 122*d* and 122*e*, between the wall panels 122*e* and 122*a*, and between the wall panels 122*a* and 122*b*, operates in a manner identical to the above-described manner in which the interconnection between the wall panels 122*b* and 122*c* operates when the fluid storage tank 120 stores fluid and hydrostatic pressure is applied radially outwardly.

Figure 34A:
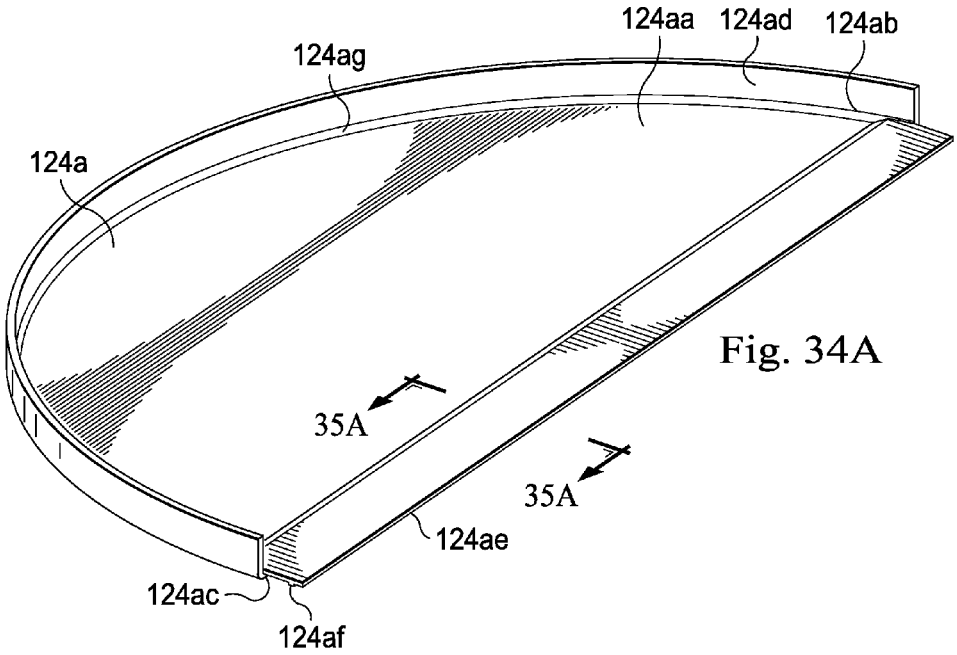
FIG. 34A is a perspective view of a floor segment of the modular composite above-ground fluid storage tank of FIGS. 31 and 32, according to an exemplary embodiment.
Figure 34B:
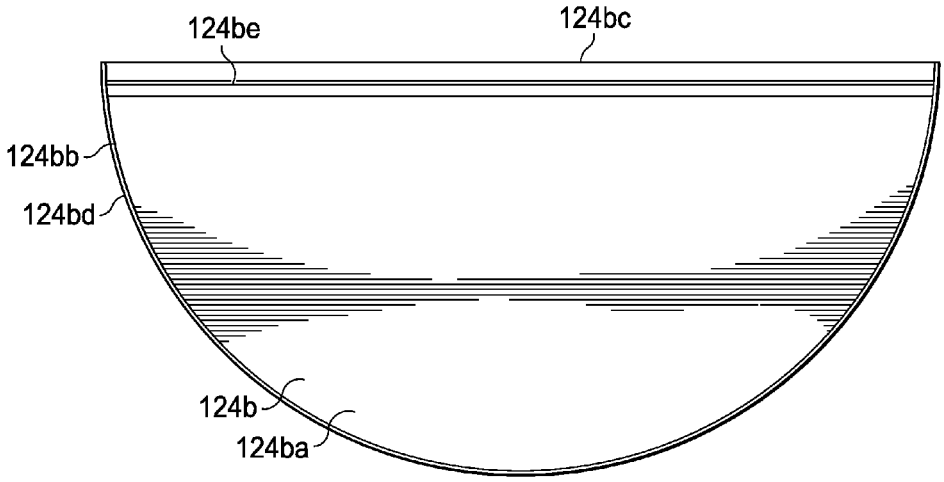
FIG. 34B is a top plan view of another floor segment of the modular composite above-ground fluid storage tank of FIGS. 31 and 32, according to an exemplary embodiment.

Referring to FIGS. 34A, 34B, 35A and 35B with continuing reference to FIGS. 31-33C, the floor segment 124*a* is generally in the shape of a half-circle, and includes a planar portion 124*aa* that defines an arcuate edge 124*ab* and a linear edge 124*ac*. An arcuate band 124*ad* extends upwards from, and along, the arcuate edge 124*ab* of the planar portion 124*aa*. A planar lip 124*ae* is connected to the planar portion 124*aa*. The planar lip 124*ae* extends between the opposing ends of the arcuate band 124*ad*, and outwardly away from the linear edge 124*ac*. A rib 124*af* extends downward from the underside of the planar lip 124*ae* and along the length thereof. In an exemplary embodiment, a channel 124*ag* adjacent the arcuate band 124*ad* is formed in the planar portion 124*aa*. As shown in FIG. 34B, the floor segment 124*b* is also generally in the shape of a half-circle, and includes a planar portion 124*ba* that defines an arcuate edge 124*bb* and a linear edge 124*bc*. An arcuate band 124*bd* extends upwards from, and along, the arcuate edge 124*bb* of the planar portion 124*ba*. A linear groove 124*be* is formed in the planar portion 124*ba* and extends between the opposing ends of the arcuate band 124*bd*.

Figure 35A:
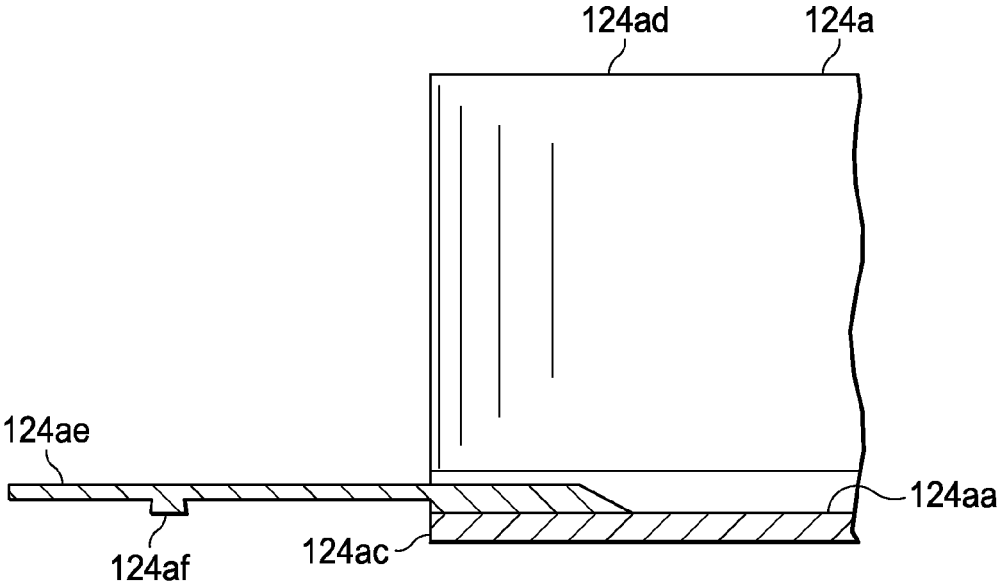
FIG. 35A is a sectional view taken along line 35A-35A of FIG. 34A, according to an exemplary embodiment.
Figure 35B:
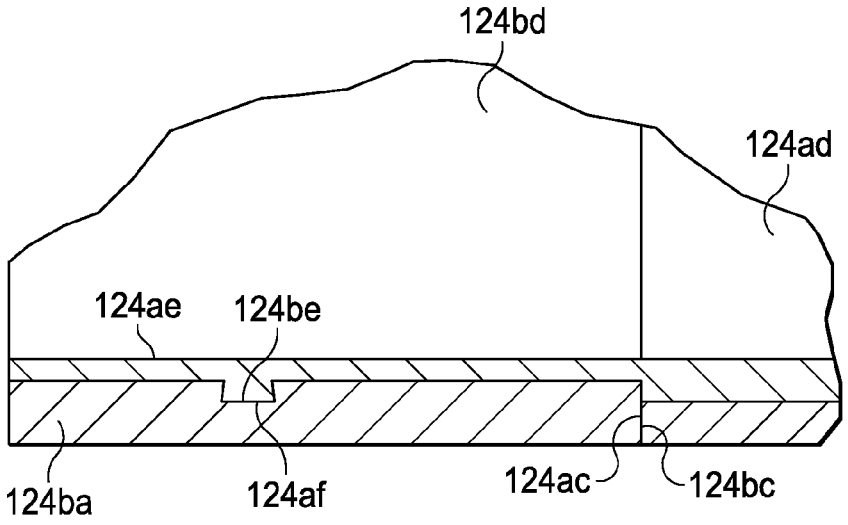
FIG. 35B is a sectional view of an engagement between respective portions of the floor segments shown in FIGS. 34A and 34B, according to an exemplary embodiment.

As shown in FIG. 35B, when the floor segment 124*a* is connected to the floor segment 124*b*, the rib 124*af* extends within the groove 124*be*, and the linear edges 124*ac* and 124*bc* are adjacent each other. In an exemplary embodiment, when the floor segment 124*a* is connected to the floor segment 124*b*, the corresponding opposing ends of the arcuate bands 124*ad* and 124*bd* are adjacent each other. In several exemplary embodiments, the connection between the floor segment 124*a* and the floor segment 124*b* is sealed with an adhesive, such as a thermoset resin adhesive, and/or one or more of the above-described adhesives. In several exemplary embodiments, one or more of the above-described adhesives are disposed on respective surfaces defined by one or more of the planar portion 124*aa*, the planar lip 124*ae*, the rib 124*af*, the planar portion 124*ba*, and the linear groove 124*be*, thereby securing the connection between the floor segments 124*a* and 124*b*. In several exemplary embodiments, each of the floor segments 124*a* and 124*b* is cast separately. In several exemplary embodiments, the floor 124 is cast as one piece.

Referring back to FIGS. 31 and 32 with continuing reference to FIGS. 33A-35B, the wall panels 122 are connected to the floor 124 so that the arcuate bands 124*ad* and 124*bd* encircle the plurality of wall panels 122. In an exemplary embodiment, the respective lower ends of at least the wall panels 122*b* and 122*c* extend within the channel 124*ag*. In an exemplary embodiment, a channel 124*bf* (shown in FIG. 32) adjacent the arcuate band 124*bd* is formed in the planar portion 124*ba*, and the respective lower ends of at least the wall panels 122*a* and 122*e* extend within the channel 124*bf*. In several exemplary embodiments, the floor 124 is joined or connected to the plurality of wall panels 122 using a thermoset resin adhesive, and/or one or more other adhesives described above, so as to form a continuous structure. In several exemplary embodiments, one or more of the above-described adhesives are disposed on respective surfaces defined by at least the arcuate bands 124*ad* and 124*bd*, the planar portions 124*aa* and 124*ba*, and the plurality of wall panels 122, thereby securing the connection between the floor 124 and the plurality of wall panels 122.

Figure 36:
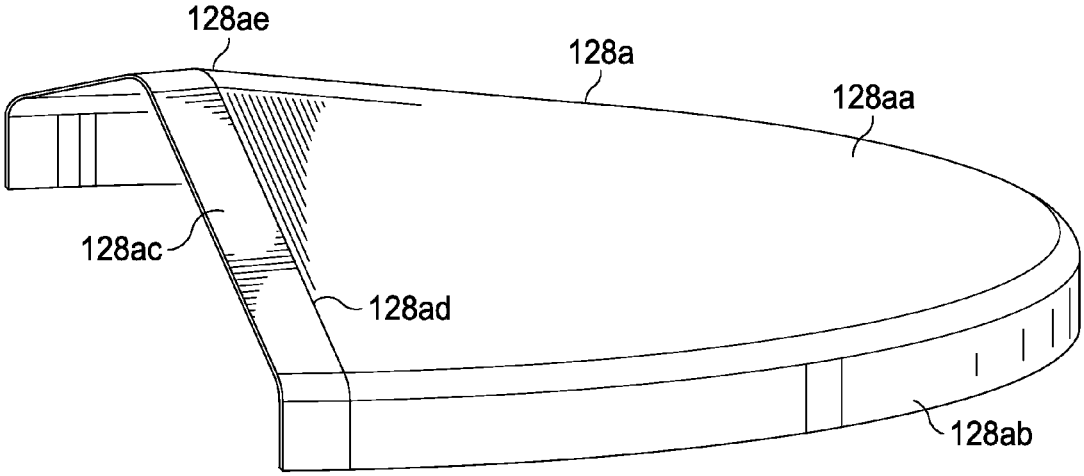
FIG. 36 is a perspective view of a tank top segment of the modular composite above-ground fluid storage tank of FIGS. 1 and 2, according to an exemplary embodiment.

Referring to FIG. 36 with continuing reference to FIGS. 31-35B, the tank top segment 128*a* includes a top portion 128*aa* and an arcuate band 128*ab* extending downwardly therefrom and circumferentially thereabout. A lip 128*ac* extends along an edge 128*ad* of the top portion 128*aa* and is adjacent the opposing ends of the arcuate band 128*ab*. The top portion 128*aa* and the lip 128*ac* define a peak portion 128*ae*, from which the top portion 128*aa* and the lip 128*ac* slope downwardly.

Referring back to FIGS. 31 and 32 with continuing reference to FIGS. 33A-36, the tank top segment 128*b* includes a top portion 128*ba* and an arcuate band 128*bb* extending downwardly therefrom and circumferentially thereabout. A lip 128*bc* extends along an edge 128*bd* of the top portion 128*ba* and is adjacent the opposing ends of the arcuate band 128*bb*. The top portion 128*ba* and the lip 128*bc* define a peak portion 128*be*, from which at least the top portion 128*ba* slopes downwardly. As shown in FIG. 1, when the tank top segment 128*a* is connected to the tank top segment 128*b*, the lip 128*ac* fits over the lip 128*bc*. In several exemplary embodiments, the tank top segments 128*a* and 128*b* are connected to form the tank top 128 by fitting the lip 128*ac* over the lip 128*bc* and sealing the connection with an adhesive, such as a thermoset resin adhesive, and/or one or more other adhesives described above. In several exemplary embodiments, one or more of the above-described adhesives are disposed on respective surfaces defined by one or both of the lip 128*ac* and the lip 128*bc*, thereby securing the connection between the floor segments 124*a* and 124*b*.

In several exemplary embodiments, each tank top segment 128*a* and 128*b* is cast separately. In several exemplary embodiments, the tank top 128 is cast as one piece.

As shown in FIGS. 31 and 32, the tank top 128 is connected to the plurality of wall panels 122 so that the arcuate bands 128*ab* and 128*bb* encircle the plurality of wall panels 122. In several exemplary embodiments, the tank top 128 is joined or connected to the plurality of wall panels 122 using a thermoset resin adhesive, and/or one or more other adhesives described above, so as to form a continuous structure. In several exemplary embodiments, one or more of the above-described adhesives are disposed on respective surfaces defined by at least the arcuate bands 128*ab* and 128*bb*, the lips 128*ac* and 128*bc*, and the plurality of wall panels 122, thereby securing the connection between the tank top 128 and the plurality of wall panels 122. In several exemplary embodiments, the tank top 128 may be cast as one piece and configured to set, clip, or bolt onto the top of the wall panels 122.

According to an exemplary embodiment, any number of wall panels 122 may be incorporated into the fluid storage tank 120, such that the fluid storage tank 120 may be of any size or shape necessary for the intended purpose of the fluid storage tank 120.

In several exemplary embodiments, the fluid storage tank 18 shown in FIG. 1 is identical to the fluid storage tank 120 shown in FIG. 31-36.

EXAMPLES

The above-described exemplary embodiments provide a number of improvements over conventional oilfield fluid storage tanks and secondary containment units. For example, the resin composite, including the fiber reinforcement and filler materials, used to fabricate the components of a fluid storage tank and/or secondary containment unit according to the exemplary embodiments is more resistant to corrosion and permeability of the contents of the tank or secondary containment unit than the materials used in conventional tanks and secondary containment units.

The weight of the resin composite is also less than the steel used in conventional tanks and secondary containment units. At the same time, the resin composite provides increased stiffness to reduce flexing of the components of the fluid storage tank during transport, handling and exposure to wind and other environmental stresses. This increased stiffness also helps the fluid storage tank to maintain a constant, measured volume, such that a fluid storage tank according to the present invention could be used to store oil and gas, in addition to water.

Additionally, the components of the resin composite decrease flammability and increase fire resistance as compared to some of the conventional tanks and secondary containment units.

An exemplary composite tank section was constructed as described above using woven or stitched glass fiber mats, such as those that are commercially available from Fibre Glast Developments Corporation, to reinforce the resin, and its mechanical properties were tested. Tensile strength, Young's Modulus and percent elongation at break for the composite tank coupon were tested according to the ASTM International procedure D3039. The flexural properties of the composite were tested according to the ASTM International procedure D790. These properties were compared with standard literature values for similar fiberglass and steel used in the field. Table 1 summarizes the results from the testing.

TABLE 1

| | Tensile Strength (psi) | Young's Modulus (psi) | Elongation at Break (%) | Flexural Strength (32:1) (psi) | Flex Modulus (psi) | Flex Strain at Break (%) |
|---|---|---|---|---|---|---|
| Composite | 42,000 | 2,460,000 | 3.23 | 50,000 | 2,090,000 | 3.48 |
| Steel | 58-80,000 | 29,000,000 | 20 | 36,000 | N/A | N/A |

TABLE 1-continued

| | Tensile Strength (psi) | Young's Modulus (psi) | Elongation at Break (%) | Flexural Strength (32:1) (psi) | Flex Modulus (psi) | Flex Strain at Break (%) |
|---|---|---|---|---|---|---|
| Fiberglass | 30,000 (lw, lengthwise) 7,000 (cw, crosswise) | 2,5000,000 (lw) 800,000 (cw) | N/A | 30,000 (lw) 10,000 (cw) | 1,800,000 (lw) 800,000 (cw) | N/A |

As used above, tensile strength is the measurement of the amount of stress a material can withstand while being stretched or pulled before failing or breaking. In the above test, the exemplary composite tank segment performed better than typical fiberglass materials used in the field due to the higher performance resin in the composite and the multidirectional glass reinforcement of the resin from woven fiber glass mats. The exemplary composite also performed comparably to similar steel used in the field. This result shows that the exemplary composite coupon retains comparable tensile strength compared to other steel tanks in the field, while being significantly lighter in weight. In an exemplary embodiment, an exemplary composite tank may have a 300 barrel capacity and weigh approximately 3,080 pounds. A similarly sized steel tank weighs approximately 5,000 pounds or more.

As used above, Young's modulus (also known as the tensile modulus) is a measurement of the stiffness of an elastic material. In the above test, the exemplary composite had comparable Young's modulus to the lengthwise measurements of typical fiberglass, and significantly higher Young's modulus compared to the crosswise measurement of typical fiberglass. The lengthwise and crosswise measurements of the fiberglass comes from measuring both the lengthwise and crosswise orientations of the fibers that are woven together to make the material. Typically, the crosswise orientation of fibers is significantly weaker than the lengthwise orientation. The exemplary composite material does not exhibit a disparity in its measurements between lengthwise and crosswise orientations that is greater than about 20% on average. Although the Young's modulus for the exemplary composite is lower than that of the steel, the value for the exemplary composite is still within a sufficient operating range.

As used above, elongation at break is a measurement of the strain on a material when it breaks. The smaller the value, the more brittle the material is. The above test shows that the composite material is capable of greater amounts of elongation prior to failure than steel.

As used above, flexural strength is a measurement of a material's ability to resist deformation under stress. In the above test, the exemplary composite performed better than both the steel and fiberglass literature values. This test result indicates that the exemplary composite will be able to better resist deformation under stress than both steel and fiberglass currently in use in the field.

As used above, the flex modulus measures the force necessary to bend or deform a material. The above test shows that the exemplary composite requires significantly more force to bend or deform than fiberglass. This test result indicates that the exemplary composite will be more flexible and durable than fiberglass under similar conditions.

As used above, flex strain at break is a measurement of how much a material will deform or strain before failing or breaking. As with elongation, the smaller the value, the more brittle the material is. The above test shows that the exemplary composite is capable of high amounts of flexural strain before break.

An assembly for a modular secondary containment unit is provided that includes a track segment including first and second channels; a wall segment mounted on the track segment and extending within the first channel of the track segment; and a brace engaged with the wall segment and extending within the second channel of the track segment. In an exemplary embodiment, each of the track segment, the wall segment, and the brace is composed of one or more reinforced resin composite materials. In an exemplary embodiment, the assembly forms at least a portion of a wall of the modular secondary containment unit; and wherein each of the track segment, the wall segment, and the brace has a constant cross section across its length so that it can be manufactured using a pultrusion process. In an exemplary embodiment, the assembly forms a corner of the modular secondary containment unit; and wherein each of the track segment, the wall segment, and the brace includes a mitered end portion adapted to be adjacent another mitered end portion of another track segment, wall segment, or brace. In an exemplary embodiment, the track segment includes a first horizontally-extending portion; wherein the wall segment includes an angularly-extending portion that extends angularly upward from the track segment; wherein the brace includes a plate extending angularly upward from the track segment and engaging the angularly-extending portion of the wall segment; and wherein a first angle is defined between the first horizontally-extending portion of the track segment and the angularly-extending portion of the wall segment. In an exemplary embodiment, the first angle ranges from about 10 degrees to less than about 90 degrees. In an exemplary embodiment, the first angle ranges from about 65 degrees to about 75 degrees. In an exemplary embodiment, the angularly-extending portion of the wall segment defines a first surface adapted to engage a fluid to be contained by the secondary containment unit, and a second surface with which the brace is engaged; wherein the brace further includes a tab extending along the plate and within the second channel of the track segment. In an exemplary embodiment, the wall segment includes further includes a second horizontally-extending portion from which the angularly-extending portion extends angularly upward, wherein a second angle is defined between the angularly-extending portion and the second horizontally-extending portion, the second angle being substantially equal to the first angle; a first vertically-extending wall connected to the second horizontally-extending portion on one side thereof; and a second vertically-extending wall connected to the second horizontally-extending portion on the side thereof opposing the first vertical wall; wherein the second vertically-extending wall of the wall segment extends within the first channel of the track segment; wherein the track segment further includes a third vertically-extending wall to which the first horizontally-extending portion is connected; and wherein the first horizontally-extending portion of the track segment extends between the third vertically-extending wall of the track segment and the first channel of the track segment. In an exemplary embodiment, a portion of a liner is adapted to be disposed between the first horizontally-extending portion of the track segment and the second horizontally-extending portion of the wall segment, and between the third vertically-extending wall of the track segment and the first vertically-extending wall of the wall segment; and wherein, when the portion of the liner is disposed between the first horizontally-extending portion of the track segment and the second horizontally-extending portion of the wall segment, and between the third vertically-extending wall of the track segment and the first vertically-extending wall of the wall segment, the first and second horizontally-extending portions are spaced in a generally parallel relation, and the third and first vertically-extending walls are spaced in a generally parallel relation. In an exemplary embodiment, a first force is adapted to be applied against the angularly-extending portion of the wall segment in response to the containment of fluid by the secondary containment unit; wherein a second force is adapted to be applied against the angularly-extending portion of the wall segment in response to wind loading, the second force being opposite in direction to that of the first force; wherein the third vertically-extending wall of the track segment is adapted to prevent the first vertically-extending wall of the wall segment from appreciably rotating in response to the application of the second force; and wherein the extension of the second vertically-extending wall of the wall segment within the first channel of the track segment is adapted to prevent the second vertically-extending wall of the wall segment from appreciably rotating in response to the application of the second force. In an exemplary embodiment, a force is adapted to be applied against the angularly-extending portion of the wall segment in response to the containment of fluid by the secondary containment unit; and wherein the assembly is adapted to dynamically respond to the application of the force. In an exemplary embodiment, a force is adapted to be applied against the angularly-extending portion of the wall segment in response to the containment of fluid by the secondary containment unit; and wherein the first vertically-extending wall of the wall segment is adapted to move upwards in response to the application of the force. In an exemplary embodiment, the angularly-extending portion of the wall segment defines a first surface adapted to engage a fluid to be contained by the secondary containment unit, and a second surface with which the brace is engaged; wherein the wall segment further includes an angular rib that extends along at least a portion of the second surface of the angularly-extending portion; wherein the angular rib extends angularly downward from the second surface of the angularly-extending portion; wherein a vertex is defined between the angular rib and the second surface; and wherein the plate of the brace is disposed in the vertex between the angular rib and the second surface. In an exemplary embodiment, the one or more reinforced resin composite materials comprise vinyl esters, epoxies, polyurethanes, polyureas, acrylics, styrenics, melamines, phenol-formaldehydes, polyimides, or any combination or mixture thereof.

A method of constructing a modular secondary containment unit is provided that includes connecting two corner track segments, each of the corner track segments including a mitered end portion; connecting a liner to the corner track segments; mounting corner wall segments on the corner track segments, respectively, so that respective portions of the liner are disposed between the corner track segments and the corner wall segments mounted thereon, respectively, each of the corner wall segments including a mitered end portion; and engaging corner braces with respective ones of the combinations of the corner track segments and the straight wall segments mounted thereon. In an exemplary embodiment, the method includes connecting the corner wall segments. In an exemplary embodiment, the method includes connecting a straight track segment to one of the corner track segments; connecting the liner to the straight track segment; mounting a straight wall segment on the straight track segment so that a portion of the liner is disposed between the straight track segment and the straight wall segment mounted thereon; and engaging a straight wall brace with each of the straight track segment and the straight wall segment. In an exemplary embodiment, the method includes connecting the straight wall segment to the corner wall segment mounted on the one of the corner track segments. In an exemplary embodiment, the method includes manufacturing each of the straight track segment, the straight wall segment, and the straight wall brace using a pultrusion process. In an exemplary embodiment, the method includes manufacturing each of the corner track segments, including manufacturing a straight track segment using a pultrusion process and cutting the straight track segment to form the corresponding mitered end portion of the each corner track segment; manufacturing each of the corner wall segments, including manufacturing a straight wall segment using a pultrusion process and cutting the straight wall segment to form the corresponding mitered end portion of the each corner wall segment; and manufacturing each of the corner braces, including manufacturing a straight brace using a pultrusion process and cutting the straight brace to form the corresponding mitered end portion of the each corner brace. In an exemplary embodiment, each of the straight track segment, the straight wall segment, and the straight wall brace is composed of one or more reinforced resin composite materials comprising vinyl esters, epoxies, polyurethanes, polyureas, acrylics, styrenics, melamines, phenol-formaldehydes, polyimides, or any combination or mixture thereof.

A modular secondary containment unit is provided that is adapted to surround an above-ground fluid storage tank. The modular secondary containment tank includes a plurality of corner assemblies, wherein two or more components of each of the corner assemblies are composed of one or more reinforced resin composite materials, and wherein the two or more components of each of the corner assemblies include respective mitered end portions engaged with each other. In an exemplary embodiment, the two or more components of each of the corner assemblies are manufactured using a pultrusion process and a cutting process to form the respective mitered end portions. In an exemplary embodiment, the module secondary containment unit includes a liner connected to the plurality of corner assemblies and over which the above-ground fluid storage tank is adapted to be positioned. In an exemplary embodiment, the modular secondary containment unit includes a plurality of wall assemblies, each of the wall assemblies being connected to at least one of the corner assemblies. In an exemplary embodiment, each of the wall assemblies includes a straight track segment including first and second channels; a straight wall segment mounted on the track segment and extending within the first channel of the track segment; and a straight brace engaged with the wall segment and extending within the second channel of the track segment. In an exemplary embodiment, each of the straight track segment, the straight wall segment, and the straight brace is composed of one or more reinforced resin composite materials. In an exemplary embodiment, each of the track segment, the wall segment, and the brace has a constant cross section across its length so that it can be manufactured using a pultrusion process. In an exemplary embodiment, the one or more reinforced resin composite materials comprise vinyl esters, epoxies, polyurethanes, polyureas, acrylics, styrenics, melamines, phenol-formaldehydes, polyimides, or any combination or mixture thereof.

A fluid storage tank is provided that includes a first floor segment; first and second wall panels interconnected together, the first and second wall panels being connected to the first floor segment; and a first top segment connected to the first and second wall panels; wherein each of the first floor segment, the first and second wall panels, and the first top segment is composed of one or more reinforced resin composite materials. In an exemplary embodiment, each of the first and second wall panels includes: opposing first and second side portions; a groove extending along the length of the first side portion; and a protrusion extending along the length of the second side portion; and wherein the protrusion of the first wall panel extends within the groove of the second wall panel to interconnect the first and second wall panels. In an exemplary embodiment, the protrusion is adapted to be urged to extend further into the groove in response to an application of a radial force against the interconnected first and second wall panels. In an exemplary embodiment, the interconnection between the first and second wall panels is adapted to be reinforced when the first and second wall panels are subjected to hydrostatic pressure. In an exemplary embodiment, the groove has a generally circular cross section and the protrusion has a generally circular cross section that is complementary to the generally circular cross section of the groove. In an exemplary embodiment, each of the first and second wall panels defines inside and outside surfaces; wherein each of the first side portions includes a first enlarged-radial-thickness portion and a first channel formed in the inside surface at the first enlarged-radial-thickness portion, the first channel defining the groove; and wherein each of the second side portions includes a second enlarged-radial-thickness portion and a second channel formed in the outside surface at the second enlarged-radial-thickness portion, the second channel defining the protrusion. In an exemplary embodiment, the tank includes a second floor segment connected to the first floor segment. In an exemplary embodiment, the first floor segment includes a rib and the second floor segment includes a groove in which the rib extends. In an exemplary embodiment, the tank includes a second top segment connected to the first top segment. In an exemplary embodiment, the first tank segment includes a first lip and the second tank segment includes a second lip over which the first lip is fit.

A kit for a secondary containment unit is provided that includes a track segment including first and second channels; a wall segment adapted to be mounted on the track segment and extend within the first channel of the track segment; and a brace adapted to be engaged with the wall segment and extend within the second channel of the track segment. In an exemplary embodiment, each of the track segment, the wall segment, and the brace is composed of one or more reinforced resin composite materials. In an exemplary embodiment, the kit is adapted to form at least a portion of a wall of the modular secondary containment unit; and wherein each of the track segment, the wall segment, and the brace has a constant cross section across its length so that it can be manufactured using a pultrusion process. In an exemplary embodiment, the kit is adapted to form a corner of the modular secondary containment unit; and wherein each of the track segment, the wall segment, and the brace includes a mitered end portion adapted to be adjacent another mitered end portion of another track segment, wall segment, or brace. In an exemplary embodiment, the track segment includes a first horizontally-extending portion; wherein the wall segment includes an angularly-extending portion that is adapted to extend angularly upward from the track segment; wherein the brace includes a plate adapted to extend angularly upward from the track segment and engage the angularly-extending portion of the wall segment; and wherein, when the angularly-extending portion extend angularly upward from the track segment, a first angle is defined between the first horizontally-extending portion of the track segment and the angularly-extending portion of the wall segment. In an exemplary embodiment, the first angle ranges from about 10 degrees to less than about 90 degrees. In an exemplary embodiment, the first angle ranges from about 65 degrees to about 75 degrees. In an exemplary embodiment, the angularly-extending portion of the wall segment defines a first surface adapted to engage a fluid to be contained by the secondary containment unit, and a second surface with which the brace is engaged; wherein the brace further includes a tab extending along the plate and adapted to extend within the second channel of the track segment. In an exemplary embodiment, the wall segment includes further includes a second horizontally-extending portion from which the angularly-extending portion extends angularly upward, wherein a second angle is defined between the angularly-extending portion and the second horizontally-extending portion, the second angle being substantially equal to the first angle; a first vertically-extending wall connected to the second horizontally-extending portion on one side thereof; and a second vertically-extending wall connected to the second horizontally-extending portion on the side thereof opposing the first vertical wall; wherein the second vertically-extending wall of the wall segment is adapted to extend within the first channel of the track segment; wherein the track segment further includes a third vertically-extending wall to which the first horizontally-extending portion is connected; and wherein the first horizontally-extending portion of the track segment extends between the third vertically-extending wall of the track segment and the first channel of the track segment. In an exemplary embodiment, a portion of a liner is adapted to be disposed between the first horizontally-extending portion of the track segment and the second horizontally-extending portion of the wall segment, and between the third vertically-extending wall of the track segment and the first vertically-extending wall of the wall segment; and wherein, when the portion of the liner is disposed between the first horizontally-extending portion of the track segment and the second horizontally-extending portion of the wall segment, and between the third vertically-extending wall of the track segment and the first vertically-extending wall of the wall segment, the first and second horizontally-extending portions are spaced in a generally parallel relation, and the third and first vertically-extending walls are spaced in a generally parallel relation. In an exemplary embodiment, a first force is adapted to be applied against the angularly-extending portion of the wall segment in response to the containment of fluid by the secondary containment unit; wherein a second force is adapted to be applied against the angularly-extending portion of the wall segment in response to wind loading, the second force being opposite in direction to that of the first force; wherein the third vertically-extending wall of the track segment is adapted to prevent the first vertically-extending wall of the wall segment from appreciably rotating in response to the application of the second force; and wherein the extension of the second vertically-extending wall of the wall segment within the first channel of the track segment is adapted to prevent the second vertically-extending wall of the wall segment from appreciably rotating in response to the application of the second force. In an exemplary embodiment, a force is adapted to be applied against the angularly-extending portion of the wall segment in response to the containment of fluid by the secondary containment unit; and wherein the kit is adapted to form at least a portion of a wall of the modular secondary containment unit, the wall being adapted to dynamically respond to the application of the force. In an exemplary embodiment, a force is adapted to be applied against the angularly-extending portion of the wall segment in response to the containment of fluid by the secondary containment unit; and wherein the first vertically-extending wall of the wall segment is adapted to move upwards in response to the application of the force. In an exemplary embodiment, the angularly-extending portion of the wall segment defines a first surface adapted to engage a fluid to be contained by the secondary containment unit, and a second surface with which the brace is engaged; wherein the wall segment further includes an angular rib that extends along at least a portion of the second surface of the angularly-extending portion; wherein the angular rib extends angularly downward from the second surface of the angularly-extending portion; wherein a vertex is defined between the angular rib and the second surface; and wherein the plate of the brace is adapted to be disposed in the vertex between the angular rib and the second surface. In an exemplary embodiment, the one or more reinforced resin composite materials comprise vinyl esters, epoxies, polyurethanes, polyureas, acrylics, styrenics, melamines, phenol-formaldehydes, polyimides, or any combination or mixture thereof.

A unit kit for forming a modular secondary containment unit is provided, the modular secondary containment unit being adapted to surround an above-ground fluid storage tank. The unit kit includes a plurality of corner assembly kits, wherein two or more components of each of the corner assembly kits are composed of one or more reinforced resin composite materials, and wherein the two or more components of each of the corner assembly kits include respective mitered end portions adapted to be adjacent each other. In an exemplary embodiment, the two or more components of each of the corner assembly kits are manufactured using a pultrusion process and a cutting process to form the respective mitered end portions. In an exemplary embodiment, the unit kit includes a liner adapted to be connected to the plurality of corner assembly kits and over which the above-ground fluid storage tank is adapted to be positioned. In an exemplary embodiment, the unit kit includes a plurality of wall assembly kits, each of the wall assembly kits being adapted to be connected to at least one of the corner assembly kits. In an exemplary embodiment, each of the wall assembly kits includes a straight track segment including first and second channels; a straight wall segment adapted to be mounted on the track segment and extend within the first channel of the track segment; and a straight brace adapted to be engaged with the wall segment and extend within the second channel of the track segment. In an exemplary embodiment, each of the straight track segment, the straight wall segment, and the straight brace is composed of one or more reinforced resin composite materials. In an exemplary embodiment, each of the track segment, the wall segment, and the brace has a constant cross section across its length so that it can be manufactured using a pultrusion process. In an exemplary embodiment, the one or more reinforced resin composite materials comprise vinyl esters, epoxies, polyurethanes, polyureas, acrylics, styrenics, melamines, phenol-formaldehydes, polyimides, or any combination or mixture thereof.

A system for constructing a secondary containment unit is provided that includes means for connecting two corner track segments, each of the corner track segments including a mitered end portion; means for connecting a liner to the corner track segments; means for mounting corner wall segments on the corner track segments, respectively, so that respective portions of the liner are disposed between the corner track segments and the corner wall segments mounted thereon, respectively, each of the corner wall segments including a mitered end portion; and means for engaging corner braces with respective ones of the combinations of the corner track segments and the straight wall segments mounted thereon. In an exemplary embodiment, the system includes means for connecting the corner wall segments. In an exemplary embodiment, the system includes means for connecting a straight track segment to one of the corner track segments; means for connecting the liner to the straight track segment; mounting a straight wall segment on the straight track segment so that a portion of the liner is disposed between the straight track segment and the straight wall segment mounted thereon; and engaging a straight wall brace with each of the straight track segment and the straight wall segment. In an exemplary embodiment, the system includes means for connecting the straight wall segment to the corner wall segment mounted on the one of the corner track segments. In an exemplary embodiment, each of the straight track segment, the straight wall segment, and the straight wall brace is composed of one or more reinforced resin composite materials comprising vinyl esters, epoxies, polyurethanes, polyureas, acrylics, styrenics, melamines, phenol-formaldehydes, polyimides, or any combination or mixture thereof.

It is understood that variations may be made in the foregoing without departing from the scope of the disclosure. For example, although the foregoing discloses that the secondary containment unit 12, the secondary containment unit 90, the wall assembly 114, the above-ground fluid storage tank 18, and the above-ground fluid storage tank 120 may be used at oilfield production sites and/or in oilfield applications, in several exemplary embodiments the secondary containment unit 12, the secondary containment unit 90, the wall assembly 114, the above-ground fluid storage tank 18, and the above-ground fluid storage tank 120 may be used at other types of sites and/or in other types of applications.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upward," "downward," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. An assembly for a modular secondary containment unit, the assembly comprising:

a track segment comprising first and second channels;

a wall segment mounted on the track segment and extending within the first channel of the track segment; and a brace engaged with the wall segment and extending within the second channel of the track segment;

wherein the assembly forms at least a portion of a wall of the modular secondary containment unit; and wherein each of the track segment, the wall segment, and the brace has a constant cross section across its entire length so that it can be manufactured using a pultrusion process.

2. The assembly of claim 1, wherein each of the track segment, the wall segment, and the brace is composed of one or more reinforced resin composite materials.

3. The assembly of claim 1, further comprising a liner having an edge portion disposed between the track segment and the wall segment.

4. The assembly of claim 1, wherein the assembly forms a corner of the modular secondary containment unit; and wherein each of the track segment, the wall segment, and the brace comprises a mitered end portion adapted to be adjacent another mitered end portion of another track segment, wall segment, or brace.

5. The assembly of claim 1, wherein the track segment comprises a first horizontally-extending portion;

wherein the wall segment comprises an angularly-extending portion that extends angularly upward from the track segment;

wherein the brace comprises a plate extending angularly upward from the track segment and engaging the angularly-extending portion of the wall segment; and wherein a first angle is defined between the first horizontally-extending portion of the track segment and the angularly-extending portion of the wall segment.

6. The assembly of claim 5, wherein the first angle ranges from about 10 degrees to less than about 90 degrees.

7. The assembly of claim 5, wherein the first angle ranges from about 65 degrees to about 75 degrees.

8. The assembly of claim 5, wherein the angularly-extending portion of the wall segment defines a first surface adapted to engage a fluid to be contained by the secondary containment unit, and a second surface with which the brace is engaged; and wherein the brace further comprises a tab extending along the plate and within the second channel of the track segment.

9. The assembly of claim 5, wherein the wall segment comprises further comprises:

a second horizontally-extending portion from which the angularly-extending portion extends angularly upward, wherein a second angle is defined between the angularly-extending portion and the second horizontally-extending portion, the second angle being substantially equal to the first angle;

a first vertically-extending wall connected to the second horizontally-extending portion on one side thereof; and a second vertically-extending wall connected to the second horizontally-extending portion on the side thereof opposing the first vertical wall;

wherein the second vertically-extending wall of the wall segment extends within the first channel of the track segment;

wherein the track segment further comprises a third vertically-extending wall to which the first horizontally-extending portion is connected; and wherein the first horizontally-extending portion of the track segment extends between the third vertically-extending wall of the track segment and the first channel of the track segment.

10. The assembly of claim 9, wherein a portion of a liner is adapted to be disposed between the first horizontally-extending portion of the track segment and the second horizontally-extending portion of the wall segment, and between the third vertically-extending wall of the track segment and the first vertically-extending wall of the wall segment; and wherein, when the portion of the liner is disposed between the first horizontally-extending portion of the track segment and the second horizontally-extending portion of the wall segment, and between the third vertically-extending wall of the track segment and the first vertically-extending wall of the wall segment, the first and second horizontally-extending portions are spaced in a generally parallel relation, and the third and first vertically-extending walls are spaced in a generally parallel relation.

11. The assembly of claim 9, wherein a first force is adapted to be applied against the angularly-extending portion of the wall segment in response to the containment of fluid by the secondary containment unit;

wherein a second force is adapted to be applied against the angularly-extending portion of the wall segment in response to wind loading, the second force being opposite in direction to that of the first force;

wherein the third vertically-extending wall of the track segment is adapted to prevent the first vertically-extending wall of the wall segment from appreciably rotating in response to the application of the second force; and wherein the extension of the second vertically-extending wall of the wall segment within the first channel of the track segment is adapted to prevent the second vertically-extending wall of the wall segment from appreciably rotating in response to the application of the second force.

12. The assembly of claim 9, wherein a force is adapted to be applied against the angularly-extending portion of the wall segment in response to the containment of fluid by the secondary containment unit; and wherein the assembly is adapted to dynamically respond to the application of the force.

13. The assembly of claim 9, wherein a force is adapted to be applied against the angularly-extending portion of the wall segment in response to the containment of fluid by the secondary containment unit; and wherein the first vertically-extending wall of the wall segment is adapted to move upwards in response to the application of the force.

14. The assembly of claim 5, wherein the angularly-extending portion of the wall segment defines a first surface adapted to engage a fluid to be contained by the secondary containment unit, and a second surface with which the brace is engaged;

wherein the wall segment further comprises an angular rib that extends along at least a portion of the second surface of the angularly-extending portion;

wherein the angular rib extends angularly downward from the second surface of the angularly-extending portion;

wherein a vertex is defined between the angular rib and the second surface; and wherein the plate of the brace is disposed in the vertex between the angular rib and the second surface.

15. The assembly of claim 2, wherein the one or more reinforced resin composite materials comprise vinyl esters, epoxies, polyurethanes, polyureas, acrylics, styrenics, melamines, phenol-formaldehydes, polyimides, or any combination or mixture thereof.

16. An assembly for a modular secondary containment unit, the assembly comprising:

a track segment comprising first and second channels;

a wall segment mounted on the track segment and extending within the first channel of the track segment;

a brace engaged with the wall segment and extending within the second channel of the track segment; and a liner having an edge portion pinched between the track segment and the wall segment;

wherein each of the track segment, the wall segment, and the brace has a constant cross section across its entire length so that it can be manufactured using a pultrusion process.

17. The assembly of claim 16, wherein the track segment comprises a first horizontally-extending portion;

wherein the wall segment comprises an angularly-extending portion that extends angularly upward from the track segment;

wherein the brace comprises a plate extending angularly upward from the track segment and engaging the angularly-extending portion of the wall segment; and wherein a first angle is defined between the first horizontally-extending portion of the track segment and the angularly-extending portion of the wall segment.

18. The assembly of claim 17, wherein the wall segment comprises further comprises:

a second horizontally-extending portion from which the angularly-extending portion extends angularly upward, wherein a second angle is defined between the angularly-extending portion and the second horizontally-extending portion, the second angle being substantially equal to the first angle;

a first vertically-extending wall connected to the second horizontally-extending portion on one side thereof; and a second vertically-extending wall connected to the second horizontally-extending portion on the side thereof opposing the first vertical wall;

wherein the second vertically-extending wall of the wall segment extends within the first channel of the track segment;

wherein the track segment further comprises a third vertically-extending wall to which the first horizontally-extending portion is connected; and wherein the first horizontally-extending portion of the track segment extends between the third vertically-extending wall of the track segment and the first channel of the track segment.

19. An assembly for a modular secondary containment unit, the assembly comprising:

a first track segment comprising first and second channels;

a first wall segment mounted on the first track segment and extending within the first channel of the first track segment;

a first brace engaged with the first wall segment and extending within the second channel of the first track segment;

a second track segment comprising first and second channels;

a second wall segment mounted on the second track segment and extending within the first channel of the second track segment;

a second brace engaged with the second wall segment and extending within the second channel of the second track segment;

a corner assembly disposed between the first track segment and the second track segment, the corner assembly comprising:

a corner track segment;

a corner wall segment;

a first corner brace; and a second corner brace;

wherein each of the first track segment, the first wall segment, and the first brace has a constant cross section across its entire length so that it can be manufactured using a pultrusion process.

20. The assembly of claim 19, wherein each of the corner track segment, the corner wall segment, the first corner brace, and the second corner brace is composed of one or more reinforced resin composite materials selected from the group consisting of vinyl esters, epoxies, polyurethanes, polyureas, acrylics, styrenics, melamines, phenol-formaldehydes, and polyimides and any combinatoin thereof.

* * * * *